US011669116B2

(12) United States Patent
Gupta et al.

(10) Patent No.: US 11,669,116 B2
(45) Date of Patent: Jun. 6, 2023

(54) LOW DROPOUT REGULATOR

(71) Applicant: NXP B.V., Eindhoven (NL)

(72) Inventors: Sushil Kumar Gupta, Bangalore (IN); Pankaj Agrawal, Bangalore (IN)

(73) Assignee: NXP B.V., Eindhoven (NL)

( * ) Notice: Subject to any disclaimer, the term of this patent is extended or adjusted under 35 U.S.C. 154(b) by 3 days.

(21) Appl. No.: 17/304,636

(22) Filed: Jun. 23, 2021

(65) Prior Publication Data

US 2022/0413532 A1 Dec. 29, 2022

(51) Int. Cl.
*G05F 1/575* (2006.01)

(52) U.S. Cl.
CPC ..... *G05F 1/575* (2013.01)

(58) Field of Classification Search
CPC . G05F 1/575; G05F 1/59; G05F 1/595; G05F 1/613; G05F 1/567; G05F 1/563
See application file for complete search history.

(56) References Cited

U.S. PATENT DOCUMENTS 6,150,872 A * 11/2000 McNeill ..... G05F 3/30 327/539
6,294,902 B1 9/2001 Moreland et al.
7,750,728 B2 7/2010 Marinca
9,030,186 B2 5/2015 Gupta et al.
9,213,349 B2 12/2015 Hu et al.
9,594,391 B2 3/2017 De Cremoux
9,780,652 B1 10/2017 Far
2009/0146730 A1 6/2009 Chen
2017/0147028 A1 5/2017 Arnold et al.
2017/0269627 A1* 9/2017 Cook ..... G05F 3/267
2020/0125129 A1* 4/2020 Ibrahim ..... G05F 3/225

OTHER PUBLICATIONS

U.S. Appl. No. 17/247,257, filed Dec. 4, 2020, entitled: Utilization of Voltage-Controlled Currents in Electronic Systems. The Examiner is referred to the copending patent prosecution of the common Applicant (no attachment).
U.S. Appl. No. 17/302,399, filed Apr. 30, 2021, entitled: Bandgap Voltage Regulator. The Examiner is referred to the copending patent prosecution of the common Applicant (no attachment).
Allen, P., "Temperature-Independent References", In: "CMOS Analog Circuit Design—Third Edition", Oxford University Press, XP055980113, pp. 156-172, Aug. 5, 2011.

* cited by examiner

*Primary Examiner* — Nguyen Tran

(57) ABSTRACT

A low dropout regulator includes a proportional-to-absolute-temperature (PTAT) circuit, an amplification circuit, and an output circuit. The PTAT circuit outputs one current, and the amplification circuit outputs one or more currents. The one or more currents are outputted by the amplification circuit based on collector-emitter voltages associated with transistors of the PTAT circuit. Alternatively, the one or more currents are outputted by the amplification circuit based on the current outputted by the PTAT circuit and the collector-emitter voltages associated with the transistors of the PTAT circuit. The output circuit generates one or more output voltages based on at least one of a base-emitter voltage associated with a transistor of the PTAT circuit and a current of the one or more currents outputted by the amplification circuit.

17 Claims, 17 Drawing Sheets

LOW DROPOUT REGULATOR

BACKGROUND

The present disclosure relates generally to electronic circuits, and, more particularly, to a low dropout (LDO) regulator.

LDO regulators are widely used in system-on-chips (SoCs) for providing output voltages to various functional circuits (e.g., analog-to-digital converters, power management units, or the like) of the SoCs. Based on the output voltages, the functional circuits execute various functional operations associated therewith. The LDO regulators can generate the output voltages that are less than a threshold value. The threshold value corresponds to a bandgap voltage at 0 kelvin (i.e., 1.23 volts). Hence, the LDO regulators can be utilized for biasing the functional circuits that require sub-bandgap voltages (i.e., voltages less than 1.23 volts).

Typically, a lowest voltage level of the output voltage that can be generated by an LDO regulator is limited by collector-emitter saturation voltages of bipolar transistors included therein. For example, the lowest voltage level of the output voltage that can be generated by the LDO regulator is limited to 0.4 volts. The functional circuits of an SoC can however require voltages less than the lowest voltage level of the output voltage for executing the functional operations associated therewith. The LDO regulator is incapable of facilitating the execution of functional operations of such functional circuits. Additionally, the functional circuits require one or more currents for executing the functional operations associated therewith. The LDO regulator is incapable of generating such currents. To solve this problem, various current reference circuits are included in the SoC. Such current reference circuits lead to an increase in a size and a manufacturing cost of the SoC. Further, each functional circuit of the SoC may require a different output voltage for executing the functional operation associated therewith. Typically, one LDO regulator can generate a single output voltage. Thus, multiple LDO regulators are required to be included in the SoC for generating multiple output voltages. This leads to a further increase in the size and the manufacturing cost of the SoC. Therefore, there exists a need for a technical solution that solves the aforementioned problems of existing LDO regulators.

SUMMARY

In an embodiment of the present disclosure, a low dropout (LDO) regulator is disclosed. The LDO regulator can include a proportional-to-absolute-temperature (PTAT) circuit, an amplification circuit, and an output circuit. The PTAT circuit can be configured to output a first current. The PTAT circuit can include a plurality of transistors. The amplification circuit can be coupled with the PTAT circuit, and configured to output a second set of currents. The second set of currents can be outputted based on first and second collector-emitter voltages associated with first and second transistors of the plurality of transistors, respectively. Alternatively, the second set of currents can be outputted based on the first current and the first and second collector-emitter voltages. The output circuit can be configured to generate a set of output voltages based on at least one of a second current of the second set of currents and a base-emitter voltage associated with the second transistor.

In another embodiment of the present disclosure, a system-on-chip (SoC) is disclosed. The SoC can include an LDO regulator and a functional circuit. The LDO regulator can further include a PTAT circuit, an amplification circuit, and an output circuit. The PTAT circuit can be configured to output a first current. The PTAT circuit can include a plurality of transistors. The amplification circuit can be coupled with the PTAT circuit, and configured to output a second set of currents. The second set of currents can be outputted based on first and second collector-emitter voltages associated with first and second transistors of the plurality of transistors, respectively. Alternatively, the second set of currents can be outputted based on the first current and the first and second collector-emitter voltages. The output circuit can be configured to generate a set of output voltages based on at least one of a second current of the second set of currents and a base-emitter voltage associated with the second transistor. Further, the functional circuit can be coupled with the LDO regulator, and configured to receive the set of output voltages, and execute one or more functional operations associated therewith.

In some embodiments, each transistor of the first and second transistors has first through third terminals. Further, the first terminals of the first and second transistors can be coupled with the amplification circuit. The first terminal of the first transistor can be configured to output the first current, and the second terminal of the first transistor can be coupled with the second terminal of the second transistor. The third terminal of the second transistor can be coupled with a ground terminal. The PTAT circuit can further include a first resistor that can be coupled between the third terminal of the first transistor and the ground terminal.

In some embodiments, the LDO regulator can further include a voltage divider that can be coupled between the second terminal of the second transistor and the ground terminal. The voltage divider can be configured to output a first control voltage such that the first control voltage is a scaled version of the base-emitter voltage associated with the second transistor.

In some embodiments, the amplification circuit can include a first current mirror circuit, a first amplifier, and a second current mirror circuit. The first current mirror circuit can be coupled with the first terminals of the first and second transistors and the output circuit. Further, the first current mirror circuit can be configured to output, based on a supply voltage and the first current, the second current, and third and fourth currents of the second set of currents. The third current can be equal to the first current, and the first current mirror circuit can be further configured to provide the third current to the first terminal of the second transistor. The second and fourth currents can be scaled versions of the first current. Further, the first current mirror circuit can output the second current such that the second current is sunk from the output circuit. The first amplifier can be coupled with the first terminals of the first and second transistors, and configured to receive the first and second collector-emitter voltages, respectively, and generate a second control voltage. The second current mirror circuit can be coupled with the first amplifier and the voltage divider. Further, the second current mirror circuit can be configured to output, based on the supply voltage and the second control voltage, fifth and sixth currents of the second set of currents such that the sixth current is a scaled version of the fifth current. The second current mirror circuit can be further configured to provide the fifth current to the voltage divider. Further, the voltage divider can output the first control voltage based on the fifth current.

In some embodiments, the LDO regulator can further include a current summing circuit that can be coupled with the first and second current mirror circuits. The current summing circuit can be configured to receive the fourth and sixth currents, respectively, and generate an output current that is equal to a sum of the fourth and sixth currents.

In some embodiments, the output circuit can include a second amplifier and a second resistor. The second amplifier can be coupled with the voltage divider, and configured to receive the first control voltage and a third control voltage, and generate a first output voltage of the set of output voltages. The second resistor can be coupled with the second amplifier in a negative feedback configuration. The second resistor can be further coupled with the first current mirror circuit such that the second current outputted by the first current mirror circuit is sunk from the second resistor. Further, the second resistor can be configured to output and provide, based on the second current, the third control voltage to the second amplifier.

In some embodiments, the output circuit can include a third amplifier and third and fourth resistors. The third amplifier can be coupled with the voltage divider, and configured to receive the first control voltage and a fourth control voltage, and generate a first output voltage of the set of output voltages. The third and fourth resistors can be coupled with the third amplifier in negative and positive feedback configurations, respectively. The third resistor can be further coupled with the first current mirror circuit such that the second current outputted by the first current mirror circuit is sunk from the third resistor. Further, the fourth resistor can be coupled with the voltage divider, and configured to receive the first control voltage. The third resistor can be further configured to output and provide, based on the second current and a voltage drop across the fourth resistor, the fourth control voltage to the third amplifier.

In some embodiments, the first current mirror circuit can be further coupled with the voltage divider, and configured to provide the fourth current to the voltage divider. Further, the voltage divider can output the first control voltage based on the fourth current. The output circuit can correspond to a fourth amplifier that can be coupled in a negative feedback configuration, and further coupled with the voltage divider. The fourth amplifier can be configured to receive the first control voltage, and generate a first output voltage of the set of output voltages.

In some embodiments, the amplification circuit can include fifth and sixth resistors and a voltage-to-current converter. The fifth and sixth resistors can be coupled with the first terminals of the first and second transistors, respectively. The fifth and sixth resistors can be further configured to receive one of a first output voltage of the set of output voltages and a fifth control voltage. The voltage-to-current converter can be coupled with the first terminals of the first and second transistors and the voltage divider. Further, the voltage-to-current converter can be configured to receive a supply voltage and the first and second collector-emitter voltages, and output and provide the second current to the voltage divider. The voltage divider can output the first control voltage based on the second current.

In some embodiments, the output circuit can correspond to a fifth amplifier that can be coupled with the voltage divider and the first terminal of the second transistor. The fifth amplifier can be configured to receive the first control voltage and the second collector-emitter voltage, respectively, and generate and provide the first output voltage to the fifth and sixth resistors.

In some embodiments, the output circuit can include a sixth amplifier and a seventh resistor. The sixth amplifier can be coupled with the voltage divider, and configured to receive the first control voltage and the fifth control voltage, and generate the first output voltage. The seventh resistor can be coupled with the sixth amplifier in a negative feedback configuration, and further coupled with the fifth and sixth resistors. The seventh resistor can be further configured to output and provide the fifth control voltage to the sixth amplifier and the fifth and sixth resistors.

In some embodiments, the output circuit can include a seventh amplifier and an eighth resistor. The seventh amplifier can be coupled with the voltage divider and the first terminal of the second transistor. The seventh amplifier can be configured to receive the first control voltage and the second collector-emitter voltage, respectively, and generate and provide the first output voltage to the fifth and sixth resistors. The eighth resistor can be coupled with the seventh amplifier in a positive feedback configuration, and further coupled with the voltage divider.

In some embodiments, the amplification circuit can include a third current mirror circuit, an eighth amplifier, and a fourth current mirror circuit. The third current mirror circuit can be coupled with the first terminals of the first and second transistors. The third current mirror circuit can be configured to output seventh and eighth currents of the second set of currents based on a supply voltage, a sixth control voltage, and the first current. The seventh current can be equal to the first current, and the third current mirror circuit can be further configured to provide the seventh current to the first terminal of the second transistor. The eighth current can be a scaled version of the first current. The eighth amplifier can be coupled with the first terminals of the first and second transistors and the third current mirror circuit. The eighth amplifier can be configured to receive the first and second collector-emitter voltages, and generate and provide the sixth control voltage to the third current mirror circuit. The fourth current mirror circuit can be coupled with the third current mirror circuit, the first terminal of the first transistor, the output circuit, and the voltage divider. The fourth current mirror circuit can be configured to output the second current and a ninth current of the second set of currents based on the supply voltage, the eighth current, and the first collector-emitter voltage. The fourth current mirror circuit can output the second current such that the second current is sunk from the output circuit. The fourth current mirror circuit can be further configured to output and provide the ninth current to the voltage divider. The voltage divider can output the first control voltage based on the ninth current.

In some embodiments, the output circuit can include a ninth amplifier and a ninth resistor. The ninth amplifier can be coupled with the voltage divider, and configured to receive the first control voltage and a seventh control voltage, and generate a first output voltage of the set of output voltages. The ninth resistor can be coupled with the ninth amplifier in a negative feedback configuration, and further coupled with the fourth current mirror circuit. The second current outputted by the fourth current mirror circuit can be sunk from the ninth resistor. Further, the ninth resistor can be configured to output and provide, based on the second current, the seventh control voltage to the ninth amplifier.

In some embodiments, the amplification circuit can include tenth and eleventh resistors, a tenth amplifier, and a fifth current mirror circuit. The tenth and eleventh resistors can be coupled with the first terminals of the first and second transistors, respectively. The tenth and eleventh resistors can be further coupled with the output circuit, and configured to receive a first output voltage of the set of output voltages. The tenth amplifier can be coupled with the first terminals of the first and second transistors, and configured to receive the first and second collector-emitter voltages, respectively, and generate an eighth control voltage. The fifth current mirror circuit can be coupled with the tenth amplifier. Further, the fifth current mirror circuit can be configured to output the second current based on a supply voltage, the eighth control voltage, and the base-emitter voltage associated with the second transistor. The fifth current mirror circuit can be further coupled with the output circuit, and configured to provide the second current to the output circuit.

In some embodiments, the output circuit can include an eleventh amplifier and a twelfth resistor. The eleventh amplifier can be coupled with the first terminal of the second transistor, and configured to receive the second collector-emitter voltage and a ninth control voltage, and generate the first output voltage of the set of output voltages. The twelfth resistor can be coupled between the fifth current mirror circuit and the ground terminal, and further coupled with the eleventh amplifier. Further, the twelfth resistor can be configured to receive the second current, and output and provide, based on the second current, the ninth control voltage to the eleventh amplifier.

In some embodiments, the output circuit can include a twelfth amplifier and a thirteenth resistor. The twelfth amplifier can be coupled with the first terminal of the second transistor, and configured to receive the second collector-emitter voltage and a tenth control voltage, and generate the first output voltage and a second output voltage of the set of output voltages. The thirteenth resistor can be coupled with the twelfth amplifier in a positive feedback configuration, and further coupled with the fifth current mirror circuit. The thirteenth resistor can be configured to receive the second output voltage and the second current, and output and provide the tenth control voltage to the twelfth amplifier.

In some embodiments, the amplification circuit can include a sixth current mirror circuit, a thirteenth amplifier, and a seventh current mirror circuit. The sixth current mirror circuit can be coupled with the first terminals of the first and second transistors and the output circuit. The sixth current mirror circuit can be configured to output, based on a supply voltage and the first current, the second current and a tenth current of the second set of currents. The tenth current can be equal to the first current, and the sixth current mirror circuit can be further configured to provide the tenth current to the first terminal of the second transistor. The second current can be a scaled version of the first current. Further, the sixth current mirror circuit can output the second current such that the second current is sunk from the output circuit. The thirteenth amplifier can be coupled with the first terminals of the first and second transistors, and configured to receive the first and second collector-emitter voltages, respectively, and generate an eleventh control voltage. The seventh current mirror circuit can be coupled with the thirteenth amplifier. The seventh current mirror circuit can be configured to output an eleventh current of the second set of currents based on the supply voltage, the eleventh control voltage, and the base-emitter voltage associated with the second transistor. Further, the seventh current mirror circuit can be coupled with the output circuit, and configured to provide the eleventh current to the output circuit.

In some embodiments, the output circuit can include a fourteenth amplifier, a fourteenth resistor, and a fifteenth resistor. The fourteenth amplifier can be coupled with the sixth and seventh current mirror circuits, and configured to receive twelfth and thirteenth control voltages, and generate first and second output voltages of the set of output voltages. The fourteenth resistor can be coupled with the fourteenth amplifier in a negative feedback configuration, and further coupled with the sixth current mirror circuit. The second current outputted by the sixth current mirror circuit can be sunk from the fourteenth resistor. Further, the fourteenth resistor can be configured to output and provide, based on the second current and the first output voltage, the twelfth control voltage to the fourteenth amplifier. The fifteenth resistor can be coupled with the fourteenth amplifier in a positive feedback configuration, and further coupled with the seventh current mirror circuit. The fifteenth resistor can be configured to receive the second output voltage and the eleventh current, and output and provide the thirteenth control voltage to the fourteenth amplifier.

Various embodiments of the present disclosure disclose an LDO regulator. The LDO regulator can include a PTAT circuit, an amplification circuit, and an output circuit. The PTAT circuit can output a current. Further, the amplification circuit can output a set of currents based on collector-emitter voltages associated with transistors of the PTAT circuit. Alternatively, the amplification circuit can output the set of currents based on the current outputted by the PTAT circuit and the collector-emitter voltages associated with transistors of the PTAT circuit. The output circuit can include an amplifier that can generate one or more output voltages based on at least one of a current of the set of currents outputted by the amplification circuit and a base-emitter voltage associated with a transistor of the PTAT circuit. The LDO regulator can further include a current summing circuit that can generate an output current. The one or more output voltages and the output current can be provided to a functional circuit for facilitating the execution of various functional operations of the functional circuit.

A lowest voltage level of an output voltage generated by the LDO regulator of the present disclosure is limited by drain-source saturation voltages associated with transistors of the amplifier of the output circuit. On the other hand, a lowest voltage level of an output voltage generated by a conventional LDO regulator is limited by collector-emitter voltages of transistors included therein. A drain-source saturation voltage of a transistor is significantly less than a collector-emitter voltage of the transistor. As a result, the lowest voltage level of the output voltage generated by the LDO regulator of the present disclosure is significantly less than that generated by the conventional LDO regulator. The LDO regulator of the present disclosure can further generate and provide the output current to the functional circuit. Additionally, the LDO regulator can output multiple output voltages simultaneously by utilizing a single PTAT circuit. As a result, a need to include current reference circuits and multiple LDO regulators in an SoC of the present disclosure is eliminated. Therefore, a size and a manufacturing cost of the SoC that includes the LDO regulator of the present disclosure are significantly less than that of an SoC including multiple conventional LDO regulators and current reference circuits.

BRIEF DESCRIPTION OF THE DRAWINGS

The following detailed description of the preferred embodiments of the present disclosure will be better understood when read in conjunction with the appended drawings. The present disclosure is illustrated by way of example, and not limited by the accompanying figures, in which like references indicate similar elements.

DETAILED DESCRIPTION

The detailed description of the appended drawings is intended as a description of the currently preferred embodiments of the present disclosure, and is not intended to represent the only form in which the present disclosure may be practiced. It is to be understood that the same or equivalent functions may be accomplished by different embodiments that are intended to be encompassed within the spirit and scope of the present disclosure.

Figure 1:
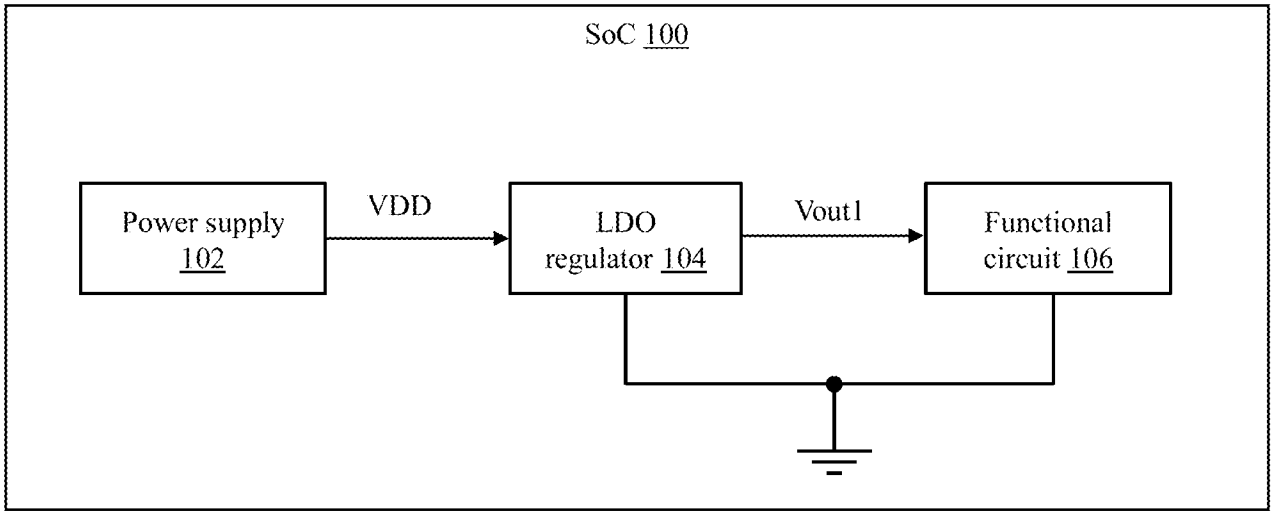
FIG. 1 illustrates a schematic block diagram of a system-on-chip (SoC) in accordance with an embodiment of the present disclosure.

FIG. 1 illustrates a schematic block diagram of a system-on-chip (SoC) 100 in accordance with an embodiment of the present disclosure. The SoC 100 can include a power supply 102 that can be configured to generate a supply voltage VDD. In an example, the supply voltage VDD is equal to 1 volt. Further, the SoC 100 can include a low dropout (LDO) regulator 104 and a functional circuit 106. The SoC 100 can be included in various devices such as automotive devices, network devices, or the like.

The LDO regulator 104 can be coupled between the power supply 102 and a ground terminal. Further, the LDO regulator 104 can be coupled with the functional circuit 106. The LDO regulator 104 can be configured to receive the supply voltage VDD from the power supply 102, and generate a first output voltage Vout1. Further, the LDO regulator 104 can be configured to provide the first output voltage Vout1 to the functional circuit 106. In an embodiment, the first output voltage Vout1 is less than a threshold value (not shown). The threshold value corresponds to a bandgap voltage at 0 kelvin (K) (e.g., 1.23V). The LDO regulator 104 is explained in detail in conjunction with FIGS. 2-17.

The functional circuit 106 can be coupled between the LDO regulator 104 and the ground terminal. The functional circuit 106 can include suitable circuitry that can be configured to perform one or more operations. For example, the functional circuit 106 can be configured to receive the first output voltage Vout1, and execute one or more functional operations associated therewith. Examples of the functional circuit 106 can include analog-to-digital converters, power management units, or the like.

Figure 2:
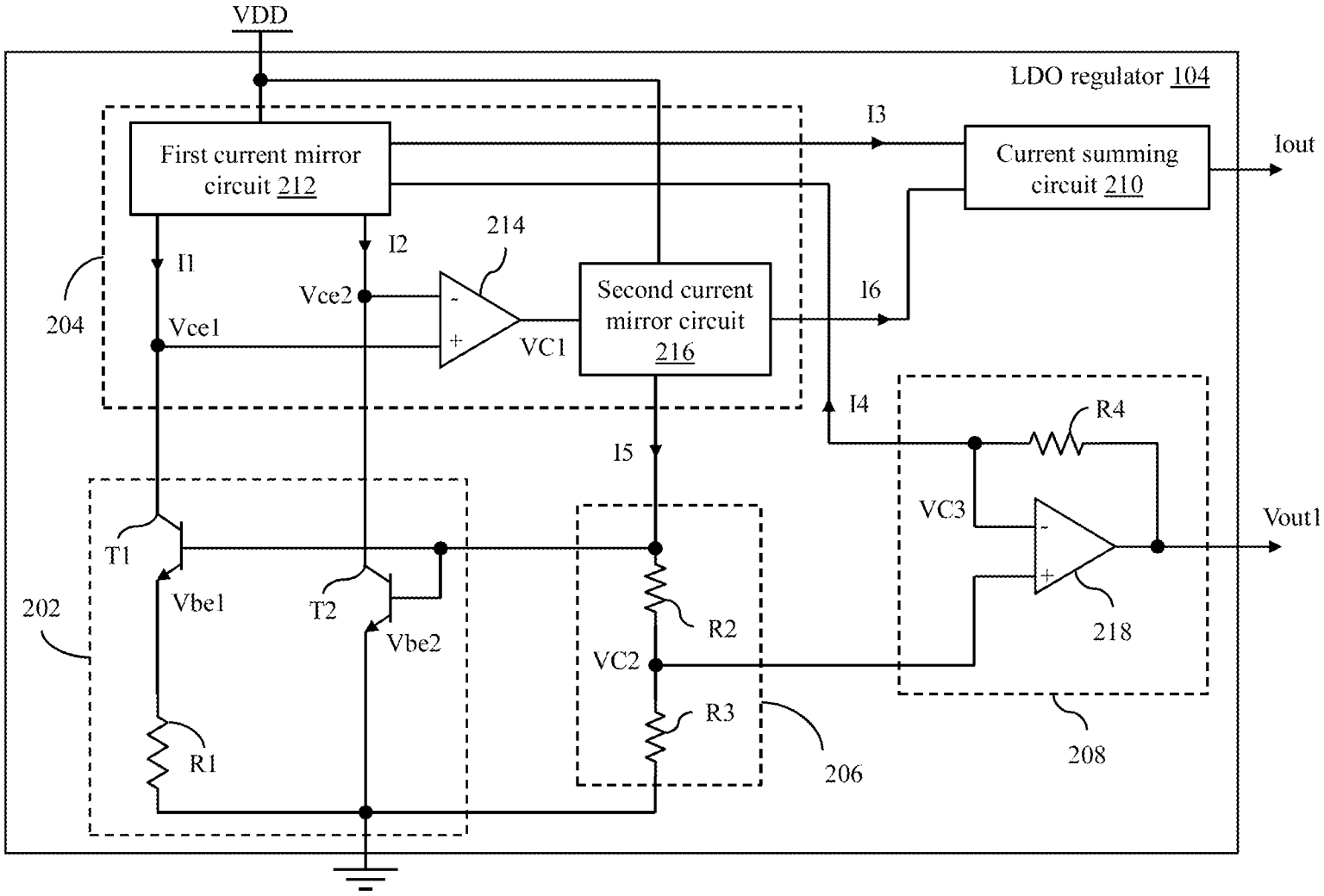
FIG. 2 illustrates a schematic circuit diagram of a low dropout (LDO) regulator of the SoC of FIG. 1 in accordance with an embodiment of the present disclosure.
Figure 3:
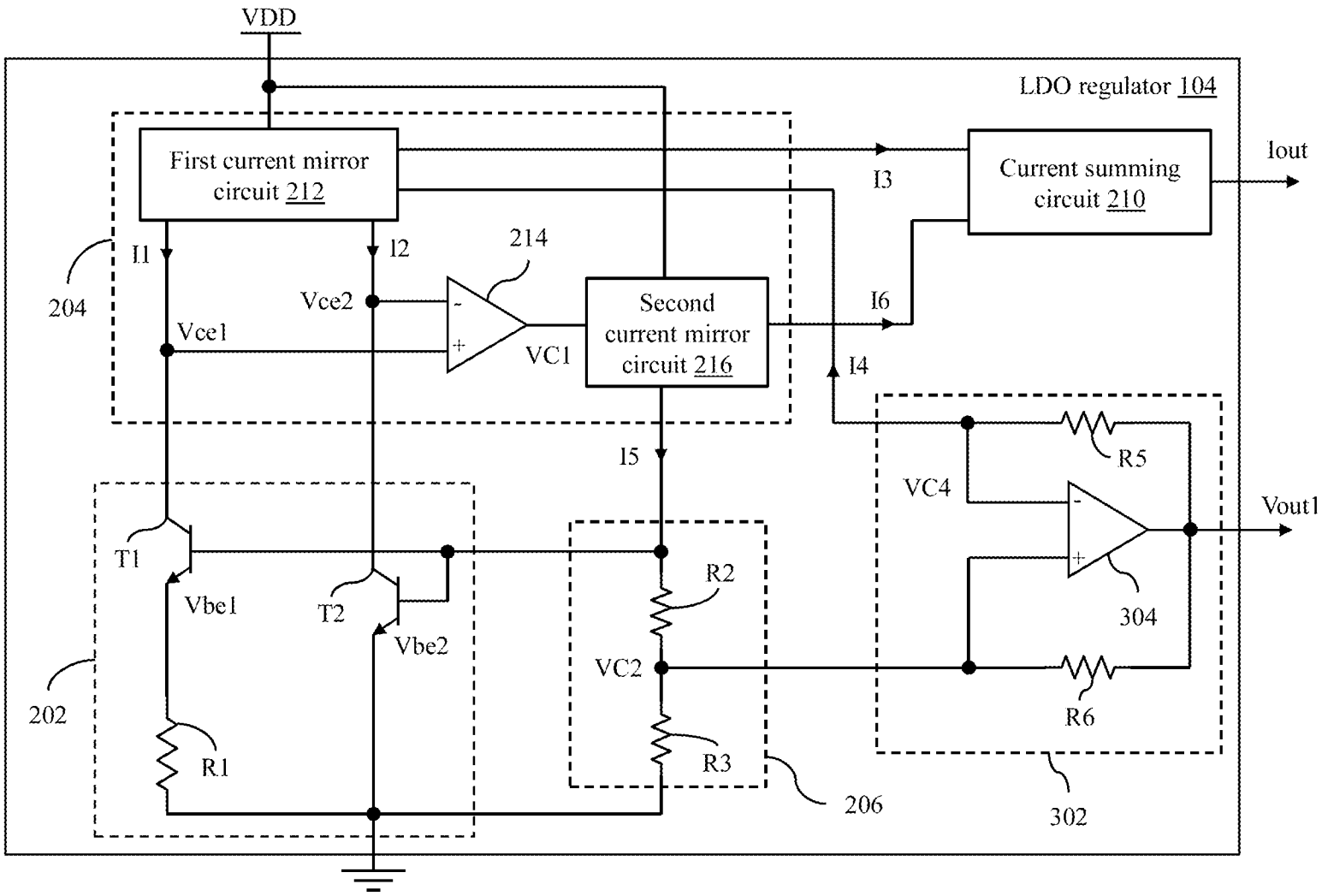
FIG. 3 illustrates a schematic circuit diagram of the LDO regulator of the SoC of FIG. 1 in accordance with another embodiment of the present disclosure.
Figure 4:
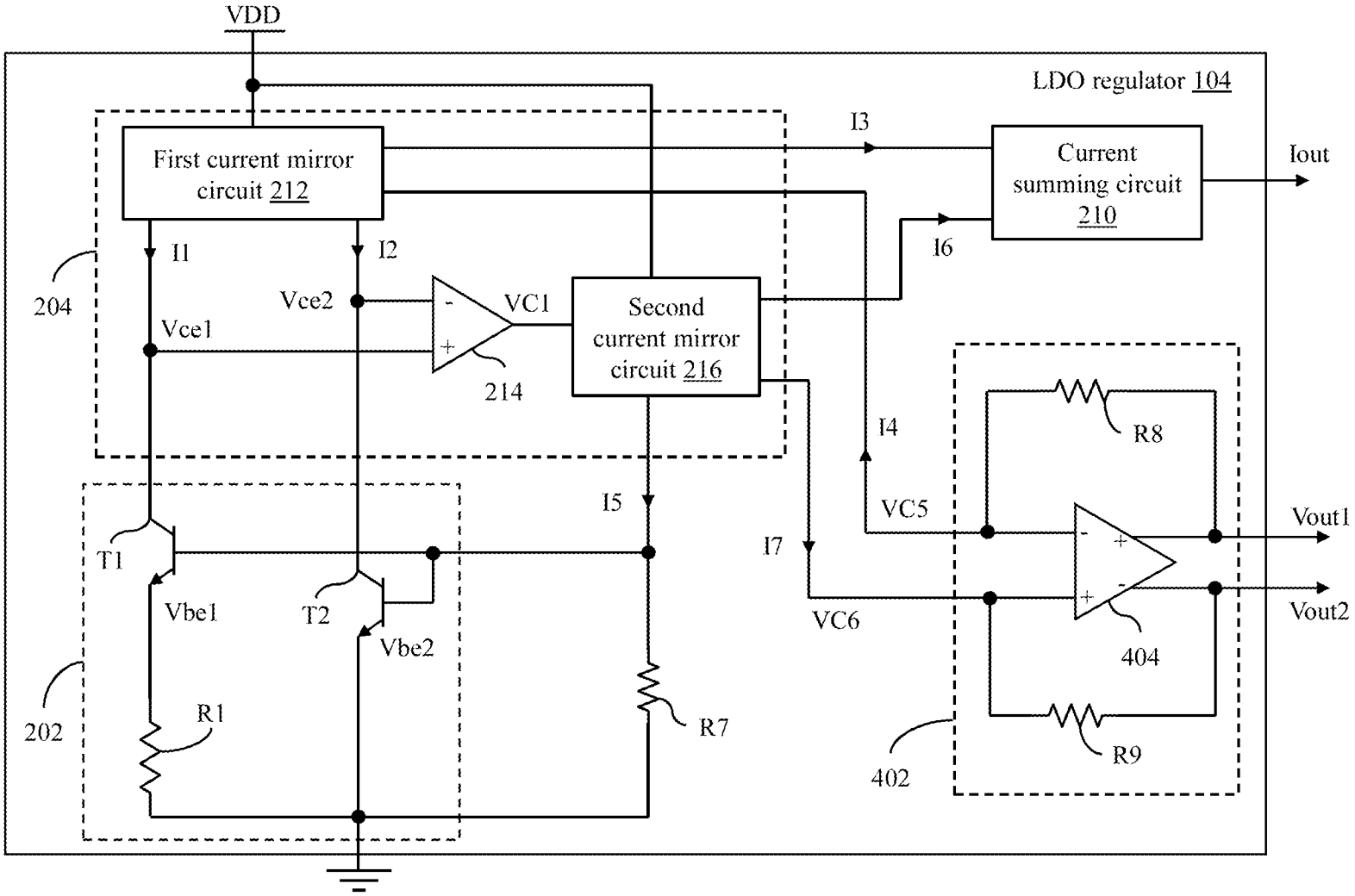
FIG. 4 illustrates a schematic circuit diagram of the LDO regulator of the SoC of FIG. 1 in accordance with yet another embodiment of the present disclosure.
Figure 5:
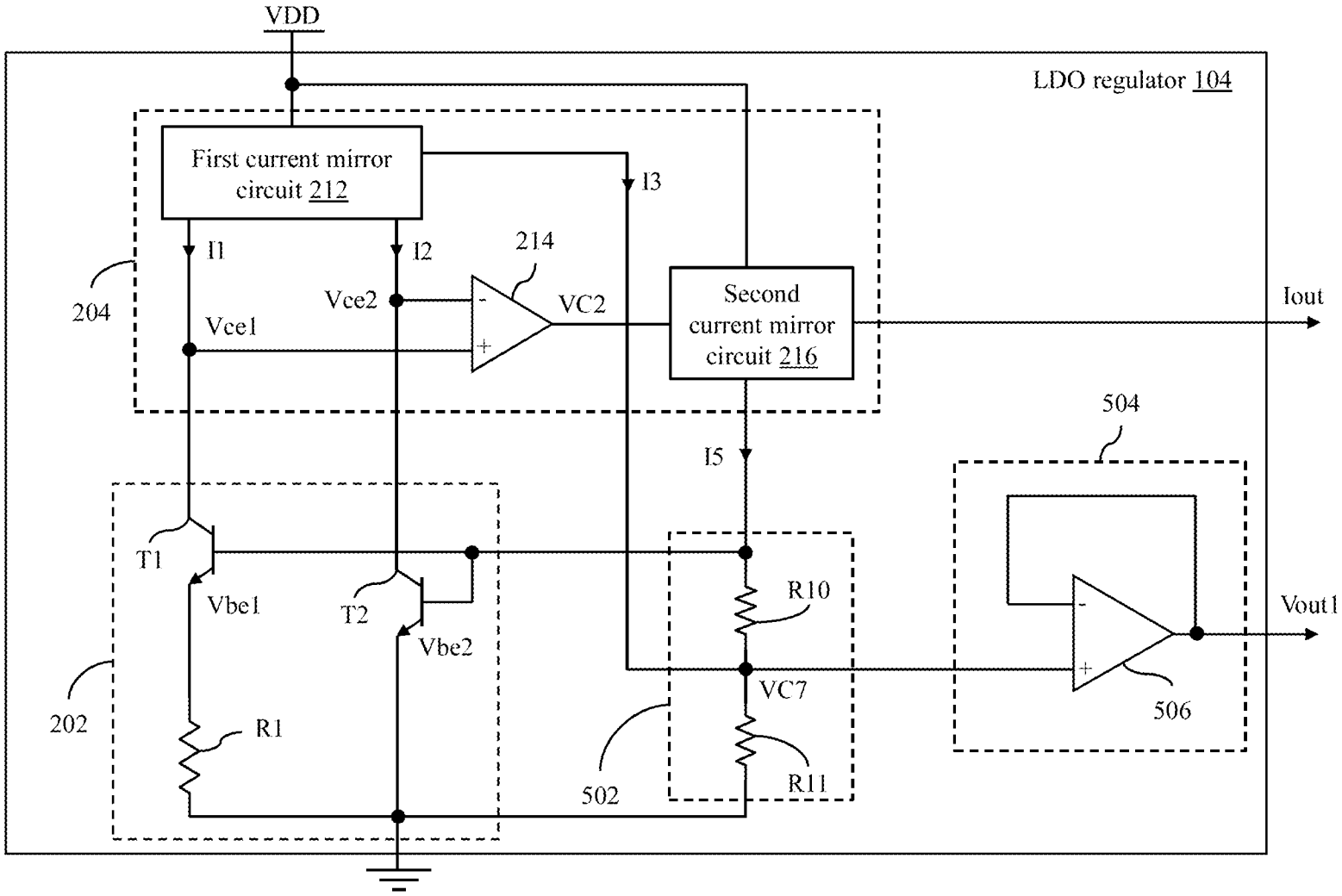
FIG. 5 illustrates a schematic circuit diagram of the LDO regulator of the SoC of FIG. 1 in accordance with yet another embodiment of the present disclosure.
Figure 15:
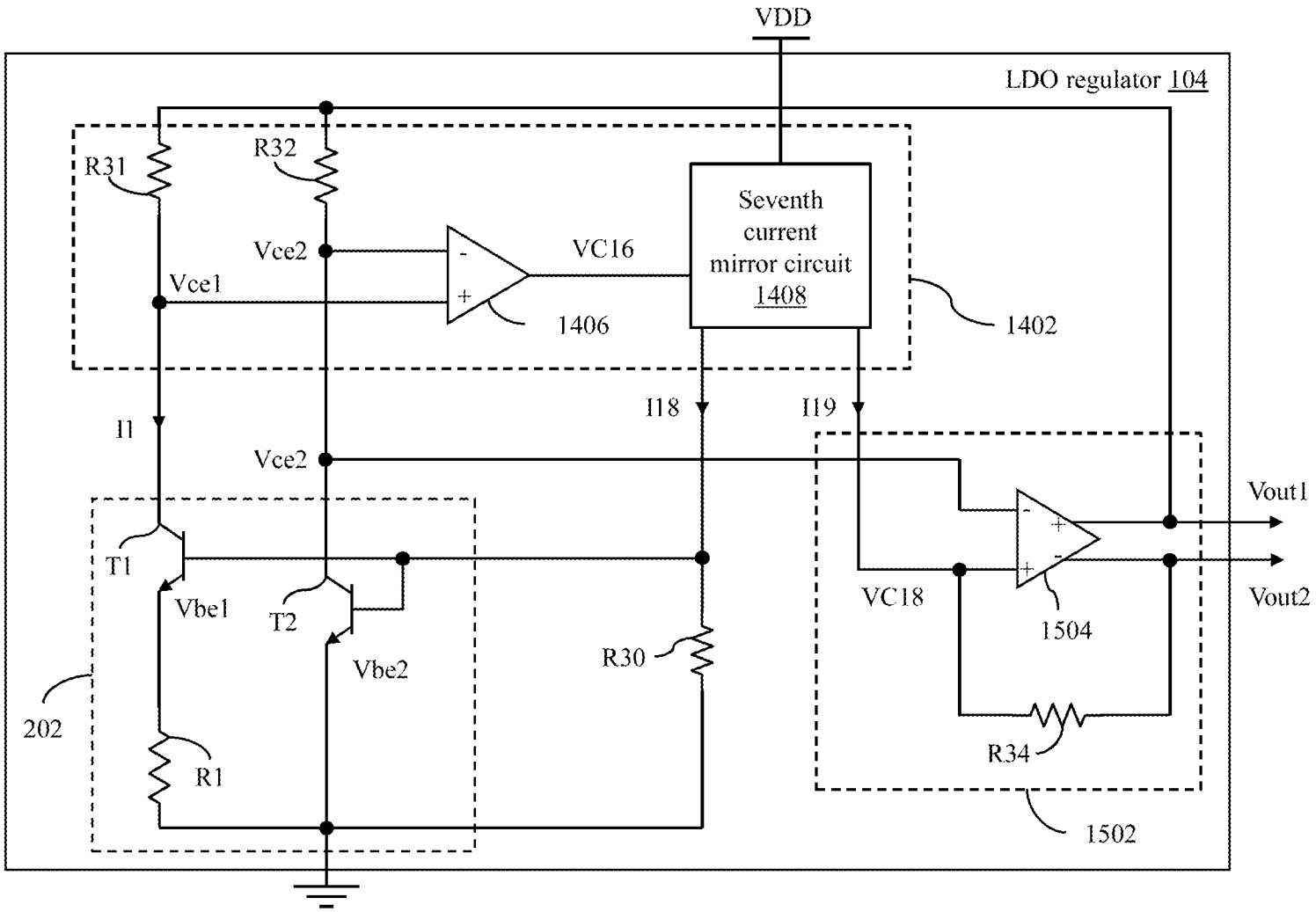
FIG. 15 illustrates a schematic circuit diagram of the LDO regulator of the SoC of FIG. 1 in accordance with yet another embodiment of the present disclosure.

Although FIG. 1 describes that the LDO regulator 104 generates one output voltage (i.e., the first output voltage Vout1), the scope of the present disclosure is not limited to it. In various other embodiments, the LDO regulator 104 can be further configured to generate a second output voltage Vout2 and provide the second output voltage Vout2 to the functional circuit 106. Such a configuration of the LDO regulator 104 is shown in FIGS. 4 and 15. The functional circuit 106 can thus execute the one or more functional operations based on the first and second output voltages Vout1 and Vout2. Alternatively, the LDO regulator 104 can be further configured to generate an output current Iout, and provide the output current Iout to the functional circuit 106. Such a configuration of the LDO regulator 104 is shown in FIGS. 2, 3, and 5. The functional circuit 106 can thus execute the one or more functional operations based on the first output voltage Vout1 and the output current Iout. Additionally, the LDO regulator 104 can be further configured to generate and provide, in addition to the first output voltage Vout1, the second output voltage Vout2 and the output current Iout to the functional circuit 106. Such a configuration of the LDO regulator 104 is shown in FIG. 4. The functional circuit 106 can thus execute the one or more functional operations based on the first and second output voltages Vout1 and Vout2 and the output current Iout.

FIG. 2 illustrates a schematic circuit diagram of the LDO regulator 104 in accordance with an embodiment of the present disclosure. The LDO regulator 104 can include a first proportional-to-absolute-temperature (PTAT) circuit 202, a first amplification circuit 204, a first voltage divider 206, a first output circuit 208, and a current summing circuit 210. The LDO regulator 104 of FIG. 2 can be configured to generate and provide the first output voltage Vout1 and the output current Iout to the functional circuit 106.

The first PTAT circuit 202 can be coupled between the first amplification circuit 204 and the ground terminal, and further coupled with the first voltage divider 206. The first PTAT circuit 202 can be configured to output a first current I1. The first current I1 can be outputted such that the first current I1 is sunk from the first amplification circuit 204. The first PTAT circuit 202 can include first and second transistors T1 and T2 and a first resistor R1.

Each of the first and second transistors T1 and T2 has first through third terminals. The first terminals of the first and second transistors T1 and T2 can be coupled with the first amplification circuit 204. The first terminal of the first transistor T1 can be configured to output the first current I1. Further, the first terminal of the second transistor T2 can be configured to receive a second current I2 from the first amplification circuit 204. The second terminal of the first transistor T1 can be coupled with the second terminal of the second transistor T2. Further, the third terminal of the second transistor T2 can be coupled with the ground terminal. The first resistor R1 has first and second terminals that can be coupled with the third terminal of the first transistor T1 and the ground terminal, respectively.

The first and second transistors T1 and T2, in combination with the first resistor R1, can thus output the first current I1. In an embodiment, the first and second transistors T1 and T2 are NPN transistors, and the first through third terminals of the first and second transistors T1 and T2 correspond to collector, base, and emitter terminals, respectively. However, it will be apparent to the person skilled in the art that the scope of the present disclosure is not limited to the first and second transistors T1 and T2 being NPN transistors. In various other embodiments, the first and second transistors T1 and T2 can be PNP transistors, NMOS transistors, or the like, without deviating from the scope of the present disclosure. Further, a size of the first transistor T1 can be greater than a size of the second transistor T2. In an example, the size of the first transistor T1 is '8' times the size of the second transistor T2.

As the second and third terminals of the first and second transistors T1 and T2 correspond to base and emitter terminals, it will be apparent to a person skilled in the art that base-emitter voltages can be generated at junctions between the second and third terminals of the first and second transistors T1 and T2. For example, a first base-emitter voltage Vbe1 can be generated at a junction between the second and third terminals of the first transistor T1. Similarly, a second base-emitter voltage Vbe2 can be generated at a junction between the second and third terminals of the second transistor T2. In such a scenario, the first current I1 can be equal to a ratio of the difference between the first and second base-emitter voltages Vbe1 and Vbe2 (i.e., ΔVbe) and a resistance value of the first resistor R1. Further, as the first and third terminals of the first and second transistors T1 and T2 correspond to collector and emitter terminals, collector-emitter voltages can be generated at junctions between the first and third terminals of the first and second transistors T1 and T2. For example, first and second collector-emitter voltages Vce1 and Vce2 can be generated at junctions between the first and third terminals of the first and second transistors T1 and T2, respectively.

It will be apparent to a person skilled in the art that the scope of the present disclosure is not limited to the first PTAT circuit 202 including two transistors and one resistor. In various other embodiments, the first PTAT circuit 202 can include an additional resistor having a first terminal coupled with the second terminal of the first resistor R1 and the third terminal of the second transistor T2, and a second terminal coupled with the ground terminal, without deviating from the scope of the present disclosure.

The first amplification circuit 204 can be coupled with the power supply 102, the first PTAT circuit 202 (i.e., the first terminals of the first and second transistors T1 and T2), the first voltage divider 206, the first output circuit 208, and the current summing circuit 210. The first amplification circuit 204 can be configured to receive the supply voltage VDD from the power supply 102. Further, the first amplification circuit 204 can be coupled with the first PTAT circuit 202 (i.e., the first terminal of the first transistor T1) such that the first current I1 is sunk from the first amplification circuit 204. The first amplification circuit 204 can be further configured to receive the first and second collector-emitter voltages Vce1 and Vce2 from the first PTAT circuit 202 (i.e., the first terminals of the first and second transistors T1 and T2, respectively). Based on the supply voltage VDD, the first and second collector-emitter voltages Vce1 and Vce2, and the first current I1, the first amplification circuit 204 can be further configured to output the second current I2 and third through sixth currents I3-I6. The second through sixth currents I2-I6 can collectively be referred to as a "first set of currents I2-I6".

The first amplification circuit 204 can be configured to provide (i.e., source) the second current I2 to the first PTAT circuit 202 (i.e., the first terminal of the second transistor T2), and the third current I3 to the current summing circuit 210. Further, the first amplification circuit 204 outputs the fourth current I4 such that the fourth current I4 is sunk from the first output circuit 208. The first amplification circuit 204 can be further configured to provide (i.e., source) the fifth and sixth currents I5 and I6 to the first voltage divider 206 and the current summing circuit 210, respectively. The first amplification circuit 204 can include a first current mirror circuit 212, a first amplifier 214, and a second current mirror circuit 216.

The first current mirror circuit 212 can be coupled with the power supply 102, the first PTAT circuit 202 (i.e., the first terminals of the first and second transistors T1 and T2), the first output circuit 208, and the current summing circuit 210. The first current mirror circuit 212 can include suitable circuitry that can be configured to perform one or more operations. For example, the first current mirror circuit 212 can be configured to receive the supply voltage VDD from the power supply 102. Further, the first current mirror circuit 212 can be coupled with the first terminal of the first transistor T1 such that the first current I1 outputted by the first terminal of the first transistor T1 is sunk from the first current mirror circuit 212. Based on the supply voltage VDD and the first current I1, the first current mirror circuit 212 can be further configured to output the second through fourth currents I2-I4. The second current I2 can be equal to the first current I1, and the third and fourth currents I3 and I4 can be scaled versions of the first current I1. The first current mirror circuit 212 can be further configured to provide (i.e., source) the second current I2 to the first PTAT circuit 202 (i.e., the first terminal of the second transistor T2), and the third current I3 to the current summing circuit 210. Further, the first current mirror circuit 212 can output the fourth current I4 such that the fourth current I4 is sunk from the first output circuit 208.

The first amplifier 214 can be coupled with the first PTAT circuit 202 (i.e., the first terminals of the first and second transistors Ti and T2). The first amplifier 214 can include suitable circuitry that can be configured to perform one or more operations. For example, the first amplifier 214 can be configured to receive the first and second collector-emitter voltages Vce1 and Vce2 from the first PTAT circuit 202 (i.e., the first terminals of the first and second transistors T1 and T2, respectively). In an embodiment, the first amplifier 214 receives the first and second collector-emitter voltages Vce1 and Vce2 at positive and negative input terminals thereof, respectively. Based on the first and second collector-emitter voltages Vce1 and Vce2, the first amplifier 214 can be further configured to generate a first control voltage VC1.

The first control voltage VC1 can be greater than a difference between the first and second collector-emitter voltages Vce1 and Vce2.

Although FIG. 1 illustrates that an amplifier (i.e., the first amplifier 214) generates the first control voltage VC1, it will be apparent to a person skilled in the art that the scope of the present disclosure is not limited to it. In various other embodiments, a transistor can be utilized for generating the first control voltage VC1, without deviating from the scope of the present disclosure.

The second current mirror circuit 216 can be coupled with the power supply 102, the first amplifier 214, the first voltage divider 206, and the current summing circuit 210. The second current mirror circuit 216 can include suitable circuitry that can be configured to perform one or more operations. For example, the second current mirror circuit 216 can be configured to receive the supply voltage VDD from the power supply 102 and the first control voltage VC1 from the first amplifier 214. Based on the first control voltage VC1 and the supply voltage VDD, the second current mirror circuit 216 can be further configured to output the fifth and sixth currents I5 and I6. The sixth current I6 can be a scaled version of the fifth current I5. The second current mirror circuit 216 can be further configured to provide (i.e., source) the fifth and sixth currents I5 and I6 to the first voltage divider 206 and the current summing circuit 210, respectively. In an embodiment, a minimum value of the supply voltage VDD required for the LDO regulator 104 is equal to a sum of the second base-emitter voltage Vbe2 and drain-source saturation voltages of transistors (not shown) included in the second current mirror circuit 216.

The first voltage divider 206 can be coupled between the first PTAT circuit 202 (i.e., the second terminal of the second transistor T2) and the ground terminal. Further, the first voltage divider 206 can be coupled with the second current mirror circuit 216 and the first output circuit 208. The first voltage divider 206 can be configured to receive, from the second terminal of the second transistor T2, the second base-emitter voltage Vbe2 associated with the second transistor T2. Further, the first voltage divider 206 can be configured to receive the fifth current I5 from the second current mirror circuit 216. The fifth current I5 can correspond to a biasing current associated with the first voltage divider 206. Based on the second base-emitter voltage Vbe2 and the fifth current I5, the first voltage divider 206 can be further configured to output a second control voltage VC2. The second control voltage VC2 can be a scaled version of the second base-emitter voltage Vbe2. The first voltage divider 206 can be further configured to provide the second control voltage VC2 to the first output circuit 208. The first voltage divider 206 can include second and third resistors R2 and R3 each having first and second terminals.

The first terminal of the second resistor R2 can be coupled with the first PTAT circuit 202 (i.e., the second terminal of the second transistor T2) and the second current mirror circuit 216. The first terminal of the second resistor R2 can be configured to receive the second base-emitter voltage Vbe2 from the second terminal of the second transistor T2, and the fifth current I5 from the second current mirror circuit 216. The second terminal of the second resistor R2 can be coupled with the first output circuit 208. The second terminal of the second resistor R2 can be configured to output and provide the second control voltage VC2 to the first output circuit 208. The first terminal of the third resistor R3 can be coupled with the second terminal of the second resistor R2, and the second terminal of the third resistor R3 can be coupled with the ground terminal.

Although it is shown that a single resistor (i.e., the third resistor R3) is coupled between the second resistor R2 and the ground terminal, it will be apparent to a person skilled in the art that the scope of the present disclosure is not limited to it. In various other embodiments, a series of two or more resistors can be coupled between the second resistor R2 and the ground terminal, without deviating from the scope of the present disclosure. In such a scenario, a total resistance value of the series of two or more resistors is equal to the resistance value of the third resistor R3. Further, the second control voltage VC2 can be outputted at any intermediate terminal of the series of two or more resistors.

The first output circuit 208 can be coupled with the first amplification circuit 204 (i.e., the first current mirror circuit 212), the first voltage divider 206 (i.e., the second terminal of the second resistor R2), and the functional circuit 106. The first output circuit 208 can be configured to receive the second control voltage VC2 from the first voltage divider 206. Further, the first output circuit 208 can be coupled with the first current mirror circuit 212 such that the fourth current I4 outputted by the first current mirror circuit 212 is sunk from the first output circuit 208. Based on the fourth current I4 and the second control voltage VC2, the first output circuit 208 can be further configured to generate the first output voltage Vout1, and provide the first output voltage Vout1 to the functional circuit 106. The first output circuit 208 can include a second amplifier 218 and a fourth resistor R4.

The second amplifier 218 can be coupled with the first voltage divider 206 (i.e., the second terminal of the second resistor R2) and the functional circuit 106. The second amplifier 218 can include suitable circuitry that can be configured to perform one or more operations. For example, the second amplifier 218 can be configured to receive the second control voltage VC2 from the first voltage divider 206 (i.e., the second terminal of the second resistor R2). Further, the second amplifier 218 can be configured to receive a third control voltage VC3. In an embodiment, the second amplifier 218 receives the second and third control voltages VC2 and VC3 at positive and negative input terminals thereof, respectively. Based on the second and third control voltages VC2 and VC3, the second amplifier 218 can be further configured to generate the first output voltage Vout1, and provide the first output voltage Vout1 to the functional circuit 106. The first output voltage Vout1 can be greater than a difference between the second and third control voltages VC2 and VC3.

The fourth resistor R4 has a first terminal that can be coupled with the second amplifier 218 (i.e., an output terminal of the second amplifier 218). The first terminal of the fourth resistor R4 can be further configured to receive the first output voltage Vout1 from the second amplifier 218. The fourth resistor R4 further has a second terminal that can be coupled with the first amplification circuit 204 (i.e., the first current mirror circuit 212), and the second amplifier 218 (i.e., the negative input terminal of the second amplifier 218). The fourth resistor R4 can be thus coupled with the second amplifier 218 in a negative feedback configuration. The second terminal of the fourth resistor R4 can be coupled with the first current mirror circuit 212 such that the fourth current I4 outputted by the first current mirror circuit 212 is sunk from the second terminal of the fourth resistor R4. The second terminal of the fourth resistor R4 can be further configured to output and provide the third control voltage VC3 to the second amplifier 218 (i.e., the negative input terminal of the second amplifier 218) based on the fourth current I4 and the first output voltage Vout1. The third control voltage VC3 can be equal to a difference between the first output voltage Vout1 and a voltage drop across the fourth resistor R4.

The current summing circuit 210 can be coupled with the first amplification circuit 204 (i.e., the first and second current mirror circuits 212 and 216) and the functional circuit 106. The current summing circuit 210 can include suitable circuitry that can be configured to perform one or more operations. For example, the current summing circuit 210 can be configured to receive the third and sixth currents I3 and I6 from the first and second current mirror circuits 212 and 216, respectively. The current summing circuit 210 can be further configured to generate the output current Tout that is equal to a sum of the third and sixth currents I3 and I6. The current summing circuit 210 can be further configured to provide the output current Tout to the functional circuit 106.

The second base-emitter voltage Vbe2 has a negative temperature co-efficient. The fifth current I5 is equal to a ratio of the second base-emitter voltage Vbe2 and a sum of resistance values of the second and third resistors R2 and R3. Thus, the fifth current I5 has a negative temperature co-efficient. The sixth current I6 is a scaled version of the fifth current I5. Thus, the sixth current I6 has a negative temperature co-efficient. Additionally, the difference between the first and second base-emitter voltages Vbe1 and Vbe2 (i.e., ΔVbe) has a positive temperature co-efficient. Thus, the first current I1, and in turn, the third current I3 have a positive temperature co-efficient. Hence, based on scaling factors associated with the third and sixth currents I3 and I6, a temperature-independent output current Tout may be generated.

As illustrated in FIG. 2, the first output voltage Vout1 is equal to the sum of the third control voltage VC3 and the voltage drop across the fourth resistor R4. The second amplifier 218 is coupled in a negative feedback configuration (i.e., the second amplifier 218 and the fourth resistor R4 form a negative feedback loop). Hence, the second amplifier 218 drives the second and third control voltages VC2 and VC3 to be equal. Further, the second control voltage VC2 is a scaled version of the second base-emitter voltage Vbe2. Thus, the third control voltage VC3 is a scaled version of the second base-emitter voltage Vbe2. The first current I1 can be determined based on the difference between the first and second base-emitter voltages Vbe1 and Vbe2 (i.e., ΔVbe) and the resistance value of the first resistor R1. Further, the fourth current I4 is a scaled version of the first current I1. For the sake of ongoing discussion, it is assumed that the fourth current I4 is "k1" times the first current I1, where "k1" is a first scaling factor. In one example, the first scaling factor "k1" is less than one. Thus, the first output voltage Vout1 generated by the first output circuit 208 can be determined as shown below in equation (1):

$$Vout1 = \frac{R3 * Vbe2}{R3 + R2} + \frac{R4 * k1 * \Delta Vbe}{R1} \quad (1)$$

where, $$\frac{R3 * Vbe\,2}{R3 + R2}$$

is equal to the third control voltage VC3, and $$\frac{R4 * k1 * \Delta Vbe}{R1}$$

is equal to me voltage drop across the fourth resistor R4.

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on resistance values of the first through fourth resistors R1-R4, a temperature-independent first output voltage Vout1 may be outputted. A lowest voltage level of the first output voltage Vout1 can be determined based on drain-source saturation voltages of transistors (not shown) included in the second amplifier 218. It will be apparent to a person skilled in the art that the drain-source saturation voltage of the transistor included in the second amplifier 218 is less than the first and second collector-emitter voltages Vce1 and Vce2.

FIG. 3 illustrates a schematic circuit diagram of the LDO regulator 104 in accordance with another embodiment of the present disclosure. The LDO regulator 104 can include the first PTAT circuit 202, the first amplification circuit 204, the first voltage divider 206, the current summing circuit 210, and a second output circuit 302. The LDO regulator 104 of FIG. 3 can be configured to generate and provide the first output voltage Vout1 and the output current Iout to the functional circuit 106.

The structure and functionalities of the first PTAT circuit 202, the first amplification circuit 204, the first voltage divider 206, and the current summing circuit 210 remain same as described in FIG. 2. The difference between the LDO regulator 104 of FIG. 2 and the LDO regulator 104 of FIG. 3 is that the first output circuit 208 in the LDO regulator 104 of FIG. 2 is replaced with the second output circuit 302 in the LDO regulator 104 of FIG. 3.

The second output circuit 302 can be coupled with the first amplification circuit 204 (i.e., the first current mirror circuit 212), the first voltage divider 206 (i.e., the second terminal of the second resistor R2), and the functional circuit 106. The second output circuit 302 can be configured to receive the second control voltage VC2 from the first voltage divider 206 (i.e., the second terminal of the second resistor R2). Further, the second output circuit 302 can be coupled with the first current mirror circuit 212 such that the fourth current I4 is sunk from the second output circuit 302. Based on the second control voltage VC2 and the fourth current I4, the second output circuit 302 can be further configured to generate the first output voltage Vout1 and provide the first output voltage Vout1 to the functional circuit 106. The second output circuit 302 can include a third amplifier 304 and fifth and sixth resistors R5 and R6.

The third amplifier 304 can be coupled with the first voltage divider 206 (i.e., the second terminal of the second resistor R2) and the functional circuit 106. The third amplifier 304 can include suitable circuitry that can be configured to perform one or more operations. For example, the third amplifier 304 can be configured to receive the second control voltage VC2 from the first voltage divider 206 (i.e., the second terminal of the second resistor R2). Further, the third amplifier 304 can be configured to receive a fourth control voltage VC4. In an embodiment, the third amplifier 304 receives the second and fourth control voltages VC2 and VC4 at positive and negative input terminals thereof, respectively. Based on the second and fourth control voltages VC2 and VC4, the third amplifier 304 can be further configured to generate the first output voltage Vout1. The first output voltage Vout1 can be greater than a difference between the second and fourth control voltages VC2 and VC4. The third amplifier 304 can be further configured to provide the first output voltage Vout1 to the functional circuit 106.

The fifth resistor R5 has a first terminal that can be coupled with the third amplifier 304 (i.e., an output terminal of the third amplifier 304). The first terminal of the fifth resistor R5 can be configured to receive the first output voltage Vout1 from the third amplifier 304. The fifth resistor R5 further has a second terminal that can be coupled with the first amplification circuit 204 (i.e., the first current mirror circuit 212), and the third amplifier 304 (i.e., the negative terminal of the third amplifier 304). Thus, the fifth resistor R5 can be coupled with the third amplifier 304 in a negative feedback configuration. The second terminal of the fifth resistor R5 can be coupled with the first current mirror circuit 212 such that the fourth current I4 outputted by the first current mirror circuit 212 is sunk from the second terminal of the fifth resistor R5. The second terminal of the fifth resistor R5 can be configured to output and provide, based on the first output voltage Vout1 and the fourth current I4, the fourth control voltage VC4 to the third amplifier 304 (i.e., the negative terminal of the third amplifier 304).

The sixth resistor R6 has a first terminal that can be coupled with the third amplifier 304 (i.e., an output terminal of the third amplifier 304). The first terminal of the sixth resistor R6 can be configured to receive the first output voltage Vout1 from the third amplifier 304. The sixth resistor R6 further has a second terminal that can be coupled with the third amplifier 304 (i.e., the positive terminal of the third amplifier 304) and the first voltage divider 206 (i.e., the second terminal of the second resistor R2). Thus, the sixth resistor R6 can be coupled with the third amplifier 304 in a positive feedback configuration. The second terminal of the sixth resistor R6 can be configured to receive the second control voltage VC2 from the first voltage divider 206 (i.e., the second terminal of the second resistor R2). The second terminal of the fifth resistor R5 can further output the fourth control voltage VC4 based on a voltage drop across the sixth resistor R6.

The first output voltage Vout1 generated by the second output circuit 302 can be determined as shown below in equation (2):

$$Vout1 = \frac{R3 * Vbe2}{R3 + R2} + \frac{R5 * k1 * \Delta Vbe * (R6 * (R3 + R2) + R3 * R2)}{R1 * R6 * (R3 + R2)} \quad (2)$$

where, $$\frac{R3 * Vbe2}{R3 + R2}$$

is equal to the fourth control voltage VC4, and $$\frac{R5 * k1 * \Delta Vbe * (R6 * (R3 + R2) + R3 * R2)}{R1 * R6 * (R3 + R2)}$$

is equal to the voltage drop across the fifth resistor R5.

The coupling of the sixth resistor R6 in a positive feedback configuration with the third amplifier 304 in the second output circuit 302 is utilized to adjust the co-efficient associated with the voltage drop across the fifth resistor R5. For example, the co-efficient associated with the voltage drop across the fifth resistor R5 decreases due to the sixth resistor R6, thereby decreasing the first output voltage Vout1.

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on the resistance values of the first through third resistors R1-R3 and resistance values of fifth and sixth resistors R5 and R6, a temperature-independent first output voltage Vout1 may be outputted. A lowest voltage level of the first output voltage Vout1 can be determined based on drain-source saturation voltages of transistors (not shown) included in the third amplifier 304. It will be apparent to a person skilled in the art that the drain-source saturation voltage of the transistor included in the third amplifier 304 is less than the first and second collector-emitter voltages Vce1 and Vce2.

FIG. 4 illustrates a schematic circuit diagram of the LDO regulator 104 in accordance with yet another embodiment of the present disclosure. The LDO regulator 104 can include the first PTAT circuit 202, the first amplification circuit 204, the current summing circuit 210, a third output circuit 402, and a seventh resistor R7. The LDO regulator 104 of FIG. 4 can be configured to generate and provide the first and second output voltages Vout1 and Vout2 and the output current Iout to the functional circuit 106.

The structure and functionalities of the first PTAT circuit 202, the first amplification circuit 204, and the current summing circuit 210 remain same as described in FIG. 2. The difference between the LDO regulator 104 of FIG. 2 and the LDO regulator 104 of FIG. 4 is that the first output circuit 208 in the LDO regulator 104 of FIG. 2 is replaced with the third output circuit 402 in the LDO regulator 104 of FIG. 4. Another difference between the LDO regulator 104 of FIG. 2 and the LDO regulator 104 of FIG. 4 is the absence of the first voltage divider 206 in the LDO regulator 104 of FIG. 4. Further, the second current mirror circuit 216 in the LDO regulator 104 of FIG. 4 can be configured to output an additional current (i.e., a seventh current I7). The second current mirror circuit 216 can be coupled with the second terminal of the second transistor T2 and the third output circuit 402. The seventh current I7 can be a scaled version of the fifth current I5, and can be outputted based on the supply voltage VDD, the first control voltage VC1, and the second base-emitter voltage Vbe2. For the sake of ongoing discussion, it is assumed that the seventh current I7 is "k2" times the fifth current I5, where "k2" is a second scaling factor. In one example, the second scaling factor "k2" is less than one. The second current mirror circuit 216 can be further configured to provide (i.e., source) the seventh current I7 to the third output circuit 402.

The seventh resistor R7 has first and second terminals. The first terminal of the seventh resistor R7 can be coupled with the first PTAT circuit 202 (i.e., the second terminal of the second transistor T2) and the second current mirror circuit 216. The first terminal of the seventh resistor R7 can be configured to receive the second base-emitter voltage Vbe2 associated with the second transistor T2 from the second terminal of the second transistor T2. Further, the first terminal of the seventh resistor R7 can be configured to receive the fifth current I5 from the second current mirror circuit 216. The seventh resistor R7 further has a second terminal that can be coupled with the ground terminal. In such a scenario, the fifth current I5 can be equal to a ratio of the second base-emitter voltage Vbe2 and a resistance value of the seventh resistor R7.

The third output circuit 402 can be coupled with the first amplification circuit 204 (i.e., the first and second current mirror circuits 212 and 216) and the functional circuit 106. The third output circuit 402 can be coupled with the first current mirror circuit 212 such that the fourth current I4 is sunk from the third output circuit 402. The third output circuit 402 can be further configured to receive the seventh current I7 from the second current mirror circuit 216. Further, based on the fourth and seventh currents I4 and I7, the third output circuit 402 can be configured to output and provide the first and second output voltages Vout1 and Vout2 to the functional circuit 106. In such a scenario, the functional circuit 106 can correspond to an analog-to-digital converter. The third output circuit 402 can include a fourth amplifier 404 and eighth and ninth resistors R8 and R9.

The fourth amplifier 404 can be coupled with the functional circuit 106. The fourth amplifier 404 can include suitable circuitry that can be configured to perform one or more operations. For example, the fourth amplifier 404 can be configured to receive fifth and sixth control voltages VC5 and VC6. In an embodiment, the fourth amplifier 404 receives the fifth and sixth control voltages VC5 and VC6 at negative and positive input terminals thereof, respectively. Based on the fifth and sixth control voltages VC5 and VC6, the fourth amplifier 404 can be further configured to generate the first and second output voltages Vout1 and Vout2. The first output voltage Vout1 can be greater than the second output voltage Vout2. Further, a difference between the first and second output voltages Vout1 and Vout2 can be greater than a difference between the fifth and sixth control voltages VC5 and VC6. The fourth amplifier 404 can be further configured to provide the first and second output voltages Vout1 and Vout2 to the functional circuit 106. In an embodiment, the fourth amplifier 404 provides the first and second output voltages Vout1 and Vout2 by way of positive and negative output terminals thereof, respectively.

Although it is described that the positive and negative output terminals of the fourth amplifier 404 provide the first and second output voltages Vout1 and Vout2 to the functional circuit 106, respectively, it will be apparent to a person skilled in the art that the scope of the present disclosure is not limited to it. In various other embodiments, the positive and negative output terminals of the fourth amplifier 404 can provide the second and first output voltages Vout2 and Vout1, respectively, without deviating from the scope of the present disclosure. In such a scenario, current directions of the fourth and seventh currents I4 and I7 are reversed (i.e., the fourth current I4 is sourced to the third output circuit 402 and the seventh current I7 is sunk from the third output circuit 402).

The eighth resistor R8 has a first terminal that can be coupled with the fourth amplifier 404 (i.e., the positive output terminal of the fourth amplifier 404). The first terminal of the eighth resistor R8 can be configured to receive the first output voltage Vout1 from the fourth amplifier 404 (i.e., the positive output terminal of the fourth amplifier 404). The eighth resistor R8 further has a second terminal that can be coupled with the first amplification circuit 204 (i.e., the first current mirror circuit 212) and the fourth amplifier 404 (i.e., the negative input terminal of the fourth amplifier 404). Thus, the eighth resistor R8 can be coupled with the fourth amplifier 404 in a negative feedback configuration. Further, the second terminal of the eighth resistor R8 can be coupled with the first current mirror circuit 212 such that the fourth current I4 outputted by the first current mirror circuit 212 is sunk from the second terminal of the eighth resistor R8. The second terminal of the eighth resistor R8 can be further configured to output and provide the fifth control voltage VC5 to the fourth amplifier 404 (i.e., the negative input terminal of the fourth amplifier 404) based on the fourth current I4 and the first output voltage Vout1. The fifth control voltage VC5 can be equal to a difference between the first output voltage Vout1 and a voltage drop across the eighth resistor R8.

The ninth resistor R9 has a first terminal that can be coupled with the fourth amplifier 404 (i.e., the negative output terminal of the fourth amplifier 404). The first terminal of the ninth resistor R9 can be configured to receive the second output voltage Vout2 from the fourth amplifier 404. The ninth resistor R9 further has a second terminal that can be coupled with the first amplification circuit 204 (i.e., the second current mirror circuit 216) and the fourth amplifier 404 (i.e., the positive input terminal of the fourth amplifier 404). Thus, the ninth resistor R9 can be coupled with the fourth amplifier 404 in a positive feedback configuration. Further, the second terminal of the ninth resistor R9 can be configured to receive the seventh current I7 from the second current mirror circuit 216. The second terminal of the ninth resistor R9 can be further configured to output and provide the sixth control voltage VC6 to the fourth amplifier 404 (i.e., the positive input terminal of the fourth amplifier 404) based on the seventh current I7 and the second output voltage Vout2. The sixth control voltage VC6 can be equal to a difference between the second output voltage Vout2 and a voltage drop across the ninth resistor R9. In the presently preferred embodiment, resistance values of the eighth and ninth resistors R8 and R9 are equal.

The difference between the first output voltage Vout1 and the second output voltage Vout2 generated by the third output circuit 402 can be determined as shown below in equation (3):

$$Vout1 - Vout2 = R8 * \left(\frac{k2 * Vbe2}{R7} + \frac{k1 * \Delta Vbe}{R1}\right) \tag{3}$$

where, $$\frac{R8 * k2 * Vbe2}{R7}$$

is equal to the voltage drop across the ninth resistor R9, and $$\frac{R8 * k1 * \Delta Vbe}{R1}$$

is equal to the voltage drop across the eighth resistor R8.

Each of the eighth and ninth resistors R8 and R9 can be variable resistors. Thus, the first and second output voltages Vout1 and Vout2 can be adjusted by adjusting resistance values of the eighth and ninth resistors R8 and R9. Further, the seventh through ninth resistors R7-R9 can be utilized to adjust the co-efficient associated with the voltage drop across the eighth and ninth resistors R8 and R9 and the second base-emitter voltage Vbe2. As the co-efficient associated the voltage drop across the eighth and ninth resistors R8 and R9 and the second base-emitter voltage Vbe2 decrease, the difference between the first and second output voltages Vout1 and Vout2 decreases.

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on the resistance values of the first, seventh, and eighth resistors R1, R7, and R8, the difference between the first and second output voltages Vout1 and Vout2 can be temperature-independent. A lowest voltage level of the difference between the first and second output voltages Vout1 and Vout2 can be determined based on drain-source saturation voltages of transistors (not shown) included in the fourth amplifier 404. It will be apparent to a person skilled in the art that the drain-source saturation voltage of the transistor included in the fourth amplifier 404 is less than the first and second collector-emitter voltages Vce1 and Vce2.

FIG. 5 illustrates a schematic circuit diagram of the LDO regulator 104 in accordance with yet another embodiment of the present disclosure. The LDO regulator 104 can include the first PTAT circuit 202, the first amplification circuit 204, a second voltage divider 502, and a fourth output circuit 504. The LDO regulator 104 of FIG. 5 can be configured to generate and provide the first output voltage Vout1 and the output current Iout to the functional circuit 106.

The structure and the functionality of the first PTAT circuit 202 remain same as described in FIG. 2. The difference between the LDO regulator 104 of FIG. 2 and the LDO regulator 104 of FIG. 5 is that the first voltage divider 206 and the first output circuit 208 in the LDO regulator 104 of FIG. 2 are replaced with the second voltage divider 502 and the fourth output circuit 504 in the LDO regulator 104 of FIG. 5, respectively. Another difference between the LDO regulator 104 of FIG. 2 and the LDO regulator 104 of FIG. 5 is the absence of the current summing circuit 210 in the LDO regulator 104 of FIG. 5.

The first amplification circuit 204 of the LDO regulator 104 of FIG. 5 can be coupled with the first PTAT circuit 202 (i.e., the first terminal of the first transistor T1) such that the first current I1 is sunk therefrom. The first amplification circuit 204 can be further configured to receive the first and second collector-emitter voltages Vce1 and Vce2 from the first PTAT circuit 202 (i.e., the first terminals of the first and second transistors T1 and T2, respectively). Based on the first current I1, the supply voltage VDD, and the first and second collector-emitter voltages Vce1 and Vce2, the first amplification circuit 204 can be further configured to output the second, third, fifth, and sixth currents I2, I3, I5, and I6. The first amplification circuit 204 of the LDO regulator 104 of FIG. 5 does not output the fourth current I4 as the LDO regulator 104 of FIG. 2. The first amplification circuit 204 (i.e., the first current mirror circuit 212) can be further configured to provide (i.e., source) the third current I3 to the second voltage divider 502. The third current I3 is a scaled version of the first current I1. For the sake of ongoing discussion, it is assumed that the third current I3 is "k3" times the first current I1, where "k3" is a third scaling factor. In one example, the third scaling factor "k3" is less than one. Further, the first amplification circuit 204 (i.e., the second current mirror circuit 216) of the LDO regulator 104 of FIG. 5 can be coupled with the functional circuit 106. The first amplification circuit 204 (i.e., the second current mirror circuit 216) of the LDO regulator 104 of FIG. 5 can be further configured to provide the sixth current I6 as the output current Iout to the functional circuit 106. The sixth current I6 is a scaled version of the fifth current I5 (i.e., a current having a negative temperature co-efficient). Thus, the output current Iout can be temperature-dependent (i.e., the output current Iout has a negative temperature co-efficient).

The second voltage divider 502 can be coupled between the first PTAT circuit 202 (i.e., the second terminal of the second transistor T2) and the ground terminal. Further, the second voltage divider 502 can be coupled with the first and second current mirror circuits 212 and 216 and the fourth output circuit 504. The second voltage divider 502 can be configured to receive, from the second terminal of the second transistor T2, the second base-emitter voltage Vbe2 associated with the second transistor T2. Further, the second voltage divider 502 can be configured to receive the third and fifth currents I3 and I5 from the first and second current mirror circuits 212 and 216, respectively. Based on the second base-emitter voltage Vbe2 and the third and fifth currents I3 and I5, the second voltage divider 502 can be further configured to output a seventh control voltage VC7. In an embodiment, the seventh control voltage VC7 is a scaled version of the second base-emitter voltage Vbe2. The second voltage divider 502 can be further configured to provide the seventh control voltage VC7 to the fourth output circuit 504. The second voltage divider 502 can include tenth and eleventh resistors R10 and R11 each having first and second terminals.

The first terminal of the tenth resistor R10 can be coupled with the first PTAT circuit 202 (i.e., the second terminal of the second transistor T2) and the second current mirror circuit 216. The first terminal of the tenth resistor R10 can be configured to receive the second base-emitter voltage Vbe2 from the second terminal of the second transistor T2, and the fifth current I5 from the second current mirror circuit 216. The second terminal of the tenth resistor R10 can be coupled with the first current mirror circuit 212 and the fourth output circuit 504. The second terminal of the tenth resistor R10 can be configured to receive the third current I3 from the first current mirror circuit 212. Further, the second terminal of the tenth resistor R10 can be configured to output and provide the seventh control voltage VC7 to the fourth output circuit 504. The first terminal of the eleventh resistor R11 can be coupled with the second terminal of the tenth resistor R10, and the second terminal of the eleventh resistor R11 can be coupled with the ground terminal.

Although it is shown that a single resistor (i.e., the eleventh resistor R11) is coupled between the tenth resistor R10 and the ground terminal, it will be apparent to a person skilled in the art that the scope of the present disclosure is not limited to it. In various other embodiments, a series of two or more resistors can be coupled between the tenth resistor R10 and the ground terminal, without deviating from the scope of the present disclosure. In such a scenario, a total resistance value of the series of two or more resistors is equal to the resistance value of the eleventh resistor R11. Further, the seventh control voltage VC7 can be outputted at any intermediate terminal of the series of two or more resistors.

The fourth output circuit 504 can be coupled with the second voltage divider 502 (i.e., the second terminal of the tenth resistor R10) and the functional circuit 106. The fourth output circuit 504 can be configured to receive the seventh control voltage VC7 from the second voltage divider 502. Further, the fourth output circuit 504 can be configured to generate the first output voltage Vout1 based on the seventh control voltage VC7, and provide the first output voltage Vout1 to the functional circuit 106. In a presently preferred embodiment, the fourth output circuit 504 corresponds to a fifth amplifier 506.

The fifth amplifier 506 can be coupled in a negative feedback configuration. Further, the fifth amplifier 506 can be coupled with the second voltage divider 502 (i.e., the second terminal of the tenth resistor R10). The fifth amplifier 506 can include suitable circuitry that can be configured to perform one or more operations. For example, the fifth amplifier 506 can be configured to receive the seventh control voltage VC7 from the second voltage divider 502 (i.e., the second terminal of the tenth resistor R10). The fifth amplifier 506 can receive the seventh control voltage VC7 at a positive input terminal thereof. As the fifth amplifier 506 can be coupled in a negative feedback configuration, the fifth amplifier 506 can be further configured to receive the first output voltage Vout1 at a negative input terminal thereof. Based on the seventh control voltage VC7, the fifth amplifier 506 can be further configured to generate the first output voltage Vout1. The fifth amplifier 506 can be further configured to provide the first output voltage Vout1 to the functional circuit 106.

The first output voltage Vout1 generated by the fourth output circuit 504 can be determined as shown below in equation (4):

$$Vout1 = \frac{R11}{R11 + R10} * \left(Vbe2 + \frac{k3 * R10 * \Delta Vbe}{R1}\right) \quad (4)$$

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on the resistance values of the first, tenth, and eleventh resistors R1, R10, and R11, a temperature-independent first output voltage Vout1 may be outputted. A lowest voltage level of the first output voltage Vout1 can be determined based on drain-source saturation voltages of transistors (not shown) included in the fifth amplifier 506. It will be apparent to a person skilled in the art that the drain-source saturation voltage of the transistor included in the fifth amplifier 506 is less than the first and second collector-emitter voltages Vce1 and Vce2.

Figure 6:
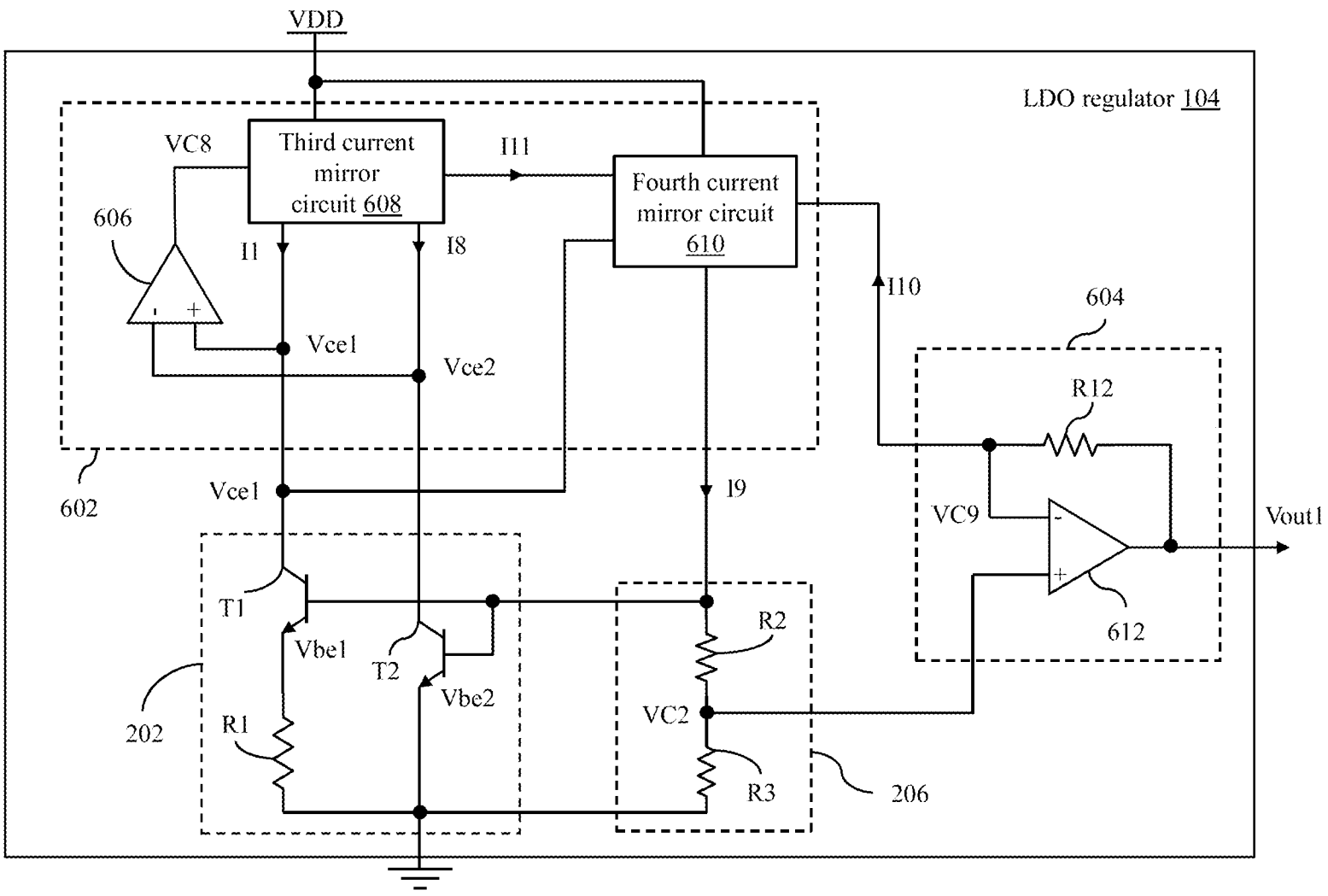
FIG. 6 illustrates a schematic circuit diagram of the LDO regulator of the SoC of FIG. 1 in accordance with yet another embodiment of the present disclosure.

FIG. 6 illustrates a schematic circuit diagram of the LDO regulator 104 in accordance with yet another embodiment of the present disclosure. The LDO regulator 104 can include the first PTAT circuit 202, a second amplification circuit 602, the first voltage divider 206, and a fifth output circuit 604. The LDO regulator 104 of FIG. 6 can be configured to generate and provide the first output voltage Vout1 to the functional circuit 106.

The structure and functionalities of the first PTAT circuit 202 and the first voltage divider 206 remain same as described in FIG. 2. The difference between the LDO regulator 104 of FIG. 2 and the LDO regulator 104 of FIG. 6 is that the first amplification circuit 204 and the first output circuit 208 in the LDO regulator 104 of FIG. 2 are replaced with the second amplification circuit 602 and the fifth output circuit 604 in the LDO regulator 104 of FIG. 6, respectively. Another difference between the LDO regulator 104 of FIG. 2 and the LDO regulator 104 of FIG. 6 is the absence of the current summing circuit 210 in the LDO regulator 104 of FIG. 6.

The second amplification circuit 602 can be coupled with the power supply 102, the first PTAT circuit 202 (i.e., the first terminals of the first and second transistors T1 and T2), the first voltage divider 206, and the fifth output circuit 604. The second amplification circuit 602 can be configured to receive the supply voltage VDD from the power supply 102. Further, the second amplification circuit 602 can be coupled with the first PTAT circuit 202 (i.e., the first terminal of the first transistor T1) such that the first current I1 is sunk from the second amplification circuit 602. The second amplification circuit 602 can be further configured to receive the first and second collector-emitter voltages Vce1 and Vce2 from the first PTAT circuit 202 (i.e., the first terminals of the first and second transistors T1 and T2, respectively). Based on the supply voltage VDD, the first and second collector-emitter voltages Vce1 and Vce2, and the first current I1, the second amplification circuit 602 can be further configured to output eighth through tenth currents I8-I10. The eighth through tenth currents I8-I10 can be collectively referred to as a "second set of currents I8-I10". The eighth current I8 can be equal to the first current I1. The ninth current I9 can be outputted based on the second base-emitter voltage Vbe2. Further, the tenth current I10 can be a scaled version of the ninth current I9.

The second amplification circuit 602 can be further configured to provide (i.e., source) the eighth current I8 to the first terminal of the second transistor T2. The second amplification circuit 602 can be further configured to provide (i.e., source) the ninth current I9 to the first voltage divider 206. The first voltage divider 206 outputs the second control voltage VC2 based on the ninth current I9 as opposed to the fifth current I5 in the LDO regulator 104 of FIG. 2. The second amplification circuit 602 can output the tenth current I10 such that the tenth current I10 is sunk from the fifth output circuit 604. The second amplification circuit 602 can include a sixth amplifier 606 and third and fourth current mirror circuits 608 and 610.

The sixth amplifier 606 can be coupled with the third current mirror circuit 608 and the first PTAT circuit 202 (i.e., the first terminals of the first and second transistors T1 and T2). The sixth amplifier 606 can include suitable circuitry that can be configured to perform one or more operations. For example, the sixth amplifier 606 can be configured to receive the first and second collector-emitter voltages Vce1 and Vce2 from the first PTAT circuit 202 (i.e., the first terminals of the first and second transistors T1 and T2, respectively). In an embodiment, the sixth amplifier 606 receives the first and second collector-emitter voltages Vce1 and Vce2 at positive and negative input terminals thereof, respectively. Based on the first and second collector-emitter voltages Vce1 and Vce2, the sixth amplifier 606 can be further configured to generate an eighth control voltage VC8. The eighth control voltage VC8 can be greater than a difference between the first and second collector-emitter voltages Vce1 and Vce2. The sixth amplifier 606 can be further configured to provide the eighth control voltage VC8 to the third current mirror circuit 608.

The third current mirror circuit 608 can be coupled with the power supply 102, the first PTAT circuit 202 (i.e., the first terminals of the first and second transistors T1 and T2), the sixth amplifier 606, and the fourth current mirror circuit 610. The third current mirror circuit 608 can include suitable circuitry that can be configured to perform one or more operations. For example, the third current mirror circuit 608 can be configured to receive the supply voltage VDD from the power supply 102, and the eighth control voltage VC8 from the sixth amplifier 606. Further, the third current mirror circuit 608 can be coupled with the first PTAT circuit 202 (i.e., the first terminal of the first transistor T1) such that the first current I1 is sunk from the third current mirror circuit 608. Based on the supply voltage VDD, the eighth control voltage VC8, and the first current I1, the third current mirror circuit 608 can be further configured to output the eighth current I8 and an eleventh current I11. The eighth current I8 can be equal to the first current I1, and the eleventh current I11 can be a scaled version of the first current I1. The third current mirror circuit 608 can be further configured to provide (i.e., source) the eighth and eleventh currents I8 and I11 to the first terminal of the second transistor T2 and the fourth current mirror circuit 610, respectively.

The fourth current mirror circuit 610 can be coupled with the power supply 102, the first PTAT circuit 202 (i.e., the first terminal of the first transistor T1), the third current mirror circuit 608, the first voltage divider 206, and the fifth output circuit 604. The fourth current mirror circuit 610 can include suitable circuitry that can be configured to perform one or more operations. For example, the fourth current mirror circuit 610 can be configured to receive the supply voltage VDD from the power supply 102, and the first collector-emitter voltage Vce1 from the first PTAT circuit 202 (i.e., from the first terminal of the first transistor T1). Further, the fourth current mirror circuit 610 can be configured to receive the eleventh current I11 from the third current mirror circuit 608. Based on the eleventh current I11, the supply voltage VDD, and the first collector-emitter voltage Vce1, the fourth current mirror circuit 610 can be further configured to output the ninth and tenth currents I9 and I10. The fourth current mirror circuit 610 can be further configured to provide (i.e., source) the ninth current I9 to the first voltage divider 206. Further, the fourth current mirror circuit 610 can output the tenth current I10 such that the tenth current I10 is sunk from the fifth output circuit 604. The ninth current I9 is thus further outputted based on the second base-emitter voltage Vbe2. As the tenth current I10 is a scaled version of the ninth current I9, the tenth current I10 can be further outputted based on the second base-emitter voltage Vbe2.

The fifth output circuit 604 can be coupled with the second amplification circuit 602 (i.e., the fourth current mirror circuit 610), the first voltage divider 206 (i.e., the second terminal of the second resistor R2), and the functional circuit 106. The fifth output circuit 604 can be configured to receive the second control voltage VC2 from the first voltage divider 206. Further, the fifth output circuit 604 can be coupled with the fourth current mirror circuit 610 such that the tenth current I10 outputted by the fourth current mirror circuit 610 is sunk from the fifth output circuit 604. Based on the tenth current I10 and the second control voltage VC2, the fifth output circuit 604 can be further configured to generate the first output voltage Vout1. The fifth output circuit 604 can be further configured to provide the first output voltage Vout1 to the functional circuit 106. The fifth output circuit 604 can include a seventh amplifier 612 and a twelfth resistor R12.

The seventh amplifier 612 can be coupled with the first voltage divider 206 (i.e., the second terminal of the second resistor R2) and the functional circuit 106. The seventh amplifier 612 can include suitable circuitry that can be configured to perform one or more operations. For example, the seventh amplifier 612 can be configured to receive the second control voltage VC2 from the first voltage divider 206 (i.e., the second terminal of the second resistor R2). Further, the seventh amplifier 612 can be configured to receive a ninth control voltage VC9. In an embodiment, the seventh amplifier 612 receives the second and ninth control voltages VC2 and VC9 at positive and negative input terminals thereof, respectively. Based on the second and ninth control voltages VC2 and VC9, the seventh amplifier 612 can be further configured to generate the first output voltage Vout1, and provide the first output voltage Vout1 to the functional circuit 106.

The twelfth resistor R12 has a first terminal that can be coupled with the seventh amplifier 612 (i.e., an output terminal of the seventh amplifier 612). The first terminal of the twelfth resistor R12 can be further configured to receive the first output voltage Vout1 from the seventh amplifier 612. The twelfth resistor R12 further has a second terminal that can be coupled with the second amplification circuit 602 (i.e., the fourth current mirror circuit 610), and the seventh amplifier 612 (i.e., the negative input terminal of the seventh amplifier 612). The twelfth resistor R12 can be thus coupled with the seventh amplifier 612 in a negative feedback configuration. The second terminal of the twelfth resistor R12 can be coupled with the fourth current mirror circuit 610 such that the tenth current I10 outputted by the fourth current mirror circuit 610 is sunk from the second terminal of the twelfth resistor R12. The second terminal of the twelfth resistor R12 can be further configured to output and provide the ninth control voltage VC9 to the seventh amplifier 612 (i.e., the negative input terminal of the seventh amplifier 612) based on the tenth current I10 and the first output voltage Vout1.

The first output voltage Vout1 generated by the fifth output circuit 604 can be determined as shown below in equation (5):

$$Vout1 = \frac{R3 * Vbe2}{R3 + R2} * \frac{R12 * \Delta Vbe}{R1} \tag{5}$$

where, $$\frac{R12 * \Delta Vbe}{R1}$$

is equal to a voltage drop across the twelfth resistor R12.

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on the resistance values of the first through third resistors R1-R3 and a resistance value of the twelfth resistor R12, a temperature-independent first output voltage Vout1 may be outputted. A lowest voltage level of the first output voltage Vout1 can be determined based on drain-source saturation voltages of transistors (not shown) included in the seventh amplifier 612. It will be apparent to a person skilled in the art that the drain-source saturation voltage of the transistor included in the seventh amplifier 612 is less than the first and second collector-emitter voltages Vce1 and Vce2.

Figure 7:
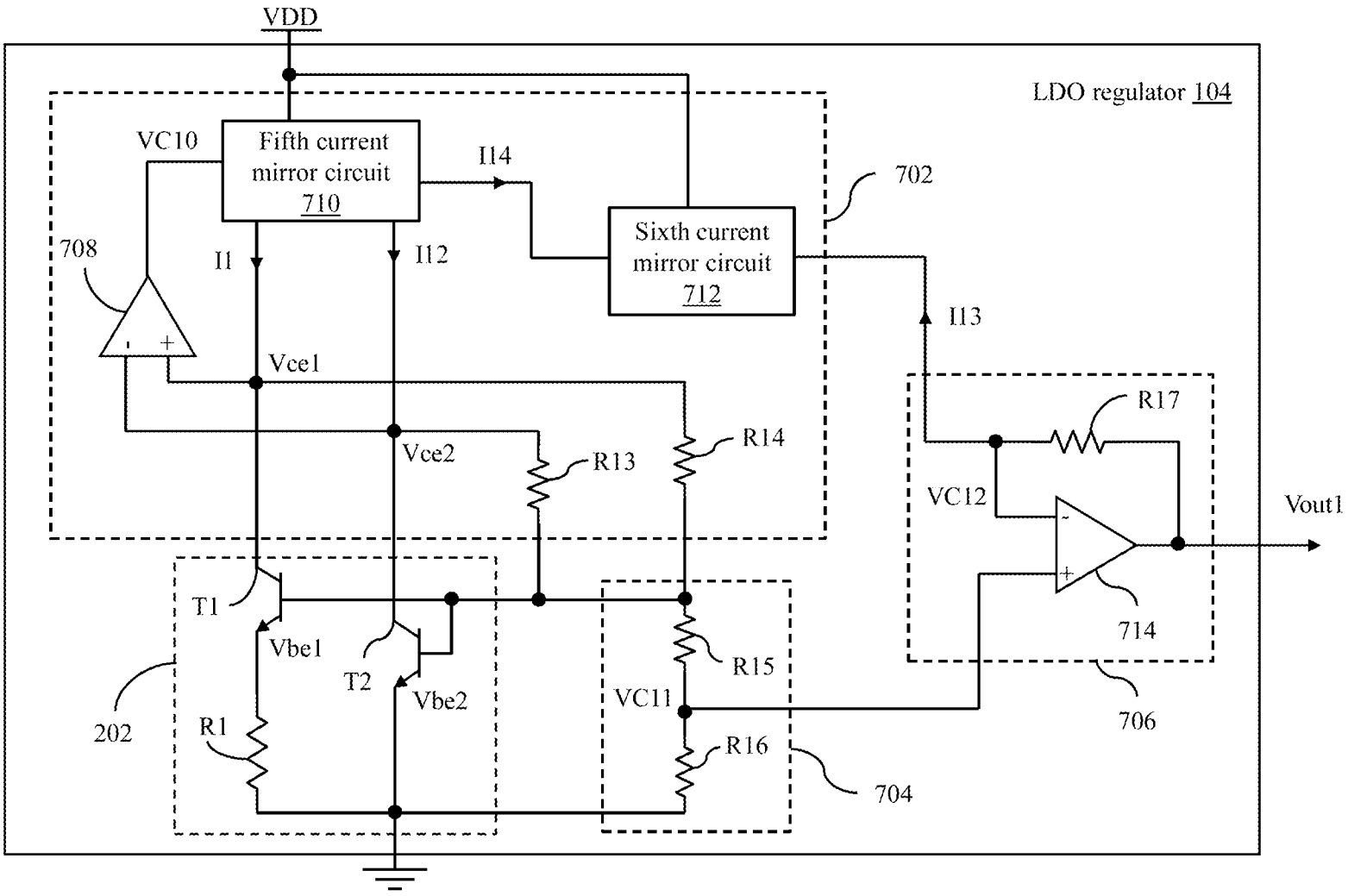
FIG. 7 illustrates a schematic circuit diagram of the LDO regulator of the SoC of FIG. 1 in accordance with yet another embodiment of the present disclosure.

FIG. 7 illustrates a schematic circuit diagram of the LDO regulator 104 in accordance with yet another embodiment of the present disclosure. The LDO regulator 104 can include the first PTAT circuit 202, a third amplification circuit 702, a third voltage divider 704, and a sixth output circuit 706. The LDO regulator 104 of FIG. 7 can be configured to generate and provide the first output voltage Vout1 to the functional circuit 106. The structure and functionality of the first PTAT circuit 202 remain same as described in FIG. 2.

The third amplification circuit 702 can be coupled with the power supply 102, the first PTAT circuit 202 (i.e., the first and second terminals of the first and second transistors T1 and T2), the third voltage divider 704, and the sixth output circuit 706. The third amplification circuit 702 can be configured to receive the supply voltage VDD from the power supply 102. Further, the third amplification circuit 702 can be coupled with the first PTAT circuit 202 (i.e., the first terminal of the first transistor T1) such that the first current I1 is sunk from the third amplification circuit 702. The third amplification circuit 702 can be further configured to receive the first and second collector-emitter voltages Vce1 and Vce2 from the first PTAT circuit 202 (i.e., the first and second terminals of the first and second transistors T1 and T2, respectively). Based on the supply voltage VDD, the first and second collector-emitter voltages Vce1 and Vce2, and the first current I1, the third amplification circuit 702 can be further configured to output twelfth and thirteenth currents I12 and I13. The twelfth and thirteenth currents I12 and I13 can be collectively referred to as a "third set of currents I12 and I13". The twelfth and thirteenth currents I12 and I13 can be equal to the first current I1.

The third amplification circuit 702 can be further configured to provide (i.e., source) the twelfth current I12 to the first terminal of the second transistor T2. The third amplification circuit 702 can output the thirteenth current I13 such that the thirteenth current I13 is sunk from the sixth output circuit 706. The third amplification circuit 702 can include an eighth amplifier 708 and fifth and sixth current mirror circuits 710 and 712.

The eighth amplifier 708 can be coupled with the fifth current mirror circuit 710 and the first PTAT circuit 202 (i.e., the first terminals of the first and second transistors T1 and T2). The eighth amplifier 708 can include suitable circuitry that can be configured to perform one or more operations. For example, the eighth amplifier 708 can be configured to receive the first and second collector-emitter voltages Vce1 and Vce2 from the first PTAT circuit 202 (i.e., the first terminals of the first and second transistors T1 and T2, respectively). In an embodiment, the eighth amplifier 708 receives the first and second collector-emitter voltages Vce1 and Vce2 at positive and negative input terminals thereof, respectively. Based on the first and second collector-emitter voltages Vce1 and Vce2, the eighth amplifier 708 can be further configured to generate a tenth control voltage VC10. The tenth control voltage VC10 can be greater than a difference between the first and second collector-emitter voltages Vce1 and Vce2. The eighth amplifier 708 can be further configured to provide the tenth control voltage VC10 to the fifth current mirror circuit 710.

The fifth current mirror circuit 710 can be coupled with the power supply 102, the first PTAT circuit 202 (i.e., the first terminals of the first and second transistors T1 and T2), the eighth amplifier 708, and the sixth current mirror circuit 712. The fifth current mirror circuit 710 can include suitable circuitry that can be configured to perform one or more operations. For example, the fifth current mirror circuit 710 can be configured to receive the supply voltage VDD from the power supply 102, and the tenth control voltage VC10 from the eighth amplifier 708. Further, the fifth current mirror circuit 710 can be coupled with the first PTAT circuit 202 (i.e., the first terminal of the first transistor T1) such that the first current I1 is sunk from the fifth current mirror circuit 710. Based on the supply voltage VDD, the tenth control voltage VC10, and the first current I1, the fifth current mirror circuit 710 can be further configured to output the twelfth current I12 and a fourteenth current I14. The twelfth and fourteenth currents I12 and I14 can be equal to the first current I1. The fifth current mirror circuit 710 can be further configured to provide (i.e., source) the twelfth and fourteenth currents I12 and I14 to the first terminal of the second transistor T2 and the sixth current mirror circuit 712, respectively.

The sixth current mirror circuit 712 can be coupled with the power supply 102, the fifth current mirror circuit 710, and the sixth output circuit 706. The sixth current mirror circuit 712 can include suitable circuitry that can be configured to perform one or more operations. For example, the sixth current mirror circuit 712 can be configured to receive the supply voltage VDD from the power supply 102, and the fourteenth current I14 from the fifth current mirror circuit 710. Based on the fourteenth current I14 and the supply voltage VDD, the sixth current mirror circuit 712 can be further configured to output the thirteenth current I13. The thirteenth current I13 can be equal to the fourteenth current I14. The sixth current mirror circuit 712 outputs the thirteenth current I13 such that the thirteenth current I13 is sunk from the sixth output circuit 706.

The third amplification circuit 702 can further include thirteenth and fourteenth resistors R13 and R14 each having first and second terminals. The first terminals of the thirteenth and fourteenth resistors R13 and R14 can be coupled with the first terminals of the second and first transistors T2 and T1, respectively. The first terminals of the thirteenth and fourteenth resistors R13 and R14 can be configured to receive the second and first collector-emitter voltages Vce2 and Vce1, respectively. The second terminals of the thirteenth and fourteenth resistors R13 and R14 can be coupled with the third voltage divider 704 and the second terminal of the second transistor T2. In the presently preferred embodiment, resistance values of the thirteenth and fourteenth resistors R13 and R14 are equal.

The third voltage divider 704 can include fifteenth and sixteenth resistors R15 and R16 that have first and second terminals. The first terminal of the fifteenth resistor R15 can be coupled with the second terminal of the second transistor T2 and the second terminals of the thirteenth and fourteenth resistors R13 and R14. The first terminal of the fifteenth resistor R15 can be configured to receive the second base-emitter voltage Vbe2 from the second terminal of the second transistor T2. The first terminal of the fifteenth resistor R15 can be further configured to receive scaled versions of the second and first collector-emitter voltages Vce2 and Vce1 from the second terminals of the thirteenth and fourteenth resistors R13 and R14, respectively. The second terminal of the fifteenth resistor R15 can be further coupled with the sixth output circuit 706. The second terminal of the fifteenth resistor R15 can be further configured to output and provide an eleventh control voltage VC11 to the sixth output circuit 706. The eleventh control voltage VC11 is outputted based on the second base-emitter voltage Vbe2 and resistance values of the thirteenth and fourteenth resistors R13 and R14 (i.e., voltage drops across the thirteenth and fourteenth resistors R13 and R14). The first terminal of the sixteenth resistor R16 can be coupled with the second terminal of the fifteenth resistor R15 and the sixth output circuit 706. Further, the second terminal of the sixteenth resistor R16 can be coupled with the ground terminal.

The sixth output circuit 706 can be coupled with the third voltage divider 704 (i.e., a second terminal of the fifteenth resistor R15), the third amplification circuit 702 (i.e., the sixth current mirror circuit 712), and the functional circuit 106. The sixth output circuit 706 can be configured to receive the eleventh control voltage VC11 from the third voltage divider 704. Further, the sixth output circuit 706 can be coupled with the sixth current mirror circuit 712 such that the thirteenth current I13 is sunk from the sixth output circuit 706. Based on the thirteenth current I13 and the eleventh control voltage VC11, the sixth output circuit 706 can be further configured to generate and provide the first output voltage Vout1 to the functional circuit 106. The sixth output circuit 706 can include a ninth amplifier 714 and a seventeenth resistor R17.

The ninth amplifier 714 can be coupled with the third voltage divider 704 (i.e., the second terminal of the fifteenth resistor R15) and the functional circuit 106. The ninth amplifier 714 can include suitable circuitry that can be configured to perform one or more operations. For example, the ninth amplifier 714 can be configured to receive the eleventh control voltage VC11 from the third voltage divider 704. Further, the ninth amplifier 714 can be configured to receive a twelfth control voltage VC12. In an embodiment, the ninth amplifier 714 receives the eleventh and twelfth control voltages VC11 and VC12 at positive and negative input terminals thereof, respectively. Based on the eleventh and twelfth control voltages VC11 and VC12, the ninth amplifier 714 can be further configured to generate the first output voltage Vout1, and provide the first output voltage Vout1 to the functional circuit 106.

The seventeenth resistor R17 has a first terminal that can be coupled with the ninth amplifier 714 (i.e., an output terminal of the ninth amplifier 714). The first terminal of the seventeenth resistor R17 can be further configured to receive the first output voltage Vout1 from the ninth amplifier 714. The seventeenth resistor R17 further has a second terminal that can be coupled with the sixth current mirror circuit 712 and the ninth amplifier 714 (i.e., the negative input terminal of the ninth amplifier 714). The seventeenth resistor R17 can be thus coupled with the ninth amplifier 714 in a negative feedback configuration. The second terminal of the seventeenth resistor R17 can be coupled with the sixth current mirror circuit 712 such that the thirteenth current I13 outputted by the sixth current mirror circuit 712 is sunk from the second terminal of the seventeenth resistor R17. The second terminal of the seventeenth resistor R17 can be further configured to output and provide the twelfth control voltage VC12 to the ninth amplifier 714 (i.e., the negative input terminal of the ninth amplifier 714) based on the thirteenth current I13 and the first output voltage Vout1. As illustrated in FIG. 7, the first output voltage Vout1 is equal to a sum of the twelfth control voltage VC12 and a voltage drop across the seventeenth resistor R17.

The first output voltage Vout1 generated by the sixth output circuit 706 can be determined as shown below in equation (6):

$$Vout1 = \frac{((0.5 * R17) + R16) * Vbe2}{R15 + R16} + \frac{R17 * \Delta Vbe}{R1} \tag{6}$$

where, $$\frac{((0.5 * R17) + R16) * Vbe2}{R15 + R16}$$

is equal to the twelfth control voltage VC12, and $$\frac{R17 * \Delta Vbe}{R1}$$

is equal to me voltage drop across the seventeenth resistor R17.

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on the resistance value of the first resistor R1 and resistance values of the fifteenth through seventeenth resistors R15-R17, a temperature-independent first output voltage Vout1 may be outputted. A minimum value of the supply voltage VDD required for the LDO regulator 104 of FIG. 7 is equal to a sum of a scaled version of the second base-emitter voltage Vbe2 and drain-source saturation voltages of transistors (not shown) included in the sixth current mirror circuit 712. The scaling factor is equal to "(1+0.5*R13/(R15+R16))". Further, a lowest voltage level of the first output voltage Vout1 can be determined based on drain-source saturation voltages of transistors (not shown) included in the ninth amplifier 714. It will be apparent to a person skilled in the art that the drain-source saturation voltage of the transistor included in the ninth amplifier 714 is less than the first and second collector-emitter voltages Vce1 and Vce2.

Figure 8:
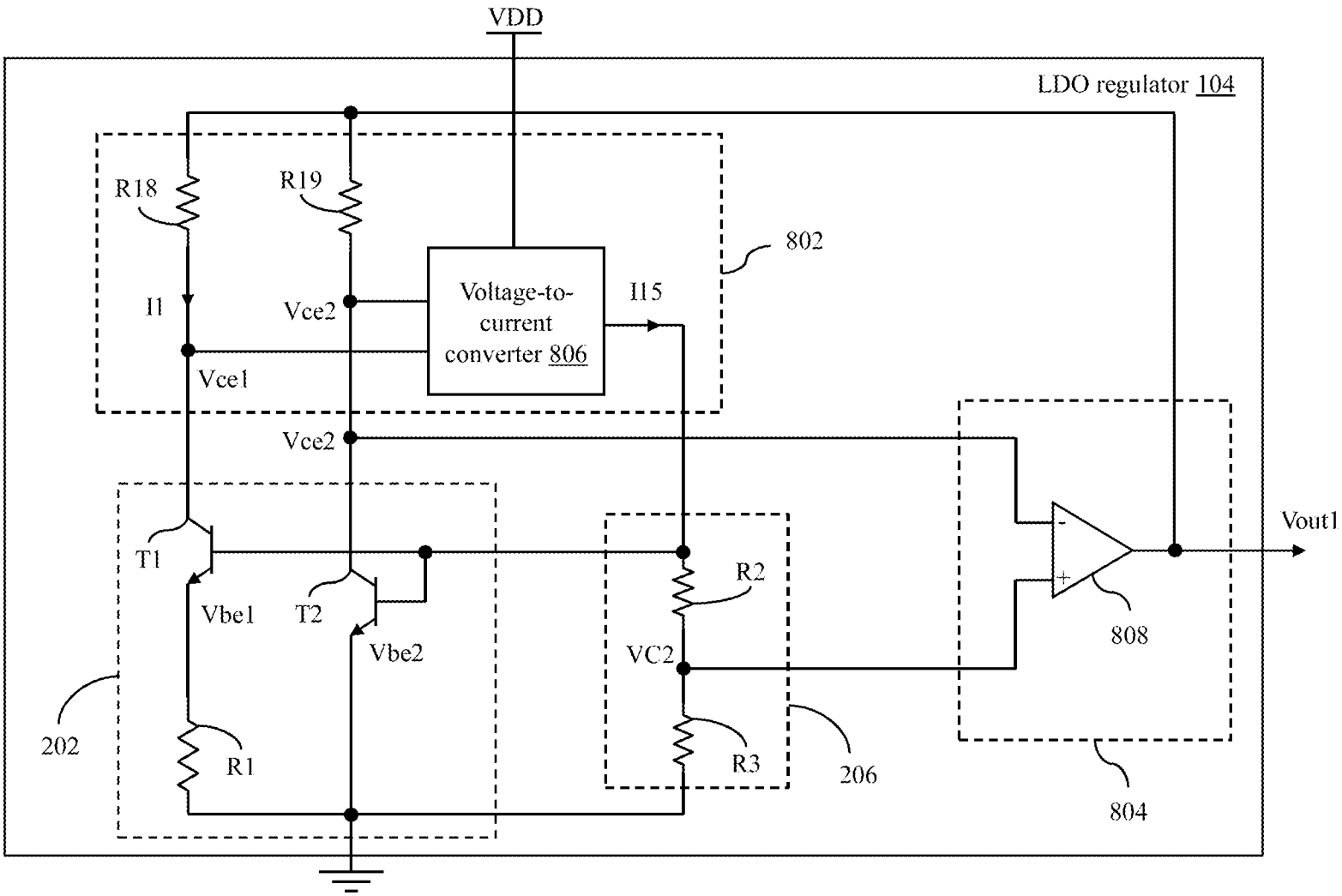
FIG. 8 illustrates a schematic circuit diagram of the LDO regulator of the SoC of FIG. 1 in accordance with yet another embodiment of the present disclosure.

FIG. 8 illustrates a schematic circuit diagram of the LDO regulator 104 in accordance with yet another embodiment of the present disclosure. The LDO regulator 104 can include the first PTAT circuit 202, a fourth amplification circuit 802, the first voltage divider 206, and a seventh output circuit 804. The LDO regulator 104 of FIG. 8 can be configured to generate and provide the first output voltage Vout1 to the functional circuit 106.

The structure and functionalities of the first PTAT circuit 202 and the first voltage divider 206 remain same as described in the LDO regulator 104 of FIG. 2. The difference between the LDO regulator 104 of FIG. 2 and the LDO regulator 104 of FIG. 8 is that the first amplification circuit 204 and the first output circuit 208 in the LDO regulator 104 of FIG. 2 are replaced with the fourth amplification circuit 802 and the seventh output circuit 804 in the LDO regulator 104 of FIG. 8, respectively. Another difference between the LDO regulator 104 of FIG. 2 and the LDO regulator 104 of FIG. 8 is the absence of the current summing circuit 210 in the LDO regulator 104 of FIG. 8.

The fourth amplification circuit 802 can be coupled with the power supply 102, the first PTAT circuit 202 (i.e., the first terminals of the first and second transistors T1 and T2), the first voltage divider 206, and the seventh output circuit 804. The fourth amplification circuit 802 can be configured to receive the supply voltage VDD from the power supply 102, the first and second collector-emitter voltages Vce1 and Vce2 from the first PTAT circuit 202 (i.e., the first terminals of the first and second transistors T1 and T2, respectively). The fourth amplification circuit 802 can be configured to receive the first output voltage Vout1 from the seventh output circuit 804. Further, the fourth amplification circuit 802 can be coupled with the first PTAT circuit 202 (i.e., the first terminal of the first transistor T1) such that the first current I1 outputted by the first terminal of the first transistor T1 is sunk from the fourth amplification circuit 802. Based on the supply voltage VDD, the first and second collector-emitter voltages Vce1 and Vce2, and the first output voltage Vout1, the fourth amplification circuit 802 can be further configured to output a fifteenth current I15. The fourth amplification circuit 802 can be further configured to provide (i.e., source) the fifteenth current I15 to the first voltage divider 206. The first voltage divider 206 can be configured to output the second control voltage VC2 based on the second base-emitter voltage Vbe2 and the fifteenth current I15. The fourth amplification circuit 802 can include a voltage-to-current converter 806 and eighteenth and nineteenth resistors R18 and R19.

The voltage-to-current converter 806 can be coupled with the first PTAT circuit 202 (i.e., the first terminals of the first and second transistors T1 and T2), the power supply 102, and the first voltage divider 206. The voltage-to-current converter 806 can include suitable circuitry that can be configured to perform one or more operations. For example, the voltage-to-current converter 806 can be configured to receive the first and second collector-emitter voltages Vce1 and Vce2 from the first PTAT circuit 202 (i.e., the first terminals of the first and second transistors T1 and T2, respectively). Further, voltage-to-current converter 806 can be configured to receive the supply voltage VDD from the power supply 102. Based on the first and second collector-emitter voltages Vce1 and Vce2 and the supply voltage VDD, the voltage-to-current converter 806 can be further configured to generate the fifteenth current I15. The fifteenth current I15 can be generated based on a difference between the first and second collector-emitter voltages Vce1 and Vce2. The voltage-to-current converter 806 can be further configured to provide (i.e., source) the fifteenth current I15 to the first voltage divider 206 (i.e., the first terminal of the second resistor R2).

The eighteenth resistor R18 has first and second terminals. The first terminal of the eighteenth resistor R18 can be coupled with the seventh output circuit 804. The first terminal of the eighteenth resistor R18 can be configured to receive the first output voltage Vout1 from the seventh output circuit 804. The second terminal of the eighteenth resistor R18 can be coupled with the first PTAT circuit 202 (i.e., the first terminal of the first transistor T1) and the voltage-to-current converter 806. The second terminal of the eighteenth resistor R18 can be configured to receive the first collector-emitter voltage Vce1 from the first terminal of the first transistor T1. Further, the second terminal of the eighteenth resistor R18 can be coupled with the first terminal of the first transistor T1 such that the first current I1 is sunk from the second terminal of the eighteenth resistor R18.

The nineteenth resistor R19 has first and second terminals. The first terminal of the nineteenth resistor R19 can be coupled with the seventh output circuit 804 and the first terminal of the eighteenth resistor R18. The first terminal of the nineteenth resistor R19 can be configured to receive the first output voltage Vout1 from the seventh output circuit 804. The second terminal of the nineteenth resistor R19 can be coupled with the first PTAT circuit 202 (i.e., the first terminal of the second transistor T2) and the voltage-to-current converter 806. The second terminal of the nineteenth resistor R19 can be configured to receive the second collector-emitter voltage Vce2. In the presently preferred embodiment, a resistance value of the nineteenth resistor R19 is equal to a resistance value of the eighteenth resistor R18.

The seventh output circuit 804 can be coupled with the fourth amplification circuit 802 (i.e., the first terminals of the eighteenth and nineteenth resistors R18 and R19) and the first voltage divider 206 (i.e., the second terminal of the second resistor R2). Further, the seventh output circuit 804 can be coupled with the first PTAT circuit 202 (i.e., the first terminal of the second transistor T2) and the functional circuit 106. The seventh output circuit 804 can be configured to receive the second control voltage VC2 from the first voltage divider 206 (i.e., the second terminal of the second resistor R2), and the second collector-emitter voltage Vce2 from the first PTAT circuit 202 (i.e., the first terminal of the second transistor T2). Based on the second control voltage VC2 and the second collector-emitter voltage Vce2, the seventh output circuit 804 can be further configured to generate and provide the first output voltage Vout1 to the functional circuit 106. The seventh output circuit 804 can be further configured to provide the first output voltage Vout1 to the fourth amplification circuit 802 (i.e., the first terminals of the eighteenth and nineteenth resistors R18 and R19). In the presently preferred embodiment, the seventh output circuit 804 corresponds to a tenth amplifier 808.

The tenth amplifier 808 can be coupled with the fourth amplification circuit 802 (i.e., the first terminals of the eighteenth and nineteenth resistors R18 and R19) and the first voltage divider 206 (i.e., the second terminal of the second resistor R2). Further, the tenth amplifier 808 can be coupled with the first PTAT circuit 202 (i.e., the first terminal of the second transistor T2) and the functional circuit 106. The tenth amplifier 808 can include suitable circuitry that can be configured to perform one or more operations. For example, the tenth amplifier 808 can be configured to receive the second control voltage VC2 from the first voltage divider 206 (i.e., the second terminal of the second resistor R2), and the second collector-emitter voltage Vce2 from the first PTAT circuit 202 (i.e., the first terminal of the second transistor T2). In an embodiment, the tenth amplifier 808 receives the second control voltage VC2 and the second collector-emitter voltage Vce2 at positive and negative input terminals thereof, respectively. Based on the second control voltage VC2 and the second collector-emitter voltage Vce2, the tenth amplifier 808 can be further configured to generate and provide the first output voltage Vout1 to the functional circuit 106. The tenth amplifier 808 can be further configured to provide the first output voltage Vout1 to the fourth amplification circuit 802 (i.e., the first terminals of the eighteenth and nineteenth resistors R18 and R19). The first output voltage Vout1 can be greater than a difference between the second control voltage VC2 and the second collector-emitter voltage Vce2. The first output voltage Vout1 generated by the seventh output circuit 804 can be determined as shown below in equation (7):

$$Vout1 = \frac{R3 * Vbe2}{R3 + R2} + \frac{R18 * \Delta Vbe}{R1} \tag{7}$$

where, $$\frac{R18 * \Delta Vbe}{R1}$$

is equal to the voltage drop across the eighteenth resistor R18.

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on the resistance values of the first, second, third, and eighteenth resistors R1, R2, R3, and R18, a temperature-independent first output voltage Vout1 may be outputted. A lowest voltage level of the first output voltage Vout1 can be determined based on drain-source saturation voltages of transistors (not shown) included in the tenth amplifier 808.

Figure 9:
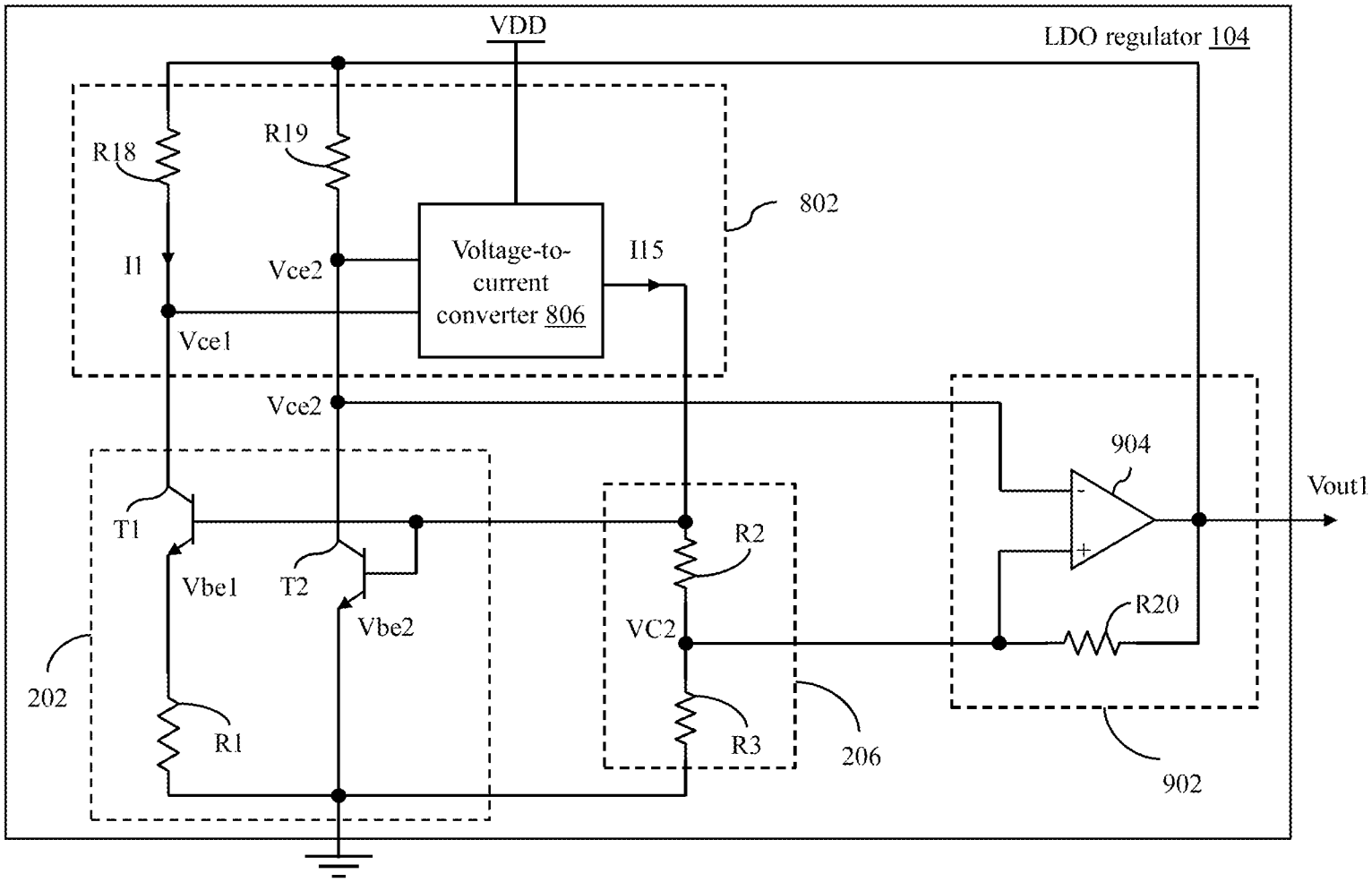
FIG. 9 illustrates a schematic circuit diagram of the LDO regulator of the SoC of FIG. 1 in accordance with yet another embodiment of the present disclosure.

FIG. 9 illustrates a schematic circuit diagram of the LDO regulator 104 in accordance with yet another embodiment of the present disclosure. The LDO regulator 104 can include the first PTAT circuit 202, the fourth amplification circuit 802, the first voltage divider 206, and an eighth output circuit 902. The LDO regulator 104 of FIG. 8 can be configured to generate and provide the first output voltage Vout1 to the functional circuit 106.

The structure and functionalities of the fourth amplification circuit 802, the first PTAT circuit 202, and the first voltage divider 206 remain same as described in FIG. 8. The difference between the LDO regulator 104 of FIG. 8 and the LDO regulator 104 of FIG. 9 is that the seventh output circuit 804 in the LDO regulator 104 of FIG. 8 is replaced with the eighth output circuit 902 in the LDO regulator 104 of FIG. 9.

The eighth output circuit 902 can be coupled with the fourth amplification circuit 802 (i.e., the first terminals of the eighteenth and nineteenth resistors R18 and R19) and the first voltage divider 206 (i.e., the second terminal of the second resistor R2). Further, the eighth output circuit 902 can be coupled with the first PTAT circuit 202 (i.e., the first terminal of the second transistor T2) and the functional circuit 106. The eighth output circuit 902 can be configured to receive the second control voltage VC2 from the first voltage divider 206 (i.e., the second terminal of the second resistor R2), and the second collector-emitter voltage Vce2 from the first PTAT circuit 202 (i.e., the first terminal of the second transistor T2). Based on the second control voltage VC2 and the second collector-emitter voltage Vce2, the eighth output circuit 902 can be further configured to generate and provide the first output voltage Vout1 to the functional circuit 106. The eighth output circuit 902 can be further configured to provide the first output voltage Vout1 to the fourth amplification circuit 802 (i.e., the first terminals of the eighteenth and nineteenth resistors R18 and R19). The eighth output circuit 902 can include an eleventh amplifier 904 and a twentieth resistor R20.

The eleventh amplifier 904 can be coupled with the first voltage divider 206 (i.e., the second terminal of the second resistor R2) and the first PTAT circuit 202 (i.e., the first terminal of the second transistor T2). The eleventh amplifier 904 can include suitable circuitry that can be configured to perform one or more operations. For example, the eleventh amplifier 904 can be configured to receive the second control voltage VC2 from the first voltage divider 206 (i.e., the second terminal of the second resistor R2). Further, the eleventh amplifier 904 can be configured to receive the second collector-emitter voltage Vce2 from the first PTAT circuit 202 (i.e., the first terminal of the second transistor T2). In an embodiment, the eleventh amplifier 904 receives the second control voltage VC2 and the second collector-emitter voltage Vce2 at positive and negative input terminals thereof, respectively. Based on the second control voltage VC2 and the second collector-emitter voltage Vce2, the eleventh amplifier 904 can be further configured to generate the first output voltage Vout1. The first output voltage Vout1 can be greater than a difference between the second control voltage VC2 and the second collector-emitter voltage Vce2. The eleventh amplifier 904 can be further coupled with the fourth amplification circuit 802 (i.e., the first terminals of the eighteenth and nineteenth resistors R18 and R19) and the functional circuit 106. The eleventh amplifier 904 can be further configured to provide the first output voltage Vout1 to the functional circuit 106 and the fourth amplification circuit 802 (i.e., the first terminals of the eighteenth and nineteenth resistors R18 and R19).

The twentieth resistor R20 has a first terminal that can be coupled with the eleventh amplifier 904 (i.e., an output terminal of the eleventh amplifier 904). The first terminal of the twentieth resistor R20 can be further configured to receive the first output voltage Vout1 from the eleventh amplifier 904. The twentieth resistor R20 further has a second terminal that can be coupled with the first voltage divider 206 (i.e., the second terminal of the second resistor R2) and the eleventh amplifier 904 (i.e., the positive input terminal of the eleventh amplifier 904). The twentieth resistor R20 can be thus coupled with the eleventh amplifier 904 in a positive feedback configuration. The second terminal of the twentieth resistor R20 can be configured to receive the second control voltage VC2. Further, the first output voltage Vout1 generated by the eighth output circuit 902 can be determined as shown below in equation (8):

$$Vout1 = \frac{R3 * Vbe2}{R3 + R2} + \frac{R18 * \Delta Vbe * (R20 * (R2 + R3) + (R2 * R3))}{R1 * (R20 * (R2 + R3))} \quad (8)$$

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on the resistance values of the first, second, third, and eighteenth resistors R1, R2, R3, and R18 and a resistance value of the twentieth resistor R20, a temperature-independent first output voltage Vout1 may be generated. A lowest voltage level of the first output voltage Vout1 can be determined based on drain-source saturation voltages of transistors (not shown) included in the eleventh amplifier 904.

Figure 10:
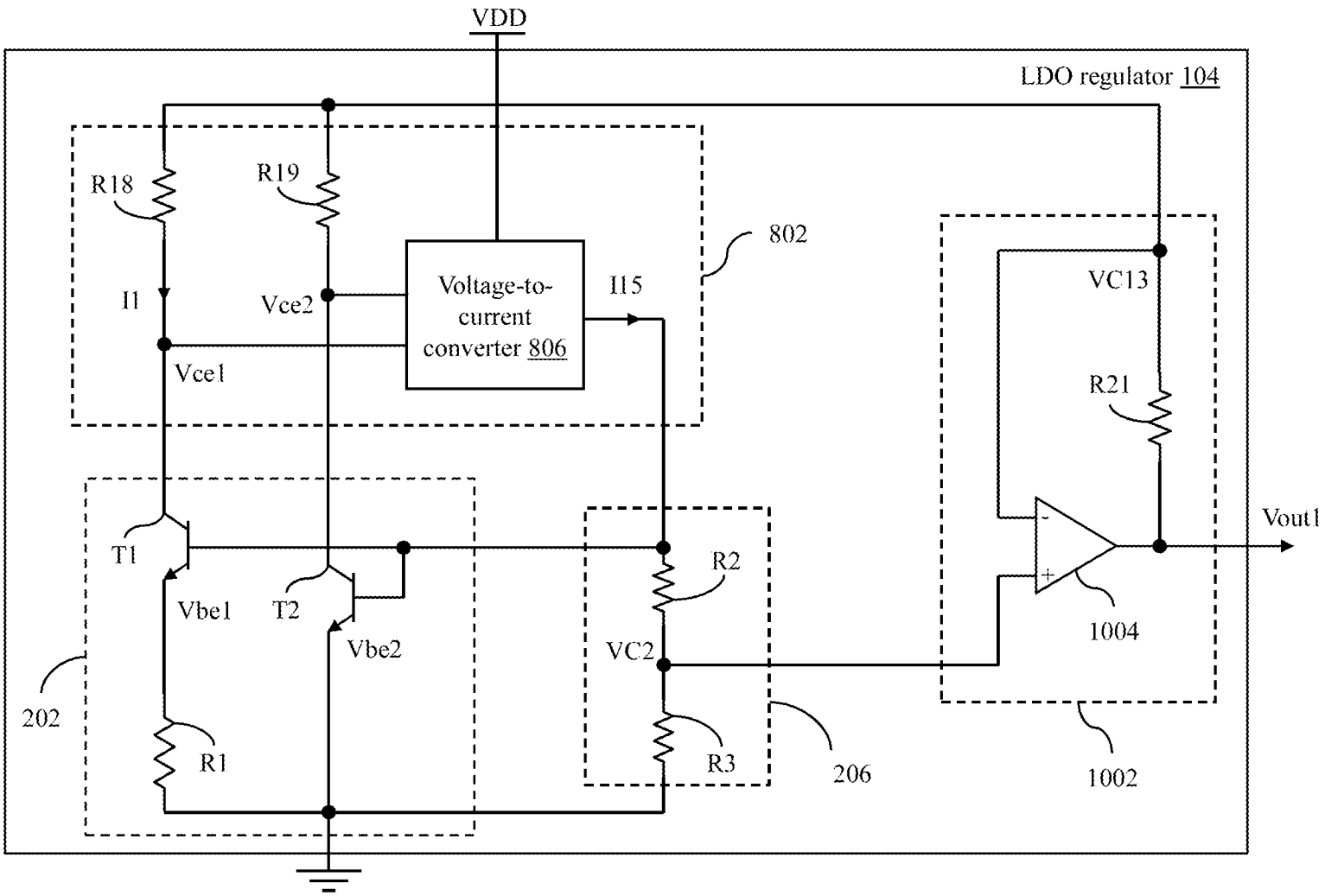
FIG. 10 illustrates a schematic circuit diagram of the LDO regulator of the SoC of FIG. 1 in accordance with yet another embodiment of the present disclosure.

FIG. 10 illustrates a schematic circuit diagram of the LDO regulator 104 in accordance with yet another embodiment of the present disclosure. The LDO regulator 104 can include the first PTAT circuit 202, the fourth amplification circuit 802, the first voltage divider 206, and a ninth output circuit 1002. The LDO regulator 104 of FIG. 10 can be configured to generate and provide the first output voltage Vout1 to the functional circuit 106.

The structure and functionalities of the first PTAT circuit 202, the fourth amplification circuit 802, and the first voltage divider 206 remain same as described in FIG. 8. The difference between the LDO regulator 104 of FIG. 8 and the LDO regulator 104 of FIG. 10 is that the seventh output circuit 804 in the LDO regulator 104 of FIG. 8 is replaced with the ninth output circuit 1002 in the LDO regulator 104 of FIG. 10.

The ninth output circuit 1002 can be coupled with the fourth amplification circuit 802 (i.e., the first terminals of the eighteenth and nineteenth resistors R18 and R19), the first voltage divider 206 (i.e., the second terminal of the second resistor R2), and the functional circuit 106. The ninth output circuit 1002 can be configured to receive the second control voltage VC2 from the first voltage divider 206 (i.e., the second terminal of the second resistor R2). Further, the ninth output circuit 1002 can be configured to output a thirteenth control voltage VC13. Based on the second control voltage VC2 and the thirteenth control voltage VC13, the ninth output circuit 1002 can be further configured to generate and provide the first output voltage Vout1 to the functional circuit 106. The ninth output circuit 1002 can be further configured to provide the thirteenth control voltage VC13 to the fourth amplification circuit 802 (i.e., the first terminals of the eighteenth and nineteenth resistors R18 and R19). The ninth output circuit 1002 can include a twelfth amplifier 1004 and a twenty-first resistor R21.

The twelfth amplifier 1004 can be coupled with the first voltage divider 206 (i.e., the second terminal of the second resistor R2), the twenty-first resistor R21, and the functional circuit 106. The twelfth amplifier 1004 can include suitable circuitry that can be configured to perform one or more operations. For example, the twelfth amplifier 1004 can be configured to receive the second control voltage VC2 from the first voltage divider 206 (i.e., the second terminal of the second resistor R2). Further, the twelfth amplifier 1004 can be configured to receive the thirteenth control voltage VC13 from the twenty-first resistor R21. In an embodiment, the twelfth amplifier 1004 receives the second control voltage VC2 and the thirteenth control voltage VC13 at positive and negative input terminals thereof, respectively. Based on the second control voltage VC2 and the thirteenth control voltage VC13, the twelfth amplifier 1004 can be further configured to generate the first output voltage Vout1 and provide the first output voltage Vout1 to the functional circuit 106. The first output voltage Vout1 can be greater than a difference between the second control voltage VC2 and the thirteenth control voltage VC13.

The twenty-first resistor R21 has a first terminal that can be coupled with the twelfth amplifier 1004 (i.e., an output terminal of the twelfth amplifier 1004). The first terminal of the twenty-first resistor R21 can be further configured to receive the first output voltage Vout1 from the twelfth amplifier 1004. The twenty-first resistor R21 further has a second terminal that can be coupled with the fourth amplification circuit 802 (i.e., the first terminals of the eighteenth and nineteenth resistors R18 and R19) and the twelfth amplifier 1004 (i.e., the negative input terminal of the twelfth amplifier 1004). The twenty-first resistor R21 can be thus coupled with the twelfth amplifier 1004 in a negative feedback configuration. The second terminal of the twenty-first resistor R21 can be configured to output and provide the thirteenth control voltage VC13 to the fourth amplification circuit 802 (i.e., the first terminals of the eighteenth and nineteenth resistors R18 and R19) and the twelfth amplifier 1004 (i.e., the negative input terminal of the twelfth amplifier 1004). The thirteenth control voltage VC13 can be equal to a difference between the first output voltage Vout1 and a voltage drop across the twenty-first resistor R21. The first output voltage Vout1 generated by the ninth output circuit 1002 can be determined as shown below in equation (9):

$$Vout1 = \frac{R2*(R18+2*R21)*Vbe2}{(R3+R2)*R18} + \frac{2*R21*\Delta Vbe}{R1} \tag{9}$$

where, $$\frac{R2*(R18+2*R21)*Vbe2}{(R3+R2)*R18}$$

is equal to the thirteenth control voltage VC13, and $$\frac{2*R21*\Delta Vbe}{R1}$$

is equal to the voltage drop across the twenty-first resistor R21.

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on the resistance values of the first, second, third, and eighteenth R1, R2, R3, and R18, and a resistance value of the twenty-first resistor R21, a temperature-independent first output voltage Vout1 may be outputted. A lowest voltage level of the first output voltage Vout1 can be determined based on drain-source saturation voltages of transistors (not shown) included in the twelfth amplifier 1004.

Figure 11:
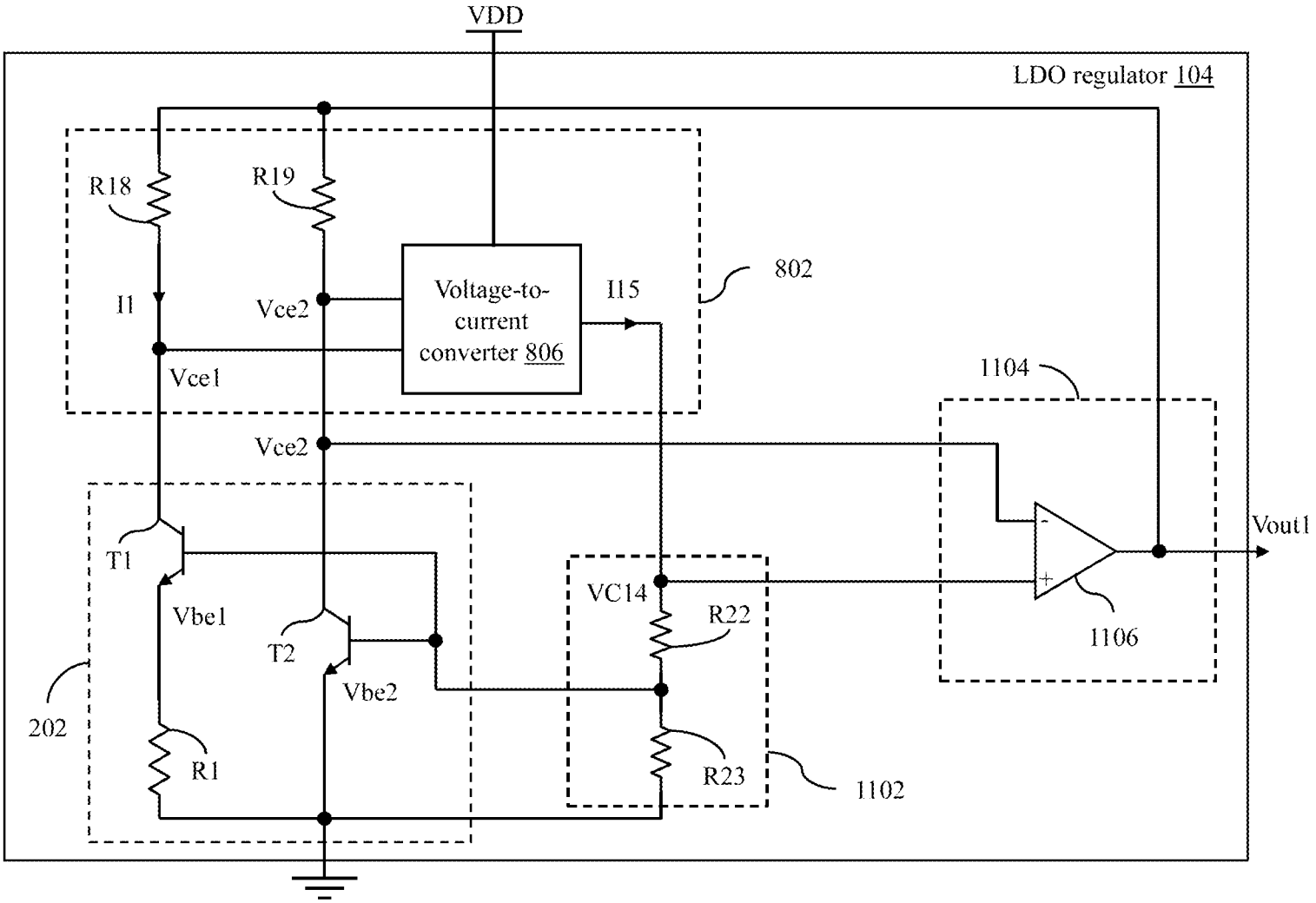
FIG. 11 illustrates a schematic circuit diagram of the LDO regulator of the SoC of FIG. 1 in accordance with yet another embodiment of the present disclosure.

FIG. 11 illustrates a schematic circuit diagram of the LDO regulator 104 in accordance with yet another embodiment of the present disclosure. The LDO regulator 104 can include the first PTAT circuit 202, the fourth amplification circuit 802, a fourth voltage divider 1102, and a tenth output circuit 1104. The LDO regulator 104 of FIG. 11 can be configured to generate and provide the first output voltage Vout1 to the functional circuit 106.

The structure and functionalities of the fourth amplification circuit 802 and the first PTAT circuit 202 remain same as described in FIG. 8. The difference between the LDO regulator 104 of FIG. 8 and the LDO regulator 104 of FIG. 11 is that the first voltage divider 206 and the seventh output circuit 804 in the LDO regulator 104 of FIG. 8 are replaced with the fourth voltage divider 1102 and the tenth output circuit 1104 in the LDO regulator 104 of FIG. 11, respectively.

The fourth voltage divider 1102 can be coupled between the first PTAT circuit 202 (i.e., the second terminal of the second transistor T2) and the ground terminal. Further, the fourth voltage divider 1102 can be coupled with the fourth amplification circuit 802 (i.e., the voltage-to-current converter 806) and the tenth output circuit 1104. The fourth voltage divider 1102 can be configured to receive, from the second terminal of the second transistor T2, the second base-emitter voltage Vbe2 associated with the second transistor T2. Further, the fourth voltage divider 1102 can be configured to receive the fifteenth current I15 from the voltage-to-current converter 806. Based on the second base-emitter voltage Vbe2 and the fifteenth current I15, the fourth voltage divider 1102 can be further configured to output a fourteenth control voltage VC14. In an embodiment, the second base-emitter voltage Vbe2 is a scaled version of the fourteenth control voltage VC14. The fourth voltage divider 1102 can be further configured to provide the fourteenth control voltage VC14 to the tenth output circuit 1104. The fourth voltage divider 1102 can include twenty-second and twenty-third resistors R22 and R23 each having first and second terminals.

The first terminal of the twenty-second resistor R22 can be coupled with the fourth amplification circuit 802 (i.e., the voltage-to-current converter 806) and the tenth output circuit 1104. The first terminal of the twenty-second resistor R22 can be configured to receive the fifteenth current I15 from the fourth amplification circuit 802 (i.e., the voltage-to-current converter 806). Further, the first terminal of the twenty-second resistor R22 can be configured to output and provide the fourteenth control voltage VC14 to the tenth output circuit 1104. The second terminal of the twenty-second resistor R22 can be coupled with the first PTAT circuit 202 (i.e., the second terminal of the second transistor T2). The second terminal of the twenty-second resistor R22 can be configured to receive the second base-emitter voltage Vbe2 associated with the second transistor T2 from the first PTAT circuit 202. The fourteenth control voltage VC14 is thus outputted based on the fifteenth current I15 and the second base-emitter voltage Vbe2. The first terminal of the twenty-third resistor R23 can be coupled with the second terminal of the twenty-second resistor R22. Further, the second terminal of the twenty-third resistor R23 can be coupled with the ground terminal.

Although it is shown that a single resistor (i.e., the twenty-third resistor R23) is coupled between the twenty-second resistor R22 and the ground terminal, it will be apparent to a person skilled in the art that the scope of the present disclosure is not limited to it. In various other embodiments, a series of two or more resistors can be coupled between the twenty-second resistor R22 and the ground terminal, without deviating from the scope of the present disclosure. In such a scenario, a total resistance value of the series of two or more resistors is equal to the resistance value of the twenty-third resistor R23.

The tenth output circuit 1104 can be coupled with the fourth amplification circuit 802 (i.e., the first terminals of the eighteenth and nineteenth resistors R18 and R19) and the fourth voltage divider 1102 (i.e., the first terminal of the twenty-second resistor R22). Further, the tenth output circuit 1104 can be coupled with the first PTAT circuit 202 (i.e., the first terminal of the second transistor T2) and the functional circuit 106. The tenth output circuit 1104 can be configured to receive the fourteenth control voltage VC14 from the fourth voltage divider 1102 (i.e., the first terminal of the twenty-second resistor R22). Further, the tenth output circuit 1104 can be configured to receive the second collector-emitter voltage Vce2 from the first PTAT circuit 202 (i.e., the first terminal of the second transistor T2). Based on the fourteenth control voltage VC14 and the second collector-emitter voltage Vce2, the tenth output circuit 1104 can be further configured to generate the first output voltage Vout1. The tenth output circuit 1104 can be further configured to provide the first output voltage Vout1 to the functional circuit 106 and the fourth amplification circuit 802 (i.e., the first terminals of the eighteenth and nineteenth resistors R18 and R19). In the presently preferred embodiment, the tenth output circuit 1104 can correspond to a thirteenth amplifier 1106.

The thirteenth amplifier 1106 can be coupled with the fourth voltage divider 1102 (i.e., the first terminal of the twenty-second resistor R22) and the first PTAT circuit 202 (i.e., the first terminal of the second transistor T2). Further, the thirteenth amplifier 1106 can be coupled with the fourth amplification circuit 802 (i.e., the first terminals of the eighteenth and nineteenth resistors R18 and R19) and the functional circuit 106. The thirteenth amplifier 1106 can include suitable circuitry that can be configured to perform one or more operations. For example, the thirteenth amplifier 1106 can be configured to receive the fourteenth control voltage VC14 from the fourth voltage divider 1102 (i.e., the first terminal of the twenty-second resistor R22). Further, the thirteenth amplifier 1106 can be configured to receive the second collector-emitter voltage Vce2 from the first PTAT circuit 202 (i.e., the first terminal of the second transistor T2). In an embodiment, the thirteenth amplifier 1106 receives the fourteenth control voltage VC14 and the second collector-emitter voltage Vce2 at positive and negative input terminals thereof, respectively. Based on the fourteenth control voltage VC14 and the second collector-emitter voltage Vce2, the thirteenth amplifier 1106 can be further configured to generate the first output voltage Vout1. Further, the thirteenth amplifier 1106 can be configured to provide the first output voltage Vout1 to the functional circuit 106 and the fourth amplification circuit 802 (i.e., the first terminals of the eighteenth and nineteenth resistors R18 and R19). The first output voltage Vout1 can be greater than a difference between the fourteenth control voltage VC14 and the second collector-emitter voltage Vce2. The first output voltage Vout1 generated by the tenth output circuit 1104 can be determined as shown below in equation (10):

$$Vout1 = \frac{(R23 + R22) * Vbe2}{R23} + \frac{R18 * \Delta Vbe}{R1} \tag{10}$$

where, $$\frac{(R23 + R22) * Vbe2}{R23}$$

is equal to the fourteenth control voltage VC14.

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on the resistance values of the first and eighteenth resistors R1 and R18, and resistance values of the twenty-second and twenty-third resistors R22 and R23, a temperature-independent first output voltage Vout1 may be generated. A lowest voltage level of the first output voltage Vout1 can be determined based on drain-source saturation voltages of transistors (not shown) included in the thirteenth amplifier 1106.

Although FIG. 11 illustrates that the fourth amplification circuit 802 includes the voltage-to-current converter 806 to output the fifteenth current I15, it will be apparent to a person skilled in the art that the scope of the present disclosure is not limited to it. In various other embodiments, the voltage-to-current converter 806 can be replaced by a resistor (not shown), without deviating from the scope of the present disclosure. In such a scenario, the resistor can be coupled between the first terminal of the first transistor T1 and the second terminal of the second transistor T2. Further, the negative terminal of the thirteenth amplifier 1106 can be coupled with the first terminal of the first transistor T1, and the fourth voltage divider 1102 can be coupled with the first terminal of the second transistor T2.

Figure 12:
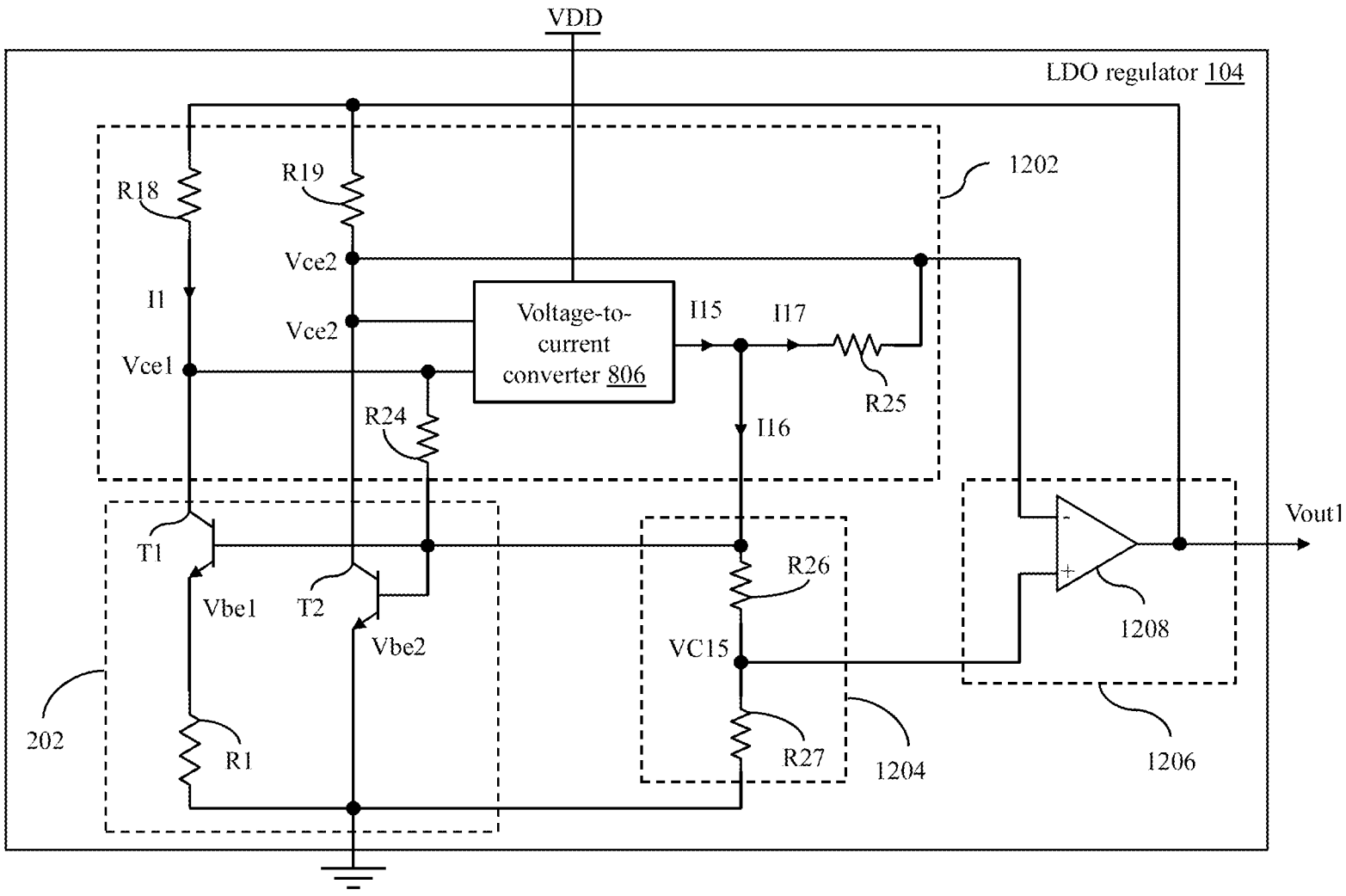
FIG. 12 illustrates a schematic circuit diagram of the LDO regulator of the SoC of FIG. 1 in accordance with yet another embodiment of the present disclosure.

FIG. 12 illustrates a schematic circuit diagram of the LDO regulator 104 in accordance with yet another embodiment of the present disclosure. The LDO regulator 104 can include the first PTAT circuit 202, a fifth amplification circuit 1202, a fifth voltage divider 1204, and an eleventh output circuit 1206. The LDO regulator 104 of FIG. 12 can be configured to generate and provide the first output voltage Vout1 to the functional circuit 106.

The structure and functionality of the first PTAT circuit 202 remain same as described in FIG. 8. The difference between the LDO regulator 104 of FIG. 8 and the LDO regulator 104 of FIG. 12 is that the fourth amplification circuit 802, the first voltage divider 206, and the seventh output circuit 804 in the LDO regulator 104 of FIG. 8 are replaced with the fifth amplification circuit 1202, the fifth voltage divider 1204, and the eleventh output circuit 1206 in the LDO regulator 104 of FIG. 12, respectively.

The fifth amplification circuit 1202 can be coupled with the power supply 102, the first PTAT circuit 202 (i.e., the first terminals of the first and second transistors T1 and T2), the fifth voltage divider 1204, and the eleventh output circuit 1206. The fifth amplification circuit 1202 can be configured to receive the supply voltage VDD from the power supply 102, and the first and second collector-emitter voltages Vce1 and Vce2 from the first PTAT circuit 202 (i.e., the first terminals of the first and second transistors T1 and T2, respectively). Further, the fifth amplification circuit 1202 can be configured to receive the first output voltage Vout1 from the eleventh output circuit 1206. The fifth amplification circuit 1202 can be coupled with the first terminal of the first transistor T1 such that the first current I1 outputted by the first terminal of the first transistor T1 is sunk from the fifth amplification circuit 1202. Based on the supply voltage VDD and the first and second collector-emitter voltages Vce1 and Vce2, the fifth amplification circuit 1202 can be further configured to output the fifteenth current I15. The fifth amplification circuit 1202 can include the voltage-to-current converter 806, the eighteenth and nineteenth resistors R18 and R19, and twenty-fourth and twenty-fifth resistors R24 and R25.

The functionalities of the voltage-to-current converter 806 and the eighteenth and nineteenth resistors R18 and R19 remain same as described in FIG. 8. In LDO regulator 104 of FIG. 12, a portion of the fifteenth current I15 (hereinafter referred to as a "sixteenth current I16") is provided (i.e., sourced) to the fifth voltage divider 1204.

The twenty-fourth resistor R24 has first and second terminals. The first terminal of the twenty-fourth resistor R24 can be coupled with the voltage-to-current converter 806 and the first PTAT circuit 202 (i.e., the first terminal of the first transistor T1). The first terminal of the twenty-fourth resistor R24 can be configured to receive the first collector-emitter voltage Vce1 from the first PTAT circuit 202 (i.e., the first terminal of the first transistor T1). The second terminal of the twenty-fourth resistor R24 can be coupled with the first PTAT circuit 202 (i.e., the second terminal of the first and second transistors T1 and T2) and the fifth voltage divider 1204.

The twenty-fifth resistor R25 has first and second terminals. The first terminal of the twenty-fifth resistor R25 can be coupled with the voltage-to-current converter 806 and the fifth voltage divider 1204. The first terminal of the twenty-fifth resistor R25 can be configured to receive another portion of the fifteenth current I15 (hereinafter referred to as a "seventeenth current I17") from the voltage-to-current converter 806. In other words, the fifteenth current I15 can be equal to a sum of the sixteenth and seventeenth currents I16 and I17. The second terminal of the twenty-fifth resistor R25 can be coupled with the first PTAT circuit 202 (i.e., the first terminal of the second transistor T2) and the eleventh output circuit 1206. The second terminal of the twenty-fifth resistor R25 can be configured to receive the second collector-emitter voltage Vce2. In an embodiment, resistance values of the twenty-fourth and twenty-fifth resistors R24 and R25 are equal.

The fifth voltage divider 1204 can be coupled with the first PTAT circuit 202 (i.e., the second terminal of the second transistor T2) and the ground terminal. Further, the fifth voltage divider 1204 can be coupled with the fifth amplification circuit 1202 (i.e., the voltage-to-current converter 806), the first terminal of the twenty-fifth resistor R25, and the eleventh output circuit 1206. The fifth voltage divider 1204 can be configured to receive, from the second terminal of the second transistor T2, the second base-emitter voltage Vbe2 associated with the second transistor T2. Further, the fifth voltage divider 1204 can be configured to receive the sixteenth current I16 from the voltage-to-current converter 806 and the first terminal of the twenty-fifth resistor R25. Based on the second base-emitter voltage Vbe2 and the sixteenth current I16, the fifth voltage divider 1204 can be further configured to output a fifteenth control voltage VC15. In an embodiment, the fifteenth control voltage VC15 is a scaled version of the second base-emitter voltage Vbe2. The fifth voltage divider 1204 can be further configured to provide the fifteenth control voltage VC15 to the eleventh output circuit 1206. The fifth voltage divider 1204 can include twenty-sixth and twenty-seventh resistors R26 and R27 each having first and second terminals.

The first terminal of the twenty-sixth resistor R26 can be coupled with the first PTAT circuit 202 (i.e., the second terminal of the second transistor T2), the fifth amplification circuit 1202 (i.e., the voltage-to-current converter 806), and the first terminal of the twenty-fifth resistor R25. The first terminal of the twenty-sixth resistor R26 can be configured to receive the second base-emitter voltage Vbe2 from the second terminal of the second transistor T2, and the sixteenth current I16 from the voltage-to-current converter 806 and the first terminal of the twenty-fifth resistor R25. The second terminal of the twenty-sixth resistor R26 can be coupled with the eleventh output circuit 1206. The second terminal of the twenty-sixth resistor R26 can be configured to output and provide the fifteenth control voltage VC15 to the eleventh output circuit 1206. The first terminal of the twenty-seventh resistor R27 can be coupled with the second terminal of the twenty-sixth resistor R26, and the second terminal of the twenty-seventh resistor R27 can be coupled with the ground terminal.

Although it is shown that a single resistor (i.e., the twenty-seventh resistor R27) is coupled between the twenty-sixth resistor R26 and the ground terminal, it will be apparent to a person skilled in the art that the scope of the present disclosure is not limited to it. In various other embodiments, a series of two or more resistors can be coupled between the twenty-sixth resistor R26 and the ground terminal, without deviating from the scope of the present disclosure. In such a scenario, a total resistance value of the series of two or more resistors is equal to the resistance value of the twenty-seventh resistor R27. Further, the fifteenth control voltage VC15 can be outputted at any intermediate terminal of the series of two or more resistors.

The eleventh output circuit 1206 can be coupled with the fifth amplification circuit 1202 (i.e., the first terminals of the eighteenth and nineteenth resistors R18 and R19) and the fifth voltage divider 1204 (i.e., the second terminal of the twenty-sixth resistor R26). Further, the eleventh output circuit 1206 can be coupled with the first PTAT circuit 202 (i.e., the first terminal of the second transistor T2) and the functional circuit 106. The eleventh output circuit 1206 can be configured to receive the fifteenth control voltage VC15 from the fifth voltage divider 1204 (i.e., the second terminal of the twenty-sixth resistor R26). Further, the eleventh output circuit 1206 can be configured to receive the second collector-emitter voltage Vce2 from the first PTAT circuit 202 (i.e., the first terminal of the second transistor T2). Based on the second collector-emitter voltage Vce2 and the fifteenth control voltage VC15, the eleventh output circuit 1206 can be further configured to generate the first output voltage Vout1. The eleventh output circuit 1206 can be further configured to provide the first output voltage Vout1 to the functional circuit 106 and the fifth amplification circuit 1202 (i.e., the first terminals of the eighteenth and nineteenth resistors R18 and R19). In the presently preferred embodiment, the eleventh output circuit 1206 corresponds to a fourteenth amplifier 1208.

The fourteenth amplifier 1208 can be coupled with the fifth voltage divider 1204 (i.e., the second terminal of the twenty-sixth resistor R26) and the first PTAT circuit 202 (i.e., the first terminal of the second transistor T2). Further, the fourteenth amplifier 1208 can be coupled with the fifth amplification circuit 1202 (i.e., the first terminals of eighteenth and nineteenth resistors R18 and R19) and the functional circuit 106. The fourteenth amplifier 1208 can include suitable circuitry that can be configured to perform one or more operations. For example, the fourteenth amplifier 1208 can be configured to receive the fifteenth control voltage VC15 from the fifth voltage divider 1204 (i.e., the second terminal of the twenty-sixth resistor R26). Further, the fourteenth amplifier 1208 can be configured to receive the second collector-emitter voltage Vce2 from the first PTAT circuit 202 (i.e., the first terminal of the second transistor T2). In an embodiment, the fourteenth amplifier 1208 receives the fifteenth control voltage VC15 and the second collector-emitter voltage Vce2 at positive and negative input terminals thereof, respectively.

Based on the fifteenth control voltage VC15 and the second collector-emitter voltage Vce2, the fourteenth amplifier 1208 can be further configured to generate the first output voltage Vout1. Further, the fourteenth amplifier 1208 can be configured to provide the first output voltage Vout1 to the functional circuit 106 and the fifth amplification circuit 1202 (i.e., the first terminals of eighteenth and nineteenth resistors R18 and R19). The first output voltage Vout1 can be greater than a difference between the fifteenth control voltage VC15 and the second collector-emitter voltage Vce2. The first output voltage Vout1 generated by the eleventh output circuit 1206 can be determined as shown below in equation (11):

$$Vout1 = \frac{R27*((R27*R25)-(R18*R26))*Vbe2}{(R27+R26)*(R27*R25)} + \frac{R18*\Delta Vbe}{R1} \quad (11)$$

where, $$\frac{R27*((R27*R25)-(R18*R26))*Vbe2}{(R27+R26)*(R27*R25)}$$

is equal to the fifteenth control voltage VC15.

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on the resistance values of the first, eighteenth, and twenty-fifth through twenty-seventh resistors R1, R18, and R25-R27, a temperature-independent first output voltage Vout1 may be generated. A lowest voltage level of the first output voltage Vout1 can be determined based on drain-source saturation voltages of transistors (not shown) included in the fourteenth amplifier 1208.

Figure 13:
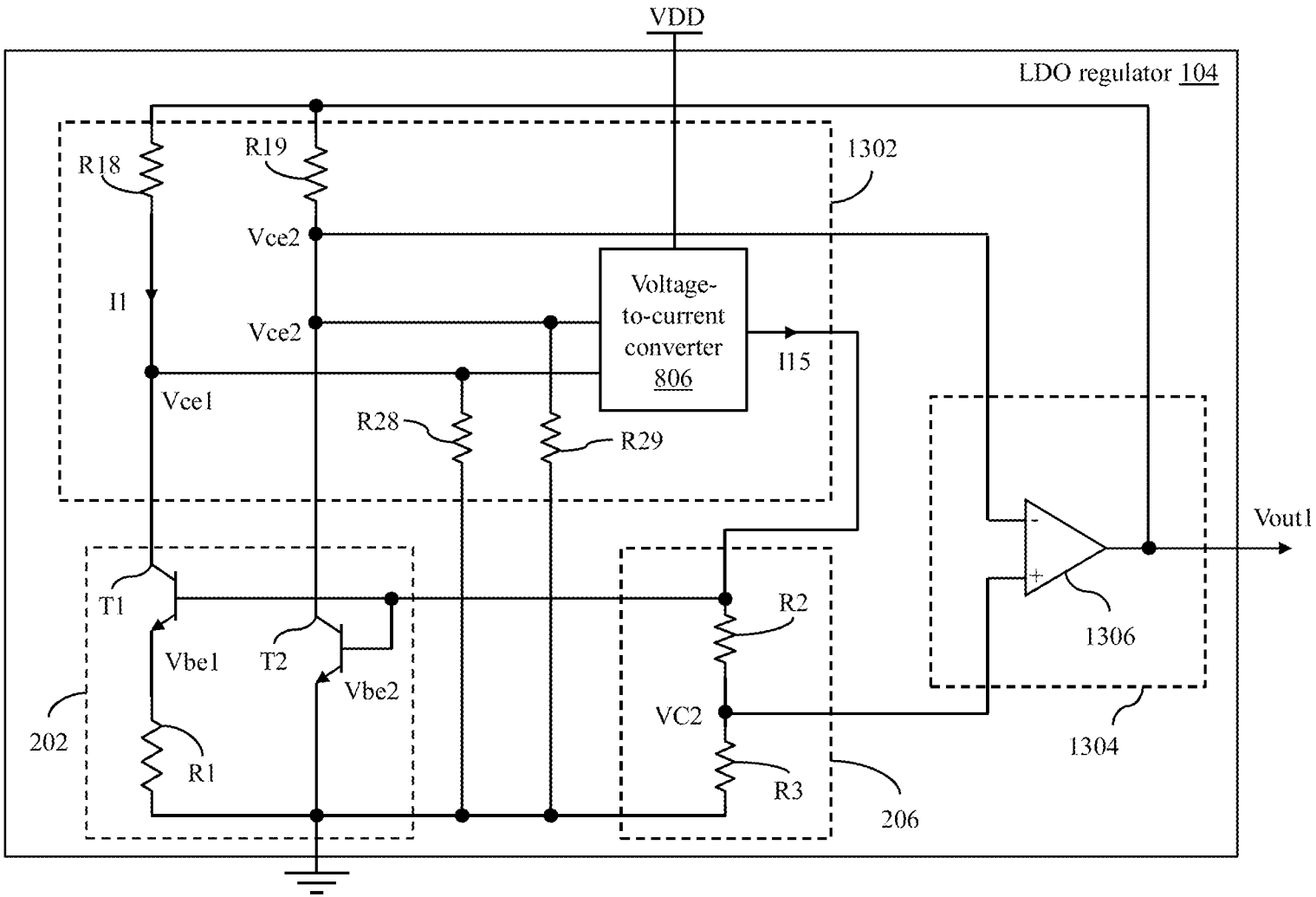
FIG. 13 illustrates a schematic circuit diagram of the LDO regulator of the SoC of FIG. 1 in accordance with yet another embodiment of the present disclosure.

FIG. 13 illustrates a schematic circuit diagram of the LDO regulator 104 in accordance with yet another embodiment of the present disclosure. The LDO regulator 104 can include the first PTAT circuit 202, a sixth amplification circuit 1302, the first voltage divider 206, and a twelfth output circuit 1304. The LDO regulator 104 of FIG. 13 can be configured to generate and provide the first output voltage Vout1 to the functional circuit 106.

The structure and functionalities of the first PTAT circuit 202 and the first voltage divider 206 remain same as described in FIG. 8. The difference between the LDO regulator 104 of FIG. 8 and the LDO regulator 104 of FIG. 13 is that the fourth amplification circuit 802 and the seventh output circuit 804 in the LDO regulator 104 of FIG. 8 are replaced with the sixth amplification circuit 1302 and the twelfth output circuit 1304 in the LDO regulator 104 of FIG. 13, respectively.

The sixth amplification circuit 1302 can be coupled with the power supply 102, the first PTAT circuit 202 (i.e., the first terminals of the first and second transistors T1 and T2), the first voltage divider 206, and the twelfth output circuit 1304. The sixth amplification circuit 1302 can be configured to receive the supply voltage VDD from the power supply 102. Further, the sixth amplification circuit 1302 can be configured to receive the first and second collector-emitter voltages Vce1 and Vce2 from the first PTAT circuit 202 (i.e., the first terminals of the first and second transistors T1 and T2, respectively) and the first output voltage Vout1 from the twelfth output circuit 1304. The sixth amplification circuit 1302 can be coupled with the first terminal of the first transistor T1 such that the first current I1 is sunk from the sixth amplification circuit 1302. Based on the supply voltage VDD and the first and second collector-emitter voltages Vce1 and Vce2, the sixth amplification circuit 1302 can be further configured to output the fifteenth current I15. The sixth amplification circuit 1302 can be further configured to provide (i.e., source) the fifteenth current I15 to the first voltage divider 206. The sixth amplification circuit 1302 can include the voltage-to-current converter 806, the eighteenth and nineteenth resistors R18 and R19, and twenty-eighth and twenty-ninth resistors R28 and R29.

The functionalities of the voltage-to-current converter 806 and the eighteenth and nineteenth resistors R18 and R19 remain same as described in FIG. 8. The twenty-eighth resistor R28 has first and second terminals. The first terminal of the twenty-eighth resistor R28 can be coupled with the voltage-to-current converter 806 and the first PTAT circuit 202 (i.e., the first terminal of the first transistor T1). The first terminal of the twenty-eighth resistor R28 can be configured to receive the first collector-emitter voltage Vce1 from the first PTAT circuit 202 (i.e., from the first terminal of the first transistor T1). The second terminal of the twenty-eighth resistor R28 can be coupled with the ground terminal.

The twenty-ninth resistor R29 has first and second terminals. The first terminal of the twenty-ninth resistor R29 can be coupled with the voltage-to-current converter 806 and the first PTAT circuit 202 (i.e., the first terminal of the second transistor T2). The first terminal of the twenty-ninth resistor R29 can be configured to receive the second collector-emitter voltage Vce2 from the first PTAT circuit 202 (i.e., from the first terminal of the second transistor T2). Further, the second terminal of the twenty-ninth resistor R29 can be coupled with the ground terminal. In an embodiment, resistance values of the twenty-eighth and twenty-ninth resistors R28 and R29 are equal.

The twelfth output circuit 1304 can be coupled with the sixth amplification circuit 1302 (i.e., the first terminals of the eighteenth and nineteenth resistors R18 and R19), the first voltage divider 206, the first PTAT circuit 202 (i.e., the first terminal of the second transistor T2), and the functional circuit 106. The twelfth output circuit 1304 can be configured to receive the second control voltage VC2 from the first voltage divider 206 (i.e., the second terminal of the second resistor R2). Further, the twelfth output circuit 1304 can be configured to receive the second collector-emitter voltage Vce2 from the first PTAT circuit 202 (i.e., the first terminal of the second transistor T2). Based on the second collector-emitter voltage Vce2 and the second control voltage VC2, the twelfth output circuit 1304 can be further configured to generate the first output voltage Vout1. Further, the twelfth output circuit 1304 can be further configured to provide the first output voltage Vout1 to the functional circuit 106 and the sixth amplification circuit 1302 (i.e., the first terminals of the eighteenth and nineteenth resistors R18 and R19). In the presently preferred embodiment, the twelfth output circuit 1304 corresponds to a fifteenth amplifier 1306.

The fifteenth amplifier 1306 can be coupled with the first voltage divider 206 (i.e., the second terminal of the second resistor R2) and the first PTAT circuit 202 (i.e., the first terminal of the second transistor T2). Further, the fifteenth amplifier 1306 can be coupled with the sixth amplification circuit 1302 (i.e., the first terminals of the eighteenth and nineteenth resistors R18 and R19) and the functional circuit 106. The fifteenth amplifier 1306 can include suitable circuitry that can be configured to perform one or more operations. For example, the fifteenth amplifier 1306 can be configured to receive the second control voltage VC2 from the first voltage divider 206 (i.e., the second terminal of the second resistor R2). Further, the fifteenth amplifier 1306 can be configured to receive the second collector-emitter voltage Vce2 from the first PTAT circuit 202 (i.e., the first terminal of the second transistor T2). In an embodiment, the fifteenth amplifier 1306 receives the second control voltage VC2 and the second collector-emitter voltage Vce2 at positive and negative input terminals thereof, respectively. Based on the second control voltage VC2 and the second collector-emitter voltage Vce2, the fifteenth amplifier 1306 can be further configured to generate the first output voltage Vout1. Further, the fifteenth amplifier 1306 can be configured to provide the first output voltage Vout1 to the functional circuit 106 and the sixth amplification circuit 1302 (i.e., the first terminals of the eighteenth and nineteenth resistors R18 and R19). The first output voltage Vout1 can be greater than a difference between the second control voltage VC2 and the second collector-emitter voltage Vce2. The first output voltage Vout1 generated by the twelfth output circuit 1304 can be determined as shown below in equation (12):

$$Vout1 = \frac{R3*(R18+R28)*Vbe2}{(R2+R3)*R28} + \frac{R18*\Delta Vbe}{R1} \tag{12}$$

where, $$\frac{R3*(R18+R28)*Vbe2}{(R2+R3)*R28}$$

is equal to the second control voltage VC2.

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on the resistance values of the first, second, third, eighteenth, and twenty-eighth, resistors R1, R2, R3, R18, and R28, a temperature-independent first output voltage Vout1 may be generated. A lowest voltage level of the first output voltage Vout1 can be determined based on drain-source saturation voltages of transistors (not shown) included in the fifteenth amplifier 1306.

Figure 14:
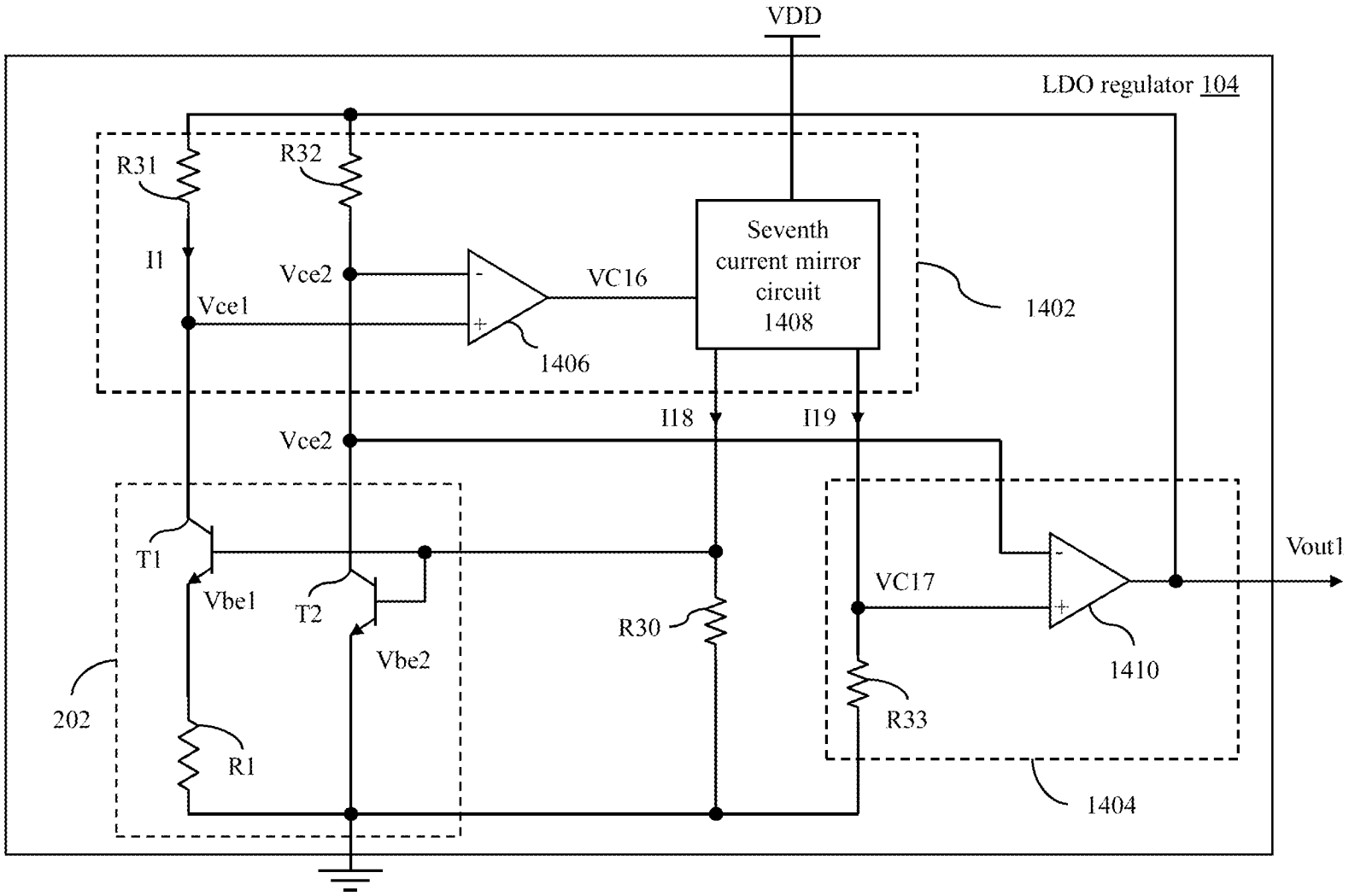
FIG. 14 illustrates a schematic circuit diagram of the LDO regulator of the SoC of FIG. 1 in accordance with yet another embodiment of the present disclosure.

FIG. 14 illustrates a schematic circuit diagram of the LDO regulator 104 in accordance with yet another embodiment of the present disclosure. The LDO regulator 104 can include the first PTAT circuit 202, a seventh amplification circuit 1402, a thirtieth resistor R30, and a thirteenth output circuit 1404. The LDO regulator 104 of FIG. 14 can be configured to generate and provide the first output voltage Vout1 to the functional circuit 106.

The structure and functionality of the first PTAT circuit 202 remain same as described in FIG. 2. The difference between the LDO regulator 104 of FIG. 2 and the LDO regulator 104 of FIG. 14 is that the first amplification circuit 204 and the first output circuit 208 in the LDO regulator 104 of FIG. 2 are replaced by the seventh amplification circuit 1402 and the thirteenth output circuit 1404 in the LDO regulator 104 of FIG. 14, respectively. Further, the first voltage divider 206 is absent in the LDO regulator 104 of FIG. 14.

The seventh amplification circuit 1402 can be coupled with the power supply 102, the first PTAT circuit 202 (i.e., the first terminals of the first and second transistors T1 and T2), the thirtieth resistor R30, and the thirteenth output circuit 1404. The seventh amplification circuit 1402 can be configured to receive the supply voltage VDD from the power supply 102. Further, the seventh amplification circuit 1402 can be coupled with the first terminal of the first transistor T1 such that the first current I1 can be sunk from the seventh amplification circuit 1402. The seventh amplification circuit 1402 can be further configured to receive the first and second collector-emitter voltages Vce1 and Vce2 from the first PTAT circuit 202, and the first output voltage Vout1 from the thirteenth output circuit 1404. Based on the first and second collector-emitter voltages Vce1 and Vce2, the first output voltage Vout1, and the supply voltage VDD, the seventh amplification circuit 1402 can be further configured to output eighteenth and nineteenth currents I18 and I19. The eighteenth and nineteenth currents I18 and I19 can be collectively referred to as a "fourth set of currents I18 and I19". The seventh amplification circuit 1402 can be further configured to provide (i.e., source) the eighteenth current I18 to the thirtieth resistor R30, and the nineteenth current to the thirteenth output circuit 1404. The seventh amplification circuit 1402 can include a sixteenth amplifier 1406, thirty-first and thirty-second resistors R31 and R32, and a seventh current mirror circuit 1408.

The thirty-first resistor R31 has first and second terminals. The first terminal of the thirty-first resistor R31 can be coupled with the thirteenth output circuit 1404. The first terminal of the thirty-first resistor R31 can be configured to receive the first output voltage Vout1 from the thirteenth output circuit 1404. The second terminal of the thirty-first resistor R31 can be coupled with the first PTAT circuit 202 (i.e., the first terminal of the first transistor T1) and the sixteenth amplifier 1406.

The thirty-second resistor R32 has first and second terminals. The first terminal of the thirty-second resistor R32 can be coupled with the thirteenth output circuit 1404 and the first terminal of the thirty-first resistor R31. The first terminal of the thirty-second resistor R32 can be configured to receive the first output voltage Vout1 from the thirteenth output circuit 1404. The second terminal of the thirty-second resistor R32 can be coupled with the first PTAT circuit 202 (i.e., the first terminal of the second transistor T2) and the sixteenth amplifier 1406. In the presently preferred embodiment, a resistance value of the thirty-first resistor R31 is equal to the resistance value of the thirty-second resistor R32.

The sixteenth amplifier 1406 can be coupled with the first PTAT circuit 202 (i.e., the first terminals of the first and second transistors T1 and T2). The sixteenth amplifier 1406 can include suitable circuitry that can be configured to perform one or more operations. For example, the sixteenth amplifier 1406 can be configured to receive the first and second collector-emitter voltages Vce1 and Vce2 from the first PTAT circuit 202 (i.e., the first terminals of the first and second transistors T1 and T2, respectively). In an embodiment, the sixteenth amplifier 1406 receives the first and second collector-emitter voltages Vce1 and Vce2 at positive and negative input terminals thereof, respectively. Based on the first and second collector-emitter voltages Vce1 and Vce2, the sixteenth amplifier 1406 can be further configured to generate a sixteenth control voltage VC16. The sixteenth control voltage VC16 can be greater than the difference between the first and second collector-emitter voltages Vce1 and Vce2.

The seventh current mirror circuit 1408 can be coupled with the power supply 102, the sixteenth amplifier 1406, the thirtieth resistor R30, and the thirteenth output circuit 1404. The seventh current mirror circuit 1408 can include suitable circuitry that can be configured to perform one or more operations. For example, the seventh current mirror circuit 1408 can be configured to receive the supply voltage VDD from the power supply 102 and the sixteenth control voltage VC16 from the sixteenth amplifier 1406. Based on the sixteenth control voltage VC16 and the supply voltage VDD, the seventh current mirror circuit 1408 can be configured to output the eighteenth and nineteenth currents I18 and I19. The nineteenth current I19 can be a scaled version of the eighteenth current I18. For the sake of ongoing discussion, it is assumed that the nineteenth current I19 is "k4" times the eighteenth current I18, where "k4" is a fourth scaling factor. In one example, the fourth scaling factor "k4" is less than one. The seventh current mirror circuit 1408 can be further configured to provide (i.e., source) the eighteenth and nineteenth currents I18 and I19 to the thirtieth resistor R30 and the thirteenth output circuit 1404, respectively.

The thirtieth resistor R30 has first and second terminals. The first terminal of the thirtieth resistor R30 can be coupled with the first PTAT circuit 202 (i.e., the second terminal of the second transistor T2) and the seventh amplification circuit 1402 (i.e., the seventh current mirror circuit 1408). The first terminal of the thirtieth resistor R30 can be configured to receive the second base-emitter voltage Vbe2 from the first PTAT circuit 202 (i.e., the second terminal of the second transistor T2) and the eighteenth current I18 from the seventh amplification circuit 1402 (i.e., the seventh current mirror circuit 1408). The second terminal of the thirtieth resistor R30 can be coupled with the ground terminal. The eighteenth current I18 is thus further outputted based on the second base-emitter voltage Vbe2. As the nineteenth current I19 is a scaled version of the eighteenth current I18, the nineteenth current I19 is further outputted based on the second base-emitter voltage Vbe2.

The thirteenth output circuit 1404 can be coupled with the seventh amplification circuit 1402 (i.e., the first terminals of the thirty-first and thirty-second resistors R31 and R32 and the seventh current mirror circuit 1408). Further, the thirteenth output circuit 1404 can be coupled with the first PTAT circuit 202 (i.e., the first terminal of the second transistor T2) and the functional circuit 106. The thirteenth output circuit 1404 can be configured to receive the nineteenth current I19 from the seventh current mirror circuit 1408. Further, the thirteenth output circuit 1404 can be configured to receive the second collector-emitter voltage Vce2 from the first PTAT circuit 202 (i.e., the first terminal of the second transistor T2). Based on the second collector-emitter voltage Vce2 and the nineteenth current I19, the thirteenth output circuit 1404 can be further configured to generate the first output voltage Vout1. Further, the thirteenth output circuit 1404 can be configured to provide the first output voltage Vout1 to the functional circuit 106 and the seventh amplification circuit 1402 (i.e., the first terminals of the thirty-first and thirty-second resistors R31 and R32). The thirteenth output circuit 1404 can include a seventeenth amplifier 1410 and a thirty-third resistor R33.

The seventeenth amplifier 1410 can be coupled with the first PTAT circuit 202 (i.e., the first terminal of the second transistor T2), the seventh amplification circuit 1402 (i.e., the first terminals of the thirty-first and thirty-second resistors R31 and R32 and the seventh current mirror circuit 1408), and the functional circuit 106. The seventeenth amplifier 1410 can include suitable circuitry that can be configured to perform one or more operations. For example, the seventeenth amplifier 1410 can be configured to receive a seventeenth control voltage VC17. Further, the seventeenth amplifier 1410 can be configured to receive the second collector-emitter voltage Vce2 from the first PTAT circuit 202 (i.e., the first terminal of the second transistor T2). In an embodiment, the seventeenth amplifier 1410 receives the seventeenth control voltage VC17 and the second collector-emitter voltage Vce2 at positive and negative input terminals thereof, respectively.

Based on the seventeenth control voltage VC17 and the second collector-emitter voltage Vce2, the seventeenth amplifier 1410 can be further configured to generate the first output voltage Vout1. Further, the seventeenth amplifier 1410 can be configured to provide the first output voltage Vout1 to the functional circuit 106 and the first terminals of the thirty-first and thirty-second resistors R31 and R32. The first output voltage Vout1 can be greater than a difference between the seventeenth control voltage VC17 and the second collector-emitter voltage Vce2.

The thirty-third resistor R33 has first and second terminals. The first terminal of the thirty-third resistor R33 can be coupled with the seventh amplification circuit 1402 (i.e., the seventh current mirror circuit 1408) and the seventeenth amplifier 1410 (i.e., the positive input terminal of the seventeenth amplifier 1410). The first terminal of the thirty-third resistor R33 can be configured to receive the nineteenth current I19 from the seventh amplification circuit 1402 (i.e., the seventh current mirror circuit 1408), and output the seventeenth control voltage VC17. The first terminal of the thirty-third resistor R33 can be configured to provide the seventeenth control voltage VC17 to the seventeenth amplifier 1410 (i.e., the positive input terminal of the seventeenth amplifier 1410). The second terminal of the thirty-third resistor R33 can be coupled with the ground terminal. In an embodiment, a resistance value of the thirty-third resistor R33 is equal to the resistance values of the thirty-first and thirty-second resistors R31 and R32. The first output voltage Vout1 generated by the thirteenth output circuit 1404 can be determined as shown below in equation (13):

$$Vout1 = R33 * \left( \frac{k4 * Vbe2}{R30} + \frac{\Delta Vbe}{R1} \right) \tag{13}$$

where, $$\frac{R33 * k4 * Vbe2}{R30}$$

is equal to the voltage drop across the thirty-third resistor R33, and $$\frac{R33 * \Delta Vbe}{R1}$$

is equal to the voltage drop across the thirty-second resistor R32.

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on the resistance values of the first, thirtieth, and thirty-third resistors R1, R30, and R33, a temperature-independent first output voltage Vout1 may be outputted. A lowest voltage level of the first output voltage Vout1 can be determined based on drain-source saturation voltages of transistors (not shown) included in the seventeenth amplifier 1410.

FIG. 15 illustrates a schematic circuit diagram of the LDO regulator 104 in accordance with yet another embodiment of the present disclosure. The LDO regulator 104 can include the first PTAT circuit 202, the seventh amplification circuit 1402, the thirtieth resistor R30, and a fourteenth output circuit 1502. The LDO regulator 104 can be configured to generate and provide the first and second output voltages Vout1 and Vout2 to the functional circuit 106.

The structure and functionalities of the seventh amplification circuit 1402, the first PTAT circuit 202, and the thirtieth resistor R30 remain same as described in FIG. 14. The difference between the LDO regulator 104 of FIG. 14 and the LDO regulator 104 of FIG. 15 is that the thirteenth output circuit 1404 in the LDO regulator 104 of FIG. 14 is replaced with the fourteenth output circuit 1502 in the LDO regulator 104 of FIG. 15.

The fourteenth output circuit 1502 can be coupled with the seventh amplification circuit 1402 (i.e., the first terminals of the thirty-first and thirty-second resistors R31 and R32 and the seventh current mirror circuit 1408), the first PTAT circuit 202 (i.e., the first terminal of the second transistor T2), and the functional circuit 106. The fourteenth output circuit 1502 can be configured to receive the nineteenth current I19 from the seventh current mirror circuit 1408. Further, the fourteenth output circuit 1502 can be configured to receive the second collector-emitter voltage Vce2 from the first PTAT circuit 202 (i.e., the first terminal of the second transistor T2). Based on the second collector-emitter voltage Vce2 and the nineteenth current I19, the fourteenth output circuit 1502 can be further configured to generate the first and second output voltages Vout1 and Vout2. Further, the fourteenth output circuit 1502 can be configured to provide the first and second output voltages Vout1 and Vout2 to the functional circuit 106. The fourteenth output circuit 1502 can be further configured to provide the first output voltage Vout1 to the seventh amplification circuit 1402 (i.e., the first terminals of the thirty-first and thirty-second resistors R31 and R32). The fourteenth output circuit 1502 can include an eighteenth amplifier 1504 and a thirty-fourth resistor R34.

The eighteenth amplifier 1504 can be coupled with the first PTAT circuit 202 (i.e., the first terminal of the second transistor T2) and the functional circuit 106. Further, the eighteenth amplifier 1504 can be coupled with the seventh amplification circuit 1402 (i.e., the first terminals of the thirty-first and thirty-second resistors R31 and R32 and the seventh current mirror circuit 1408). The eighteenth amplifier 1504 can include suitable circuitry that can be configured to perform one or more operations. For example, the eighteenth amplifier 1504 can be configured to receive an eighteenth control voltage VC18. Further, the eighteenth amplifier 1504 can be configured to receive the second collector-emitter voltage Vce2 from the first PTAT circuit 202 (i.e., the first terminal of the second transistor T2). In an embodiment, the eighteenth amplifier 1504 receives the eighteenth control voltage VC18 and the second collector-emitter voltage Vce2 at positive and negative input terminals thereof, respectively.

Based on the eighteenth control voltage VC18 and the second collector-emitter voltage Vce2, the eighteenth amplifier 1504 can be further configured to generate the first and second output voltages Vout1 and Vout2. The first output voltage Vout1 is greater than the second output voltage Vout2. The difference between the first and second output voltages Vout1 and Vout2 can be greater than a difference between the eighteenth control voltage VC18 and the second collector-emitter voltage Vce2. Further, the eighteenth amplifier 1504 can be configured to provide the first and second output voltages Vout1 and Vout2 to the functional circuit 106. In an embodiment, the eighteenth amplifier 1504 provides the first output voltage Vout1 and the second output voltage Vout2 to the functional circuit 106 by way of positive and negative output terminals thereof, respectively. The eighteenth amplifier 1504 can be configured to provide the first output voltage Vout1 to the first terminals of the thirty-first and thirty-second resistors R31 and R32.

Although FIG. 15 illustrates that the first and second output voltages Vout1 and Vout2 are provided by way of the positive and negative output terminals of the eighteenth amplifier 1504, respectively, it will be apparent to the person skilled in the art that the scope of the present disclosure is not limited to it. In various other embodiments, the first and second output voltages Vout1 and Vout2 can be provided by way of the negative and positive output terminals of the eighteenth amplifier 1504, without deviating from the scope of the present disclosure. In such a scenario, a direction of the nineteenth current I19 is reversed (i.e., the nineteenth current I19 is outputted by the seventh current mirror circuit 1408 such that the nineteenth current I19 is sunk from the fourteenth output circuit 1502).

The thirty-fourth resistor R34 has first and second terminals. The first terminal of the thirty-fourth resistor R34 can be coupled with the eighteenth amplifier 1504 (i.e., the negative output terminal of the eighteenth amplifier 1504). The first terminal of the thirty-fourth resistor R34 can be configured to receive the second output voltage Vout2 from the eighteenth amplifier 1504 (i.e., the negative output terminal of the eighteenth amplifier 1504). The second terminal of the thirty-fourth resistor R34 can be coupled with the seventh amplification circuit 1402 (i.e., the seventh current mirror circuit 1408) and the eighteenth amplifier 1504 (i.e., the positive input terminal of the eighteenth amplifier 1504). Thus, the thirty-fourth resistor R34 can be coupled with the eighteenth amplifier 1504 in a positive feedback configuration. The second terminal of the thirty-fourth resistor R34 can be configured to receive the nineteenth current I19 from the seventh amplification circuit 1402 (i.e., from the seventh current mirror circuit 1408), and output the eighteenth control voltage VC18. Further, the second terminal of the thirty-fourth resistor R34 can be configured to provide the eighteenth control voltage VC18 to the eighteenth amplifier 1504 (i.e., the positive input terminal of the eighteenth amplifier 1504). In an embodiment, a resistance value of the thirty-fourth resistor R34 is equal to the resistance values of the thirty-first and thirty-second resistors R31 and R32.

The difference of the first and second output voltages Vout1 and Vout2 can be determined as shown below in equation (14):

$$Vout1 - Vout2 = R34 * \left(\frac{k4 * Vbe2}{R30} + \frac{\Delta Vbe}{R1}\right) \quad (14)$$

where, $$\frac{R34 * k4 * Vbe2}{R30}$$

is equal to the eighteenth control voltage VC18, and $$\frac{R34 * \Delta Vbe}{R1}$$

is equal to the voltage drop across the thirty-second resistor R32.

The difference between the first and second base-emitter voltages Vbe1 and Vbe2 (i.e., ΔVbe) has a positive temperature co-efficient, whereas the second base-emitter voltage Vbe2 has a negative temperature co-efficient. Thus, based on the resistance values of the first, thirtieth, and thirty-fourth resistors R1, R30, and R34, the difference between the first and second output voltages Vout1 and Vout2 can be temperature-independent. A lowest voltage level of the first output voltage Vout1 can be determined based on drain-source saturation voltages of transistors (not shown) included in the eighteenth amplifier 1504.

Figure 16:
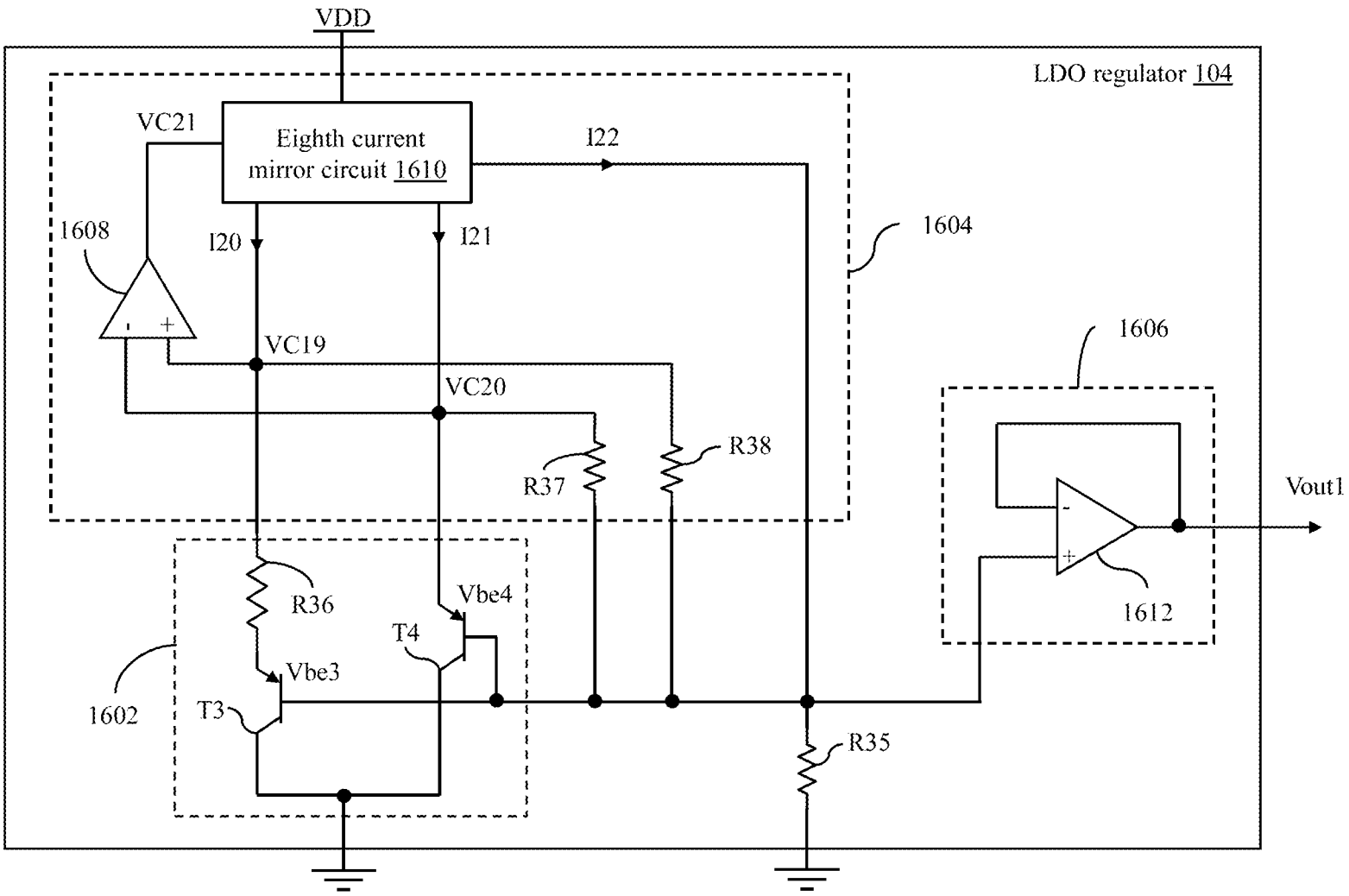
FIG. 16 illustrates a schematic circuit diagram of the LDO regulator of the SoC of FIG. 1 in accordance with yet another embodiment of the present disclosure.

FIG. 16. illustrates a schematic circuit diagram of the LDO regulator 104 in accordance with yet another embodiment of the present disclosure. The LDO regulator 104 can include a second PTAT circuit 1602, an eighth amplification circuit 1604, and a fifteenth output circuit 1606. Further, the LDO regulator 104 can include a thirty-fifth resistor R35. The LDO regulator 104 of FIG. 16 can be configured to generate and provide the first output voltage Vout1 to the functional circuit 106.

The second PTAT circuit 1602 can be coupled between the eighth amplification circuit 1604 and the ground terminal, and further coupled with the thirty-fifth resistor R35. The second PTAT circuit 1602 can be configured to output a twentieth current I20. The twentieth current I20 can be outputted such that the twentieth current I20 is sunk from the eighth amplification circuit 1604. The second PTAT circuit 1602 can include third and fourth transistors T3 and T4, and a thirty-sixth resistor R36.

Each of the third and fourth transistors T3 and T4 has first through third terminals. The first terminals of the third and fourth transistors T3 and T4 can be coupled with the ground terminal. The second terminal of the third transistor T3 can be coupled with the second terminal of the fourth transistor T4. The third terminal of the third transistor T3 can be coupled with the thirty-sixth resistor R36. Further, the third terminal of the fourth transistor T4 can be coupled with the eighth amplification circuit 1604. The third terminal of the fourth transistor T4 can be configured to receive a twenty-first current I21 from the eighth amplification circuit 1604. The thirty-sixth resistor R36 has first and second terminals that can be coupled with the eighth amplification circuit 1604 and the third terminal of the third transistor T3, respectively. The first terminal of the thirty-sixth resistor R36 can be configured to receive the twentieth current I20. Further, the first terminal of the thirty-sixth resistor R36 and the third terminal of the fourth transistor T4 can be configured to output nineteenth and twentieth control voltages VC19 and VC20. In an embodiment, the third and fourth transistors T3 and T4 are PNP transistors, and the first through third terminals of the third and fourth transistors T3 and T4 correspond to collector, base, and emitter terminals, respectively. Further, a size of the third transistor T3 can be greater than a size of the fourth transistor T4. In an example, the size of the third transistor T3 is '8' times the size of the fourth transistor T4.

As the second and third terminals of the third and fourth transistors T3 and T4 correspond to base and emitter terminals, it will be apparent to a person skilled in the art that base-emitter voltages can be generated at junctions between the second and third terminals of the third and fourth transistors T3 and T4. For example, a third base-emitter voltage Vbe3 can be generated at a junction between the second and third terminals of the third transistor T3. Similarly, a fourth base-emitter voltage Vbe4 can be generated at a junction between the second and third terminals of the fourth transistor T4. Further, as the first and third terminals of the third and fourth transistors T3 and T4 correspond to collector and emitter terminals, it will be apparent to a person skilled in the art that collector-emitter voltages can be generated at junctions between the first and third terminals of the third and fourth transistors T3 and T4. For example, third and fourth collector-emitter voltages Vce3 and Vce4 can be generated at junctions between the first and third terminals of the third and fourth transistors T3 and T4, respectively. The nineteenth control voltage VC19 can be a scaled version of the third collector-emitter voltage Vce3, and the twentieth control voltage VC20 can be equal to the fourth collector-emitter voltage Vce4.

The eighth amplification circuit 1604 can be coupled with the power supply 102, the thirty-fifth resistor R35, and the fifteenth output circuit 1606. Further, the eighth amplification circuit 1604 can be coupled with the second PTAT circuit 1602 (i.e., the third terminal of the fourth transistor T4, second terminals of third and fourth transistors T3 and T4, and the first terminal of the thirty-sixth resistor R36). The eighth amplification circuit 1604 can be configured to receive the supply voltage VDD from the power supply 102. Further, the eighth amplification circuit 1604 can be coupled with the second PTAT circuit 1602 (i.e., the first terminal thirty-sixth resistor R36) such that the twentieth current I20 is sunk from the eighth amplification circuit 1604. The eighth amplification circuit 1604 can be configured to receive the nineteenth and twentieth control voltages VC19 and VC20 from the first terminal thirty-sixth resistor R36 and the third terminal of the fourth transistor T4. Based on the supply voltage VDD, the nineteenth and twentieth control voltages VC19 and VC20, and the twentieth current I20, the eighth amplification circuit 1604 can be further configured to output the twenty-first current I21 and a twenty-second current I22.

The eighth amplification circuit 1604 can be configured to provide (i.e., source) the twenty-first current I21 to the second PTAT circuit 1602 (i.e., the third terminal of the fourth transistor T4), and the twenty-second current I22 to the thirty-fifth resistor R35. The eighth amplification circuit 1604 can include a nineteenth amplifier 1608, an eighth current mirror circuit 1610, and thirty-seventh and thirty-eighth resistors R37 and R38.

The nineteenth amplifier 1608 can be coupled with the eighth current mirror circuit 1610 and the second PTAT circuit 1602 (i.e., the first terminal of the thirty-sixth resistor R36 and the third terminal of the fourth transistor T4). The nineteenth amplifier 1608 can include suitable circuitry that can be configured to perform one or more operations. For example, the nineteenth amplifier 1608 can be configured to receive the nineteenth and twentieth control voltages VC19 and VC20 from the second PTAT circuit 1602 (i.e., the first terminal of the thirty-sixth resistor R36 and the third terminal of the fourth transistor T4, respectively). In an embodiment, the nineteenth amplifier 1608 receives the nineteenth and twentieth control voltages VC19 and VC20 at positive and negative input terminals thereof, respectively. Based on the nineteenth and twentieth control voltages VC19 and VC20, the nineteenth amplifier 1608 can be further configured to generate a twenty-first control voltage VC21. The twenty-first control voltage VC21 can be greater than a difference between the nineteenth and twentieth control voltages VC19 and VC20. The nineteenth amplifier 1608 can be further configured to provide the twenty-first control voltage VC21 to the eighth current mirror circuit 1610.

The eighth current mirror circuit 1610 can be coupled with the power supply 102, the second PTAT circuit 1602 (i.e., the first terminal of the thirty-sixth resistor R36 and the third terminal of the fourth transistor T4), and the nineteenth amplifier 1608. The eighth current mirror circuit 1610 can be coupled with the second PTAT circuit 1602 (i.e., the first terminal of the thirty-sixth resistor R36) such that the twentieth current I20 is sunk from the eighth current mirror circuit 1610. The eighth current mirror circuit 1610 can be configured to receive the supply voltage VDD from the power supply 102, and the twenty-first control voltage VC21 from the nineteenth amplifier 1608. Based on the supply voltage VDD, the twenty-first control voltage VC21, and the twentieth current I20, the eighth current mirror circuit 1610 can be further configured to output the twenty-first and twenty-second currents I21 and I22. The twenty-first current I21 can be equal to the twentieth current I20, and the twenty-second current I22 can be a scaled version of the twentieth current I20. For the sake of ongoing discussion, it is assumed that the twenty-second current I22 is "k5" times the twentieth current I20, where "k5" is a fifth scaling factor. In one example, the fifth scaling factor "k5" is less than one. The eighth current mirror circuit 1610 can be further configured to provide (i.e., source) the twenty-first and twenty-second currents I21 and I22 to the third terminal of the fourth transistor T4 and the thirty-fifth resistor R35, respectively.

The thirty-seventh and thirty-eighth resistors R37 and R38 each have first and second terminals. The first terminals of the thirty-seventh and thirty-eighth resistors R37 and R38 can be coupled with the third terminal of the fourth transistor T4 and the first terminal of the thirty-sixth resistor R36, respectively. The first terminals of the thirty-seventh and thirty-eighth resistors R37 and R38 can be configured to receive the twentieth and nineteenth control voltages VC20 and VC19, respectively. The second terminals of the thirty-seventh and thirty-eighth resistors R37 and R38 can be coupled with the second terminal of the fourth transistor T4. In an embodiment, resistance values of the thirty-seventh and thirty-eighth resistors R37 and R38 are equal.

The thirty-fifth resistor R35 has first and second terminals. The first terminal of the thirty-fifth resistor R35 can be coupled with the second PTAT circuit 1602 (i.e., the second terminal of the fourth transistor T4), the eighth amplification circuit 1604 (i.e., the eighth current mirror circuit 1610), and the second terminals of the thirty-seventh and thirty-eighth resistors R37 and R38. The first terminal of the thirty-fifth resistor R35 can be configured to receive the fourth base-emitter voltage Vbe4 from the second PTAT circuit 1602 (i.e., the second terminal of the fourth transistor T4) and the twenty-second current I22 from the eighth amplification circuit 1604 (i.e., the eighth current mirror circuit 1610). The second terminal of the thirty-fifth resistor R35 can be coupled with the ground terminal.

The fifteenth output circuit 1606 can be coupled with the second PTAT circuit 1602 (i.e., the second terminals of the third and fourth transistors T3 and T4), and the functional circuit 106. The fifteenth output circuit 1606 can be configured to receive the fourth base-emitter voltage Vbe4 from the second PTAT circuit 1602 (i.e., the second terminal of the fourth transistor T4). Based on the fourth base-emitter voltage Vbe4, the fifteenth output circuit 1606 can be further configured to generate the first output voltage Vout1. Further, the fifteenth output circuit 1606 can be configured to provide the first output voltage Vout1 to the functional circuit 106. In the presently preferred embodiment, the fifteenth output circuit 1606 corresponds to a twentieth amplifier 1612.

The twentieth amplifier 1612 can be coupled with the second PTAT circuit 1602 (i.e., the second terminal of the fourth transistor T4), the first terminal of the thirty-fifth resistor R35, and the functional circuit 106. The twentieth amplifier 1612 can include suitable circuitry that can be configured to perform one or more operations. For example, the twentieth amplifier 1612 can be configured to receive the fourth base-emitter voltage Vbe4 from the second terminal of the fourth transistor T4. Further, the twentieth amplifier 1612 can be configured to receive the first output voltage Vout1 (i.e., from an output terminal of the twentieth amplifier 1612). In an embodiment, the twentieth amplifier 1612 receives the fourth base-emitter voltage Vbe4 and the first output voltage Vout1 at positive and negative input terminals thereof, respectively. Therefore, the twentieth amplifier 1612 can be configured in a negative feedback configuration. Based on the fourth base-emitter voltage Vbe4, the twentieth amplifier 1612 can be further configured to generate the first output voltage Vout1. Further, the twentieth amplifier 1612 can be configured to provide the first output voltage Vout1 to the functional circuit 106.

The first output voltage Vout1 can be determined as shown below in equation (15):

$$Vout1 = R35 * \left( \frac{(k5 + 2) * Vbe4}{R37} + \frac{k5 * (Vbe3 - Vbe4)}{R36} \right) \tag{15}$$

Figure 17:
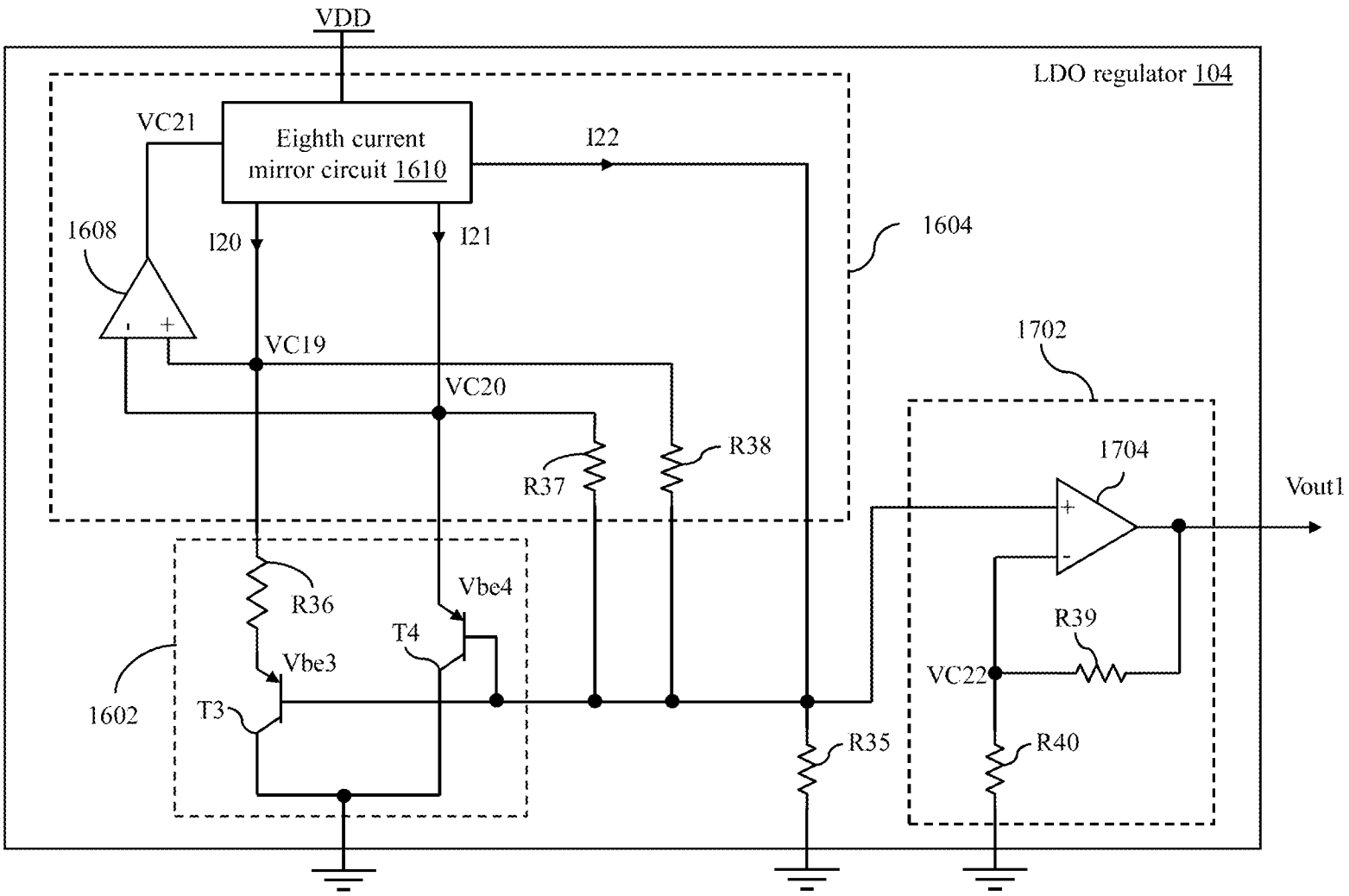
FIG. 17 illustrates a schematic circuit diagram of the LDO regulator of the SoC of FIG. 1 in accordance with yet another embodiment of the present disclosure.

FIG. 17 illustrates a schematic circuit diagram of the LDO regulator 104 in accordance with yet another embodiment of the present disclosure. The LDO regulator 104 can include the second PTAT circuit 1602, the eighth amplification circuit 1604, the thirty-fifth resistor R35, and a sixteenth output circuit 1702. The LDO regulator 104 of FIG. 17 can be configured to generate and provide the first output voltage Vout1 to the functional circuit 106.

The structure and functionalities of the second PTAT circuit 1602, the eighth amplification circuit 1604, and the thirty-fifth resistor R35 remain same as described in FIG. 16. The difference between the LDO regulator 104 of FIG. 16 and the LDO regulator 104 of FIG. 17 is that the fifteenth output circuit 1606 in the LDO regulator 104 of FIG. 16 is replaced with the sixteenth output circuit 1702 in the LDO regulator 104 of FIG. 17.

The sixteenth output circuit 1702 can be coupled with the eighth amplification circuit 1604 (i.e., the eighth current mirror circuit 1610) the first terminal of the thirty-fifth resistor R35, the second PTAT circuit 1602 (i.e., the second terminal of the fourth transistor T4), and the functional circuit 106. The sixteenth output circuit 1702 can be configured to receive the fourth base-emitter voltage Vbe4 from the second PTAT circuit 1602 (i.e., the second terminal of the fourth transistor T4). Based on the fourth base-emitter voltage Vbe4, the sixteenth output circuit 1702 can be further configured to generate and provide the first output voltage Vout1 to the functional circuit 106. The sixteenth output circuit 1702 can include a twenty-first amplifier 1704 and thirty-ninth and fortieth resistors R39 and R40.

The twenty-first amplifier 1704 can be coupled with the eighth amplification circuit 1604 (i.e., the eighth current mirror circuit 1610) and the first terminal of the thirty-fifth resistor R35. Further, the twenty-first amplifier 1704 can be coupled with the second PTAT circuit 1602 (i.e., the second terminal of the fourth transistor T4), the functional circuit 106, and the thirty-ninth and fortieth resistors R39 and R40. The twenty-first amplifier 1704 can include suitable circuitry that can be configured to perform one or more operations. For example, the twenty-first amplifier 1704 can be configured to receive a twenty-second control voltage VC22 from the thirty-ninth resistor R39. Further, the twenty-first amplifier 1704 can be configured to receive the fourth base-emitter voltage Vbe4 from the second PTAT circuit 1602 (i.e., the second terminal of the fourth transistor T4). In an embodiment, the twenty-first amplifier 1704 receives the twenty-second control voltage VC22 and the fourth base-emitter voltage Vbe4 at negative and positive input terminals thereof, respectively. Based on the twenty-second control voltage VC22 and the fourth base-emitter voltage Vbe4, the twenty-first amplifier 1704 can be further configured to generate the first output voltage Vout1. The first output voltage Vout1 can be greater than a difference between the twenty-second control voltage VC22 and the fourth base-emitter voltage Vbe4. The twenty-first amplifier 1704 can be further configured to provide the first output voltage Vout1 to the functional circuit 106 and the thirty-ninth resistor R39.

The thirty-ninth resistor R39 has a first terminal that can be coupled with the twenty-first amplifier 1704 (i.e., an output terminal of the twenty-first amplifier 1704). The first terminal of the thirty-ninth resistor R39 can be further configured to receive the first output voltage Vout1 from the twenty-first amplifier 1704. The thirty-ninth resistor R39 further has a second terminal that can be coupled with the fortieth resistor R40 and the twenty-first amplifier 1704 (i.e., the negative input terminal of the twenty-first amplifier 1704). The thirty-ninth resistor R39 can be thus coupled with the twenty-first amplifier 1704 in a negative feedback configuration. The second terminal of the thirty-ninth resistor R39 can be configured to output the twenty-second control voltage VC22 based on the first output voltage Vout1. Further, the fortieth resistor R40 has a first terminal that can be coupled with the second terminal of the thirty-ninth resistor R39 and the twenty-first amplifier 1704 (i.e., the negative input terminal of the twenty-first amplifier 1704). The fortieth resistor R40 has a second terminal that can be coupled with the ground terminal.

Although FIGS. 2-17 illustrate one output circuit for generating one or two output voltages, it will be apparent to a person skilled in the art that the scope of the present disclosure is not limited to it. In various other embodiments, multiple output circuits can be utilized for each LDO regulator 104 of FIGS. 2-17, without deviating from the scope of the present disclosure. Thus, by utilizing the same PTAT circuit, the LDO regulator 104 can generate multiple output voltages.

Thus, an output voltage (i.e., the first output voltage Vout1) generated by the LDO regulator 104 of the present disclosure is a sum of a scaled version of a base-emitter voltage (e.g., the second base-emitter voltage Vbe2) and a scaled version of the difference between two base-emitter voltages (i.e., ΔVbe). Further, a lowest voltage level of the output voltage (i.e., the first and second output voltages Vout1 and Vout2) generated by the LDO regulator 104 is limited by the drain-source saturation voltages associated with transistors included in an amplifier of an output circuit of the LDO regulator 104. A drain-source saturation voltage is significantly less than a collector-emitter voltage of a transistor. As a result, the lowest voltage level of the output voltage generated by the LDO regulator 104 is less than that generated by a conventional LDO regulator where the lowest voltage level of the output voltage is limited by collector-emitter voltages of transistors included therein. Further, the LDO regulator 104 can include multiple output circuits that can utilize the same PTAT circuit (e.g., the first PTAT circuit 202) to generate multiple output voltages. Additionally, the LDO regulator 104 can generate and provide the output current Tout to the functional circuit 106. As a result, a need to include current reference circuits and multiple LDO regulators in the SoC 100 is eliminated. Thus, a size and a manufacturing cost of the SoC 100 that includes the LDO regulator 104 of the present disclosure are significantly less than that of an SoC including multiple conventional LDO regulators and current reference circuits.

While various embodiments of the present disclosure have been illustrated and described, it will be clear that the present disclosure is not limited to these embodiments only. Numerous modifications, changes, variations, substitutions, and equivalents will be apparent to those skilled in the art, without departing from the spirit and scope of the present disclosure, as described in the claims. Further, unless stated otherwise, terms such as "first" and "second" are used to arbitrarily distinguish between the elements such terms describe. Thus, these terms are not necessarily intended to indicate temporal or other prioritization of such elements.

What is claimed is:

1. A low dropout (LDO) regulator, comprising:

a proportional-to-absolute-temperature (PTAT) circuit configured to output a first current, wherein the PTAT circuit comprises a plurality of transistors;

an amplification circuit that is coupled with the PTAT circuit, and configured to output a second set of currents based on one of (i) first and second collector-emitter voltages associated with first and second transistors of the plurality of transistors, respectively, and (ii) the first current and the first and second collector-emitter voltages; and an output circuit that is configured to generate an output voltage based on at least one of a second current of the second set of currents and a base-emitter voltage associated with the second transistors;

wherein each transistor of the first and second transistors has first through third terminals, and the first terminals of the first and second transistors are coupled with the amplification circuit, wherein the first terminal of the first transistor is configured to output the first current, the second terminal of the first transistor is coupled with the second terminal of the second transistor, and the third terminal of the second transistor is coupled with a ground terminal, and wherein the PTAT circuit further comprises a first resistor that is coupled between the third terminal of the first transistor and the ground terminal;

a voltage divider that is coupled between the second terminal of the second transistor and the ground terminal, and configured to output a first control voltage such that the first control voltage is a scaled version of the base-emitter voltage associated with the second transistor.

2. The LDO regulator of claim 1, wherein the amplification circuit comprises:

a first current mirror circuit that is coupled with the first terminals of the first and second transistors and the output circuit, and configured to output, based on a supply voltage and the first current, the second current and third and fourth currents of the second set of currents, wherein the third current is equal to the first current, and the first current mirror circuit is further configured to provide the third current to the first terminal of the second transistor, wherein the second and fourth currents are scaled versions of the first current, and wherein the first current mirror circuit outputs the second current such that the second current is sunk from the output circuit;

a first amplifier that is coupled with the first terminals of the first and second transistors, and configured to receive the first and second collector-emitter voltages, respectively, and generate a second control voltage; and a second current mirror circuit that is coupled with the first amplifier and the voltage divider, and configured to output, based on the supply voltage and the second control voltage, fifth and sixth currents of the second set of currents such that the sixth current is a scaled version of the fifth current, wherein the second current mirror circuit is further configured to provide the fifth current to the voltage divider, and wherein the voltage divider outputs the first control voltage based on the fifth current.

3. The LDO regulator of claim 2, further comprising a current summing circuit that is coupled with the first and second current mirror circuits, and configured to receive the fourth and sixth currents, respectively, and generate an output current that is equal to a sum of the fourth and sixth currents.

4. The LDO regulator of claim 2, wherein the output circuit comprises:

a second amplifier that is coupled with the voltage divider, and configured to receive the first control voltage and a third control voltage, and generate the output voltage; and a second resistor that is coupled with the second amplifier in a negative feedback configuration, wherein the second resistor is further coupled with the first current mirror circuit such that the second current outputted by the first current mirror circuit is sunk from the second resistor, and wherein the second resistor is further configured to output and provide, based on the second current, the third control voltage to the second amplifier.

5. The LDO regulator of claim 2, wherein the output circuit comprises:

a third amplifier that is coupled with the voltage divider, and configured to receive the first control voltage and a fourth control voltage, and generate the output voltage; and third and fourth resistors that are coupled with the third amplifier in negative and positive feedback configurations, respectively, wherein the third resistor is further coupled with the first current mirror circuit such that the second current outputted by the first current mirror circuit is sunk from the third resistor, wherein the fourth resistor is further coupled with the voltage divider, and configured to receive the first control voltage, and wherein the third resistor is further configured to output and provide, based on the second current and a voltage drop across the fourth resistor, the fourth control voltage to the third amplifier.

6. The LDO regulator of claim 1, wherein:

the amplification circuit comprises:

a first current mirror circuit that is coupled with the first terminals of the first and second transistors and the voltage divider, and configured to output, based on a supply voltage and the first current, the second current and a third current of the second set of currents, wherein the third current is equal to the first current, and the first current mirror circuit is further configured to provide the third current to the first terminal of the second transistor, and wherein the second current is a scaled version of the first current, and the first current mirror circuit is further configured to provide the second current to the voltage divider;

a first amplifier that is coupled with the first terminals of the first and second transistors, and configured to receive the first and second collector-emitter voltages, respectively, and generate a second control voltage; and a second current mirror circuit that is coupled with the first amplifier and the voltage divider, and configured to output, based on the supply voltage and the second control voltage, fourth and fifth currents of the second set of currents such that the fifth current is a scaled version of the fourth current, wherein the fifth current corresponds to an output current of the LDO regulator, and wherein the second current mirror circuit is further configured to provide the fourth current to the voltage divider, the voltage divider further outputs the first control voltage based on the second current and the fourth current, and the output circuit corresponds to a second amplifier that is coupled in a negative feedback configuration, and further coupled with the voltage divider, and configured to receive the first control voltage, and generate the output voltage.

7. The LDO regulator of claim 1, wherein the amplification circuit comprises:

fifth and sixth resistors that are coupled with the first terminals of the first and second transistors, respectively, wherein the fifth and sixth resistors are further configured to receive one of (i) the output voltage and (ii) a fifth control voltage; and a voltage-to-current converter that is coupled with the first terminals of the first and second transistors and the voltage divider, and configured to receive a supply voltage and the first and second collector-emitter voltages, and output and provide the second current to the voltage divider, wherein the voltage divider outputs the first control voltage based on the second current.

8. The LDO regulator of claim 7, wherein the output circuit corresponds to a fifth amplifier that is coupled with the voltage divider and the first terminal of the second transistor, and configured to receive the first control voltage and the second collector-emitter voltage, respectively, and generate and provide the first output voltage to the fifth and sixth resistors.

9. The LDO regulator of claim 7, wherein the output circuit comprises:

a sixth amplifier that is coupled with the voltage divider, and configured to receive the first control voltage and the fifth control voltage, and generate the first output voltage; and a seventh resistor that is coupled with the sixth amplifier in a negative feedback configuration, and further coupled with the fifth and sixth resistors, wherein the seventh resistor is further configured to output and provide the fifth control voltage to the sixth amplifier and the fifth and sixth resistors.

10. The LDO regulator of claim 7, wherein the output circuit comprises:

a seventh amplifier that is coupled with the voltage divider and the first terminal of the second transistor, and configured to receive the first control voltage and the second collector-emitter voltage, respectively, and generate and provide the first output voltage to the fifth and sixth resistors; and an eighth resistor that is coupled with the seventh amplifier in a positive feedback configuration, and further coupled with the voltage divider.

11. The LDO regulator of claim 1, wherein the amplification circuit comprises:

a third current mirror circuit that is coupled with the first terminals of the first and second transistors, and configured to output seventh and eighth currents of the second set of currents based on a supply voltage, a sixth control voltage, and the first current, wherein the seventh current is equal to the first current, and the third current mirror circuit is further configured to provide the seventh current to the first terminal of the second transistor, and wherein the eighth current is a scaled version of the first current;

an eighth amplifier that is coupled with the first terminals of the first and second transistors and the third current mirror circuit, and configured to receive the first and second collector-emitter voltages, and generate and provide the sixth control voltage to the third current mirror circuit; and a fourth current mirror circuit that is coupled with the third current mirror circuit, the first terminal of the first transistor, the output circuit, and the voltage divider, and configured to output the second current and a ninth current of the second set of currents based on the supply voltage, the eighth current, and the first collector-emitter voltage, wherein the fourth current mirror circuit outputs the second current such that the second current is sunk from the output circuit, wherein the fourth current mirror circuit is further configured to output and provide the ninth current to the voltage divider, and wherein the voltage divider outputs the first control voltage based on the ninth current.

12. The LDO regulator of claim 11, wherein the output circuit comprises:

a ninth amplifier that is coupled with the voltage divider, and configured to receive the first control voltage and a seventh control voltage, and generate the output voltage; and a ninth resistor that is coupled with the ninth amplifier in a negative feedback configuration, and further coupled with the fourth current mirror circuit, wherein the second current outputted by the fourth current mirror circuit is sunk from the ninth resistor, and wherein the ninth resistor is further configured to output and provide, based on the second current, the seventh control voltage to the ninth amplifier.

13. The LDO regulator of claim 1, wherein the amplification circuit comprises:

tenth and eleventh resistors that are coupled with the first terminals of the first and second transistors, respectively, wherein the tenth and eleventh resistors are further coupled with the output circuit, and configured to receive the output voltage;

a tenth amplifier that is coupled with the first terminals of the first and second transistors, and configured to receive the first and second collector-emitter voltages, respectively, and generate an eighth control voltage; and a fifth current mirror circuit that is coupled with the tenth amplifier, and configured to output the second current based on a supply voltage, the eighth control voltage, and the base-emitter voltage associated with the second transistor, wherein the fifth current mirror circuit is further coupled with the output circuit, and configured to provide the second current to the output circuit.

14. The LDO regulator of claim 13, wherein the output circuit comprises:

an eleventh amplifier that is coupled with the first terminal of the second transistor, and configured to receive the second collector-emitter voltage and a ninth control voltage, and generate the output voltage; and a twelfth resistor that is coupled between the fifth current mirror circuit and the ground terminal, and further coupled with the eleventh amplifier, and configured to receive the second current, and output and provide, based on the second current, the ninth control voltage to the eleventh amplifier.

15. The LDO regulator of claim 13, wherein the output circuit comprises:

a twelfth amplifier that is coupled with the first terminal of the second transistor, and configured to receive the second collector-emitter voltage and a tenth control voltage, and generate the output voltage and a second output voltage; and a thirteenth resistor that is coupled with the twelfth amplifier in a positive feedback configuration, and further coupled with the fifth current mirror circuit, and configured to receive the second output voltage and the second current, and output and provide the tenth control voltage to the twelfth amplifier.

16. The LDO regulator of claim 1, wherein the amplification circuit comprises:

a sixth current mirror circuit that is coupled with the first terminals of the first and second transistors and the output circuit, and configured to output, based on a supply voltage and the first current, the second current and a tenth current of the second set of currents, wherein the tenth current is equal to the first current, and the sixth current mirror circuit is further configured to provide the tenth current to the first terminal of the second transistor, wherein the second current is a scaled version of the first current, and wherein the sixth current mirror circuit outputs the second current such that the second current is sunk from the output circuit;

a thirteenth amplifier that is coupled with the first terminals of the first and second transistors, and configured to receive the first and second collector-emitter voltages, respectively, and generate an eleventh control voltage; and a seventh current mirror circuit that is coupled with the thirteenth amplifier, and configured to output an eleventh current of the second set of currents based on the supply voltage, the eleventh control voltage, and the base-emitter voltage associated with the second transistor, wherein the seventh current mirror circuit is further coupled with the output circuit, and configured to provide the eleventh current to the output circuit.

17. The LDO regulator of claim 16, wherein the output circuit comprises:

a fourteenth amplifier that is coupled with the sixth and seventh current mirror circuits, and configured to receive twelfth and thirteenth control voltages, and generate the output voltage and a second output voltage;

a fourteenth resistor that is coupled with the fourteenth amplifier in a negative feedback configuration, and further coupled with the sixth current mirror circuit, wherein the second current outputted by the sixth current mirror circuit is sunk from the fourteenth resistor, and wherein the fourteenth resistor is further configured to output and provide, based on the second current and the first output voltage, the twelfth control voltage to the fourteenth amplifier; and a fifteenth resistor that is coupled with the fourteenth amplifier in a positive feedback configuration, and further coupled with the seventh current mirror circuit, and configured to receive the second output voltage and the eleventh current, and output and provide the thirteenth control voltage to the fourteenth amplifier.

* * * * *